United States Patent [19]

Tate et al.

[11] Patent Number: 5,022,441

[45] Date of Patent: Jun. 11, 1991

[54] PAPERMAKER'S DOUBLE LAYER FABRIC WITH HIGH WARP AND WEFT VOLUME PER REPEAT

[75] Inventors: Takuo Tate, Hachiouji; Taketoshi Watanabe; Hiroyuki Nagura, both of Inagi, all of Japan

[73] Assignee: Nippon Filcon Co., Ltd., Ikejiri, Japan

[21] Appl. No.: 369,452

[22] Filed: Jun. 21, 1989

[30] Foreign Application Priority Data

| | | | |
|---|---|---|---|
| Jun. 27, 1988 | [JP] | Japan | 63-156692 |
| Jun. 27, 1988 | [JP] | Japan | 63-156693 |
| Jul. 6, 1988 | [JP] | Japan | 63-166989 |
| Nov. 25, 1988 | [JP] | Japan | 63-296003 |
| Nov. 25, 1988 | [JP] | Japan | 63-296004 |
| Nov. 25, 1988 | [JP] | Japan | 63-296005 |

[51] Int. Cl.[5] ..... D03D 13/00

[52] U.S. Cl. ..... 139/383 A; 139/413

[58] Field of Search ..... 139/383 A, 425 A, 413, 139/414, 410, 408; 162/DIG. 1

[56] References Cited

U.S. PATENT DOCUMENTS

| | | | |
|---|---|---|---|
| 4,709,732 | 12/1987 | Kinnunen | 139/383 A |
| 4,789,009 | 12/1988 | Troughton | 139/393 A |
| 4,867,206 | 9/1989 | Kufferable | 139/383 A |

*Primary Examiner*—Andrew M. Falik

*Attorney, Agent, or Firm*—Bucknam and Archer

[57] ABSTRACT

A papermakers' double layer type fabric comprises in one repeat a warp layer consisting of n (an integer of at least 7)×2 of warps, and n (an integer of at least 7)×2 of wefts arranged on the warp layer as the upper surface wefts and n (an integer of at least 7)×2 of wefts arranged under the warp layer as the lower surface wefts. The lower surface wefts consist of polyester yarns and polyamide yarns, the lower surface polyamide wefts being each interlaced once in one repeat with a warp and the lower surface polyester wefts being each interlaced once or twice in one repeat with a warp.

20 Claims, 67 Drawing Sheets

PAPERMAKER'S DOUBLE LAYER FABRIC WITH HIGH WARP AND WEFT VOLUME PER REPEAT

BACKGROUND OF THE INVENTION

1. Field of the Invention

This invention relates to papermakers' double layer type fabrics.

2. Description of the Prior Art

There have heretofore been many requirements for papermakers' fabrics. The requirements may be roughly sorted into the following three groups:

Group I Prevention of generation of wire marking, sufficient tanglement of cellulosic fibers, and problems as to the quality of paper or as to the retention of paper obtained;

Group II Improvement in wear resistance of fabrics and extension of the service life thereof; and Group III Satisfactory drainage, and the like.

The requirements in the respective groups are associated with one another in many respects. Roughly speaking, the problems in group I are greatly associated mainly with the structure of the papermaking side surface of the fabric, the problems in group II are greatly associated with the structure of the running side surface (which is the reverse side surface or roller side surface) of the fabric, and the problems in group III are associated with the entire fabric.

There have heretofore been proposed many approaches to the solution of the problems in group I. However, there have not been made sufficient efforts to improve the papermakers' fabrics in wear resistance except that the running side of the fabric has been made to take a wefts-wearing form only to prevent the warps of the fabric from being worn.

On the other hand, there have recently been made many requirements such as the rate of papermaking, an increase in amounts of filler used, an increased necessity of manufacturing neutral paper, and, in addition, a serious problem has been raised as to the wear resistance of the papermaking fabrics.

To improve the papermakers' fabrics in wear resistance, it has been attempted to use polyamide yarns but papermakers' fabrics in which polyamide yarns are used are defective in that they are apt to stretch and have poor runability (posture or shape stability).

Thus, polyester yarns which are poor in wear resistance but excellent in rigidity, have heretofore been mainly used in the preparation of papermakers' fabrics which are stretchable with difficulty and excellent in runability.

In such heretofore-used papermakers' fabrics, the crimps of wefts in the running side surface (which is the reverse side surface or roller side surface of the fabric) are identical in length with one another and are short as explained with reference to FIG. 59 which will be stated later. It has been attempted to improve even such conventional papermakers' fabrics use of yarns having a large diameter as wefts in the running side surface of the fabric, whereby the fabrics are improved in wear resistance to some extent but the thus improved fabrics are defective in that, because the wefts are large in diameter, the balance between the wefts and the warps is lost so that the crimpness is affected and wire marking occurs. Thus, such conventional improved papermakers' fabrics are those which raise too many problems from the standpoint of their practical use.

In addition, as is understood from the problems of Group III, a change in the structure of the running side surface will affect the drainage of the fabric and the problems will not be solved by a makeshift means such as the use of large wefts in the running side surface.

SUMMARY OF THE INVENTION

In view of the above conventional technical problems, the object of this invention is to improve papermakers' fabrics in wear resistance without having any adverse effects on papermaking performance such as the drainage and anti-wire marking property of the fabrics.

The papermakers' double layer type fabric of this invention comprises in one repeat a warp layer consisting of n (an integer of at least 7)×2 of warps, and n (an integer of at least 7)×2 of wefts arranged on the warp layer as the upper surface wefts and n (an integer of at least 7)×2 of wefts arranged under said warp layer as the lower surface wefts, the lower surface wefts consisting of polyester yarns and polyamide yarns, the lower surface polyamide wefts being each interlaced once in one repeat with a warp and the lower surface polyester wefts being each interlaced once or twice in one repeat with a warp.

The papermakers' fabric of this invention has the above structure formed in the running side surface and, therefore, the papermaking side surface of a double layer type, triple layer type or other multi-layer type fabric is very little influenced by such a structure and the papermaking performance of the fabric is hardly affected with no substantial changes in drainage and antiwire marking property.

Since the papermakers' double layer type fabric of this invention has such a structure as above in the running side surface, both the lower surface (running side surface) polymer (polyamide and polyester) wefts or the lower surface polyamide wefts have long crimps which are satisfactory in crimpiness as described later, so that large in diameter lower surface wefts, are formed particularly large lower surface polyamide wefts, whereby the fabric can be improved in wear resistance.

The function of the above-mentioned structure will be detailed hereunder.

The wear resistance of the running side surface will be increased by increasing the to-be-worn volume of wefts which form the running side. In addition, it is desirable to have the wefts exert wear resistant actions in order to keep runability (stable the posture or shape) of a fabric in use and extend the service life of the fabric. This is because, if the warps are worn, then the fabric will change in dimension and will be torn off whereby its service life is shortened.

The papermakers' double layer type fabrics are those which are increased in the to-be worn volume of the wefts in the running side (the reverse side of the papermaking side) surface and greatly improved in wear resistance without changing the surface properties, such as supportability of pulp fibers and anti-wire marking property, of conventional papermakers' fabrics and are obtained by arranging, for example, alternately polyester wefts having excellent rigidity and good runability (posture stability) and polyamide wefts having excellent wear resistance to have the polyester wefts exert runability (posture stability) actions and allow both the lower surface polymer wefts or the lower surface polyamide wefts to have long crimps.

In fact, as explained later with reference to the following FIGS. 7 and 8, in the knuckles of a papermakers' fabric which are formed by interlacing the warps with the wefts to sharply bend these yarns, there exist weft portions which do not exert wear resistant actions because of the configuration of crimp of the wefts. In other words, in this invention, a fabric having a lower number of knuckles in a fixed area can have less weft portions contributing nothing to wear resisting actions whereby an effective to-be-worn volume can be increased and the wear resistance of the fabric is enhanced accordingly. Further, in this case, the drainage of the fabric also improves.

In addition, crimpiness which is an indicator showing warps' capability of overcoming the repulsive force of wefts and press bending the wefts when the warps bend the wefts, will be improved if the length of one crimp, that is the distance (or space) between the warps which push upward the lower (running side) surface weft respectively to form knuckles nearest to each other, is set great. The improvement in crimpiness permits the use of large (in diameter) wefts.

In this invention as mentioned above, the crimps of all the lower surface wefts or the lower polyamide wefts forming the running side surface of the fabric are longer then those of conventional wefts and, therefore, the crimpiness is better so that the use of large (in diameter) lower surface wefts is possible, something which heretofore it has not been possible to use, particularly lower surface polyamide wefts, this making it possible to enlarge the volume to be worn of lower surface wefts as compared with a conventional fabric.

It is also preferable in the papermakers' double layer type fabrics that the lower surface polyamide wefts be larger (in diameter) than the lower surface polyester wefts since the wear resistance of the running side surface of the fabric is effectively improved by the use of polyamide wefts which have excellent wear resistance of the lower surface wefts and have been made of large diameter (in diameter).

In the papermakers' double layer type fabric of this invention wherein the polyester and polyamide wefts are arranged in the lower surface of the war layer and both the lower surface polymer wefts are each interlaced once with a warp in one repeat (the fabric being hereinafter sometimes called "fabric A" for convenience' sake), the ratio in number between the lower surface polyester wefts and the lower surface polyamide wefts used in the fabric is not particularly limited, and only either of them may be used as the lower surface wefts.

Further, the papermakers' double layer type fabric A may be modified to form a papermakers' double layer type fabric B as follows.

In the fabric A, there is arranged, as part of the warps, at least one warp which does not interlace with lower surface polyester and polyamide wefts and the lower surface polymer wefts are each interlaced once in one repeat of the fabric with a pair of warps which are arranged adjacent to each other with said non-interlacing warp being arranged between the pair of warps, and, further, knuckles are formed respectively on the lower surface wefts in the staggered relation so that the knuckles are not situated adjacent to each other, whereby a papermakers' double layer type fabric having even better properties may desirably be obtained (the thus obtained fabric being hereinafter sometimes called "fabric B" for convenience' sake).

The warps which do not interlace with the lower surface wefts forming the running side surface, will not wear during the use of the fabric since they are not exposed to the running side surface and, therefore, they are neither elongated nor torn off. Thus, the arrangement of said non-interlacing warps in the fabric B further improves the fabric in runability (posture stability) and is effective in preventing the fabric from being torn off. Further, the destruction of papermaking machines and the damage of slice lips which are nozzles through which pulp is flown, caused by the torn-off of a papermakers' fabric rotating at a high speed and the spatter of the torn off fabric, are prevented by the abrasion and torn-off of the warps interlacing with the lower surface wefts.

Further, in the fabric B, a pair of the warps which are adjacent to each other with the warp, which does not interlace with any of the lower surface wefts, being arranged therebetween, press bend a weft in the running side (lower) surface and interlace with each weft at one position in one repeat. In general, a plurality of adjacent warps can surely bend a weft at one position in one repeat with larger bending strength than one warp can. In a case where, in this manner, a plurality of adjacent warps bend each weft once in one repeat to form knuckles, the plurality of warps are pushed to approach one another by the repulsive force of the wefts whereby the warps which approach one another are lacking in a planar drainage space and lower the drainage. Thus, in the fabric, non-uniformity of drainage is apt to be caused and wire marking is likely to be produced. These disadvantages are overcome by forming a structure in which a warp interlacing none of the lower surface wefts is arranged between a pair of warps interlacing with a lower surface weft, thus each lower surface weft being interlaced with the pair of warps. In the fabric B, each of the lower surface wefts is bent with high strength by the pair of warps and interlaced therewith at one position in one repeat, and, thus, crimpiness becomes more satisfactory without having any adverse effects on the drainage of the fabric thereby to permit the use of larger diameter wefts and improve remarkably the fabric in wear resistance.

Further, in the fabric B, since the knuckles in which the warp crosses the lower surface weft and interlaces with the latter are formed on every adjacent wefts in the staggered relation, they are not unevenly distributed so that they prevent the uneven distribution of drainage spaces and achieve an effect of smoothing the running side surface.

Regarding the fabric B, in a case where a warp interlacing with none of the lower surface weft and arranged between a pair of warps interlacing with a lower surface weft, slips upward out of between the pair of warps at a position (knuckle), where the pair of warps interlace with a lower surface weft, to interlace with a weft in the upper surface, that is the papermaking side surface, it is preferable that the pair of warps closely approach each other to strongly bend a lower surface weft and interlace with the latter thus remarkably improving crimpiness. In the above knuckles, the pair of warps approach each other and the planar drainage spaces decrease accordingly; however, drainage spaces are three-dimensionally formed by the presence of a warp between the pair of warps, thus preventing the uneven distribution of the drainage spaces.

In addition, the warp interlacing with none of the lower surface polymeric (polyester and polyamide) wefts and the warp interlacing with a lower surface polymeric weft, may be alternately arranged; or the warp interlacing with none of the lower surface polymeric wefts and the plurality of warps interlacing with a lower surface polymeric weft may also be alternately arranged.

Even in the fabric B, as previously mentioned, it is preferable that the lower surface polyamide wefts have a larger diameter than the lower surface polyester wefts. The ratio in number between the lower surface polyester wefts and lower surface polyamide wefts used is not particularly limited, and the polyester yarns and polyamide yarns may be mixedly woven for use as the lower surface wefts or either of said two kinds of yarns may also be used alone for the same purpose as above.

In one type of a papermakers' double layer type fabric of this invention in which the lower surface polyamide wefts are each interlaced once in one repeat with a warp and the lower surface polyester wefts are each interlaced twice in one repeat with a warp (this fabric being hereinafter sometimes called "fabric C" for convenience' sake), the lower surface (running side surface) polyamide wefts, which wefts, which are excellent in wear resistance, form long crimps as in the fabric A and, therefore, crimpiness becomes satisfactory as previously mentioned thereby permitting the arrangement of large (in diameter) wefts which heretofore it has not been possible to use and enabling the to-be-worn volume to be remarkably enlarged. Accordingly, the fabric can be conspicuously improved in wear resistance without changing the surface properties of conventional papermakers' fabrics as in the fabric A. On the other hand, since the lower surface polyester wefts having excellent rigidity are each interlaced twice with a warps in one repeat, they provide rigidity to the fabric thereby further increasing it in runability (posture stability). This is due to the fact that in a case where the number of times the wefts are interlaced with the warps in one repeat is increased, the effect of the wefts for providing rigidity for the fabric becomes remarkable.

Also in the fabric C, as previously mentioned, it is preferable that the lower surface polyamide wefts have a larger diameter than the lower surface polyester wefts.

Further, in the fabric C, the lower surface wefts whose crimps are different in length (the lower surface polyester wefts and the lower surface polyamide wefts) may not be alternately arranged. The lower surface wefts forming long crimps (or long crimp-forming wefts) and those forming short crimps (or short crimp-forming wefts) may not be in equal number. It is preferable that the number of the lower surface polyamide wefts (long crimp-forming wefts) and that of the lower surface polyester wefts arranged (short crimp-forming wefts) be in the ratio of from 3:1 to 1:3 (including 2:1, 3:2, 1:1, 2:3 and 1:2).

It is preferable from the standpoint of a balance between the wear resistance and runability (posture retentivity) of a fabric that in the lower surface (running side surface) wefts, long crimp-forming wefts and short crimp-forming wefts be arranged in a ratio (in number) of from 3:1 to 1:3. The long crimp-forming wefts are very effective in contributing to the improvement of a fabric in wear resistance, but they are not very effective in retaining the posture of the fabric since the wefts are not interlaced with the warps rather many times. On the other hands, the short crimp-forming wefts are highly effective in retaining the posture of the fabric but they are little slightly effective in improving the fabric in wear resistance. The use of the long crimp-forming lower surface wefts and short crimp-forming ones in a ratio (in number) of more than 3:1, undesirably tends to worsen the fabric in runability (posture retentivity); whereas the use thereof in a ratio of less than 1:3 undesirably improves little the fabric in wear resistance. In addition, there are made differences in level between the long crimp-forming wefts and short crimp-forming ones, but the use of the former and latter in a ratio (in number) of from 3:1 to 1:3 decreases such differences in level and is effective in smoothing the running side surface of the fabric.

In cases where with respect to the length of crimps of wefts in the running side surface (lower surface), the long crimps themselves are identical in length with one another while the short crimps themselves are identical in length with one another, this is effective in improving the papermakers' fabrics in runability (posture retentivity). However, the same is not always true of the wear resistance of the fabric It is important in the fabric C that both the lower surface long crimp-forming wefts for exerting wear resistance and the lower surface short crimp-forming wefts for exerting runability are arranged.

The fabric C is modified by interlacing the lower surface polyamide and polyester wefts respectively with adjacent two warps to make a papermakers' fabric (the fabric so made being hereinafter sometimes called a "fabric D" for convenience' sake). In the fabric D, the lower surface (running side surface) polymer wefts are bent with high strength to acquire better crimpiness by interlacing the polymer wefts with the adjacent two warps as a pair, to permit the use of further wefts of large diameter in the fabric. This makes it possible to further increase the to-be-worn volume of the lower surface wefts and consequently further improve the fabric in wear resistance.

Also in the fabric D, as previously mentioned, it is preferable that the lower surface polyamide wefts have a diameter larger than the lower surface polyester wefts and that the number of the former and that of the latter be in a ratio of from 1:3 to 3:1.

The fabric C may be modified by interlacing the lower surface polyamide wefts respectively with a pair of adjacent warps between which a warp interlacing with an upper surface weft at a position where said pair of warps interlace with the lower surface polyamide weft, is sandwiched in. The modified fabric having such a structure as above is hereinafter sometimes called a "fabric E" for convenience' sake. In the fabric E, a pair of adjacent two warps between which a warp is arranged interlace with a lower surface polyamide weft to form a knuckle where the warp sandwiched in between said two warps interlacing with said lower surface polyamide weft extends upward through between these two warps and interlaces with a upper surface (papermaking side surface) weft, whereby, as mentioned as to the fabric B, crimpiness becomes more satisfactory, further polyamide wefts of larger diameter can be used and the uneven distribution of spaces for drainage can be prevented. Thus, there can be obtained the fabric E which has been more remarkably improved in wear resistance without changing the surface properties of the conventional papermakers' fabrics.

Further, it is preferable in the fabric E to arrange a warp interlacing with none of both the lower surface polymer wefts, contiguously to the warp interlacing with the lower surface polyester weft. In this papermakers' double layer type fabric, the warps interlacing with none of both the lower surface polymer wefts are prevented from being elongated or torn off by wear as mentioned as to the fabric B and, therefore, the runability (posture stability) of the fabric is very satisfactory.

Further, in the fabric E, at least one of the pair of warps interlacing with the lower surface polyamide weft may also interlace with the lower surface polyester weft. More particularly, in the papermakers' double layer type fabric so obtained, the lower surface short crimp-forming polyester wefts are each interlaced with at least one of the pair of warps interlacing with said lower surface polyamide weft, and said polyester wefts are respectively so interlaced twice in one repeat. The warps interlacing with the polyester wefts having excellent rigidity, in the above manner, further interlace with the polyamide weft whereby the polyester wefts provide rigidity for the fabric and consequently the posture of the warps is stabilized, the polyamide wefts which are somewhat inferior in runability (posture stability) are retained securely and stably and the runability (posture stability) of the fabric is remarkably improved.

It is also preferable in the fabric E that the lower surface polyamide wefts have a diameter larger than the lower surface polyester wefts and that the number of the former and that of the latter be in a ratio of from 1:3 to 3:1.

In the fabric E, on the other hand, the lower surface polyester wefts may respectively be interlaced at two positions within one repeat with a warp sandwiched in between a pair of warps interlacing with a lower surface polyamide weft. The fabric so obtained is hereinafter sometimes called a "fabric F" for convenience' sake. In the fabric F so obtained, the position where the lower surface polyester wefts are interlaced and the position where the lower surface polyamide wefts are interlaced have a certain fixed interrelation, which permits the uniform distribution of positions or knuckles where the lower surface wefts are interlaced and the non-uniform distribution of spaces for drainage in the fabric is substantially prevented.

Also in the fabric F, it is preferable that the lower surface polyamide wefts have a diameter larger than the lower surface polyester wefts and that the number of the former arranged and that of the latter be in a ratio of from 1:3 to 3:1.

The papermakers' double layer type fabrics of this invention will be better understood by the following Examples and Comparative Example. Increases in the to-be-worn volume of fabrics of this invention to be obtained and improvements in the wear resistance thereof will be concretely explained in comparison with conventional fabrics and with reference to the accompanying drawings.

DETAILED DESCRIPTION OF THE INVENTION

Figure 1:
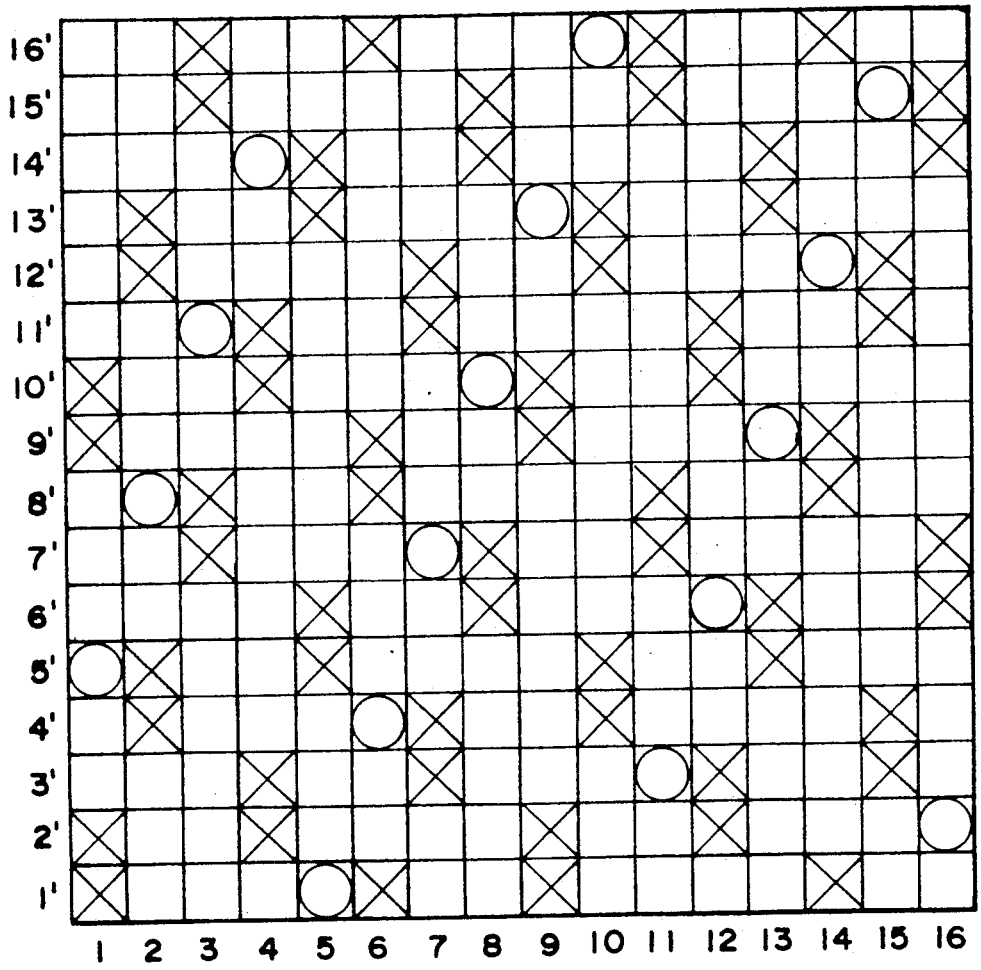
FIGS. 1–6, 10–37 and 39–58 are each a complete design (one repeat) showing an example of papermakers' double layer type fabric of this invention.
Figure 10B:
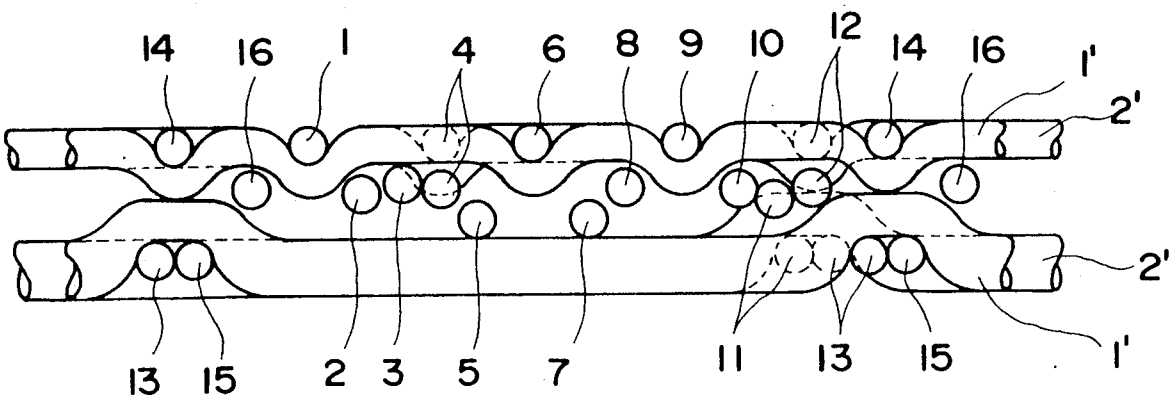
Figure 2:
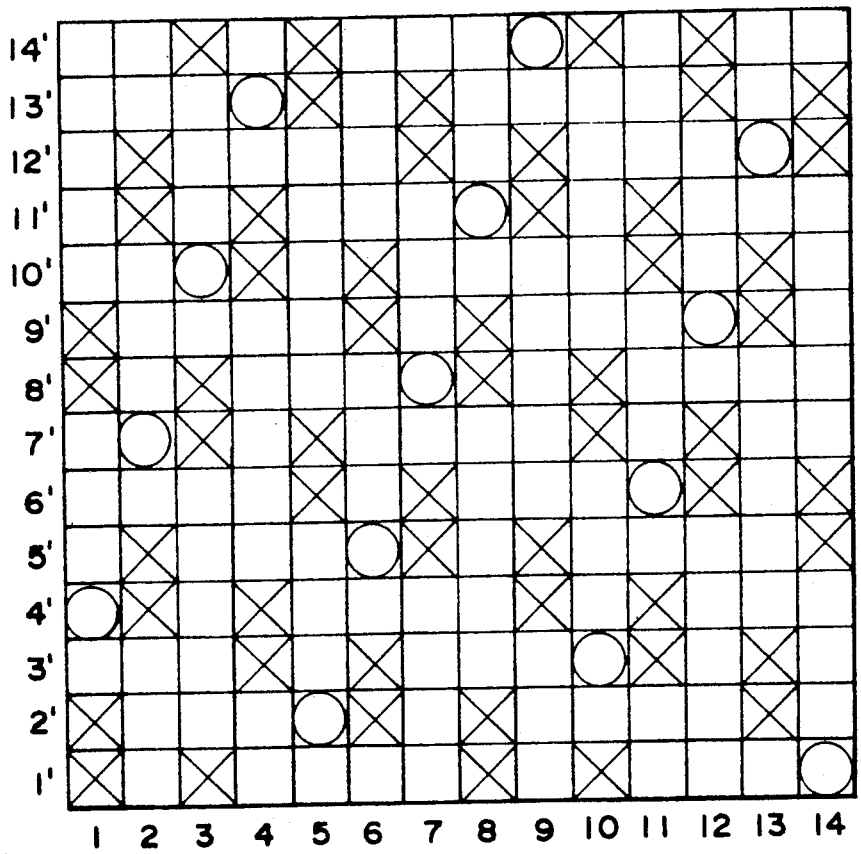
Figure 10:
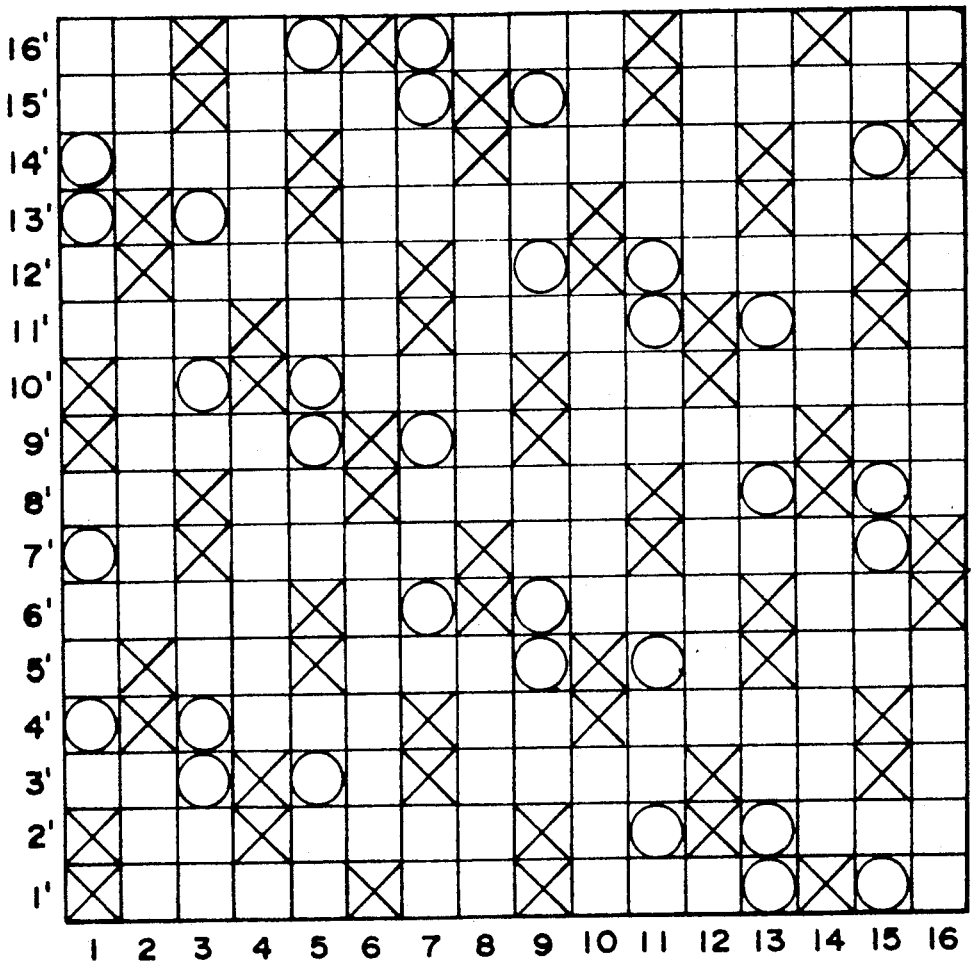
Figure 16B:
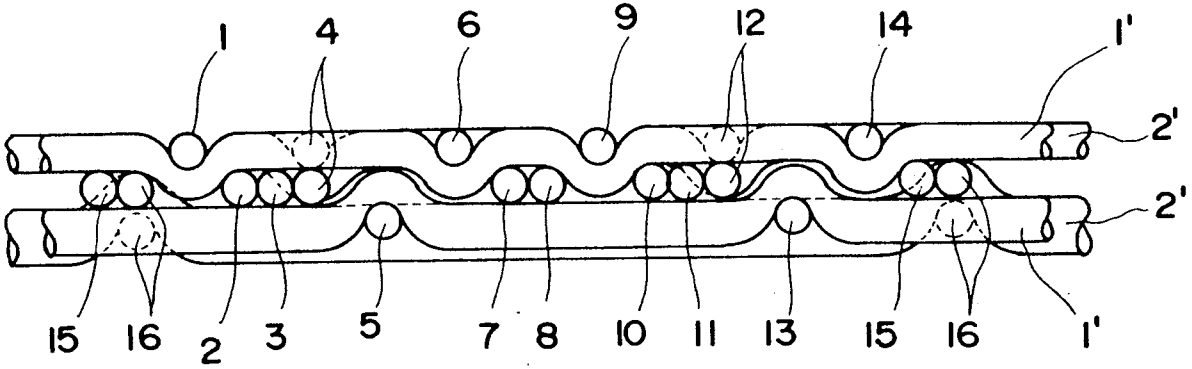
Figure 27B:
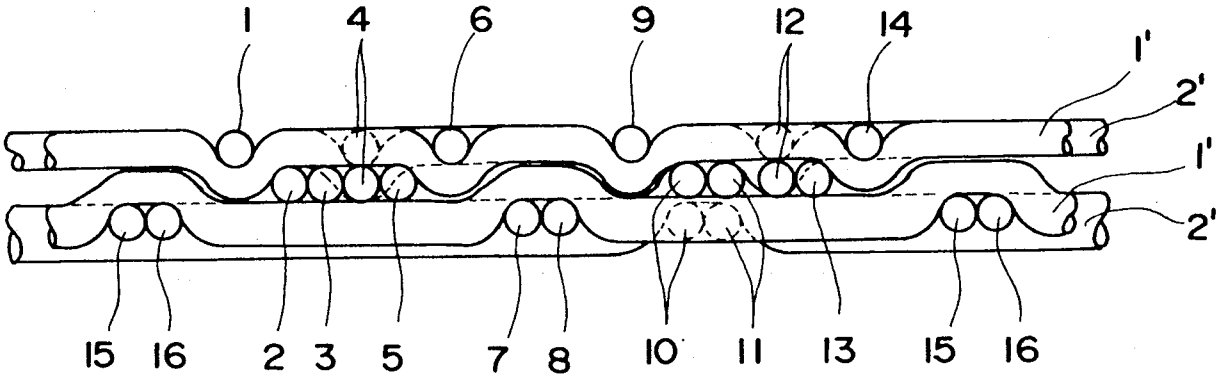
Figure 16A:
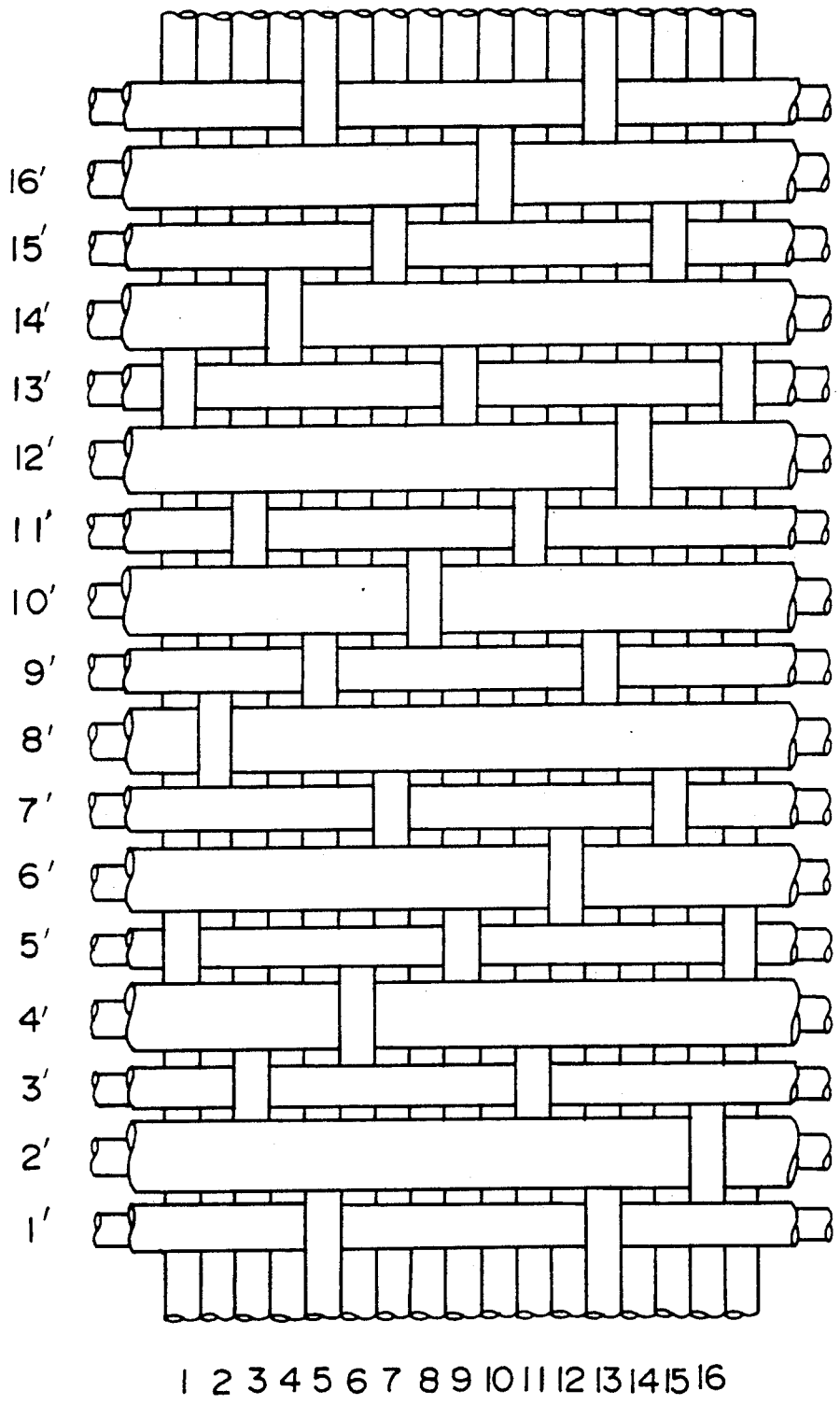
Figure 17:
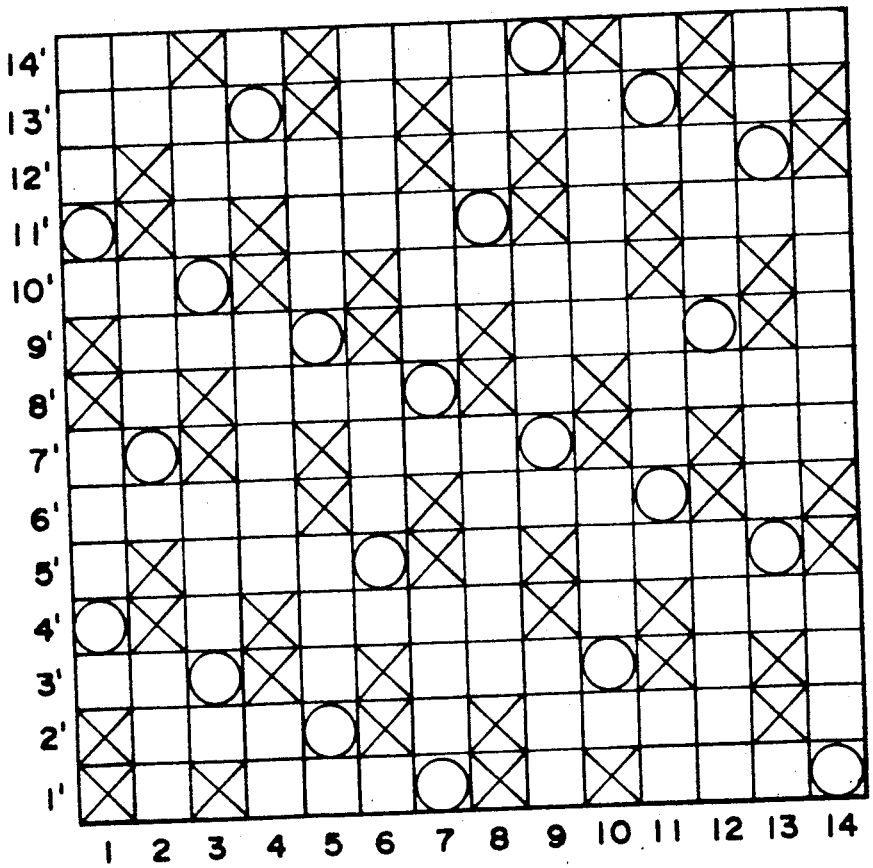
Figure 18:
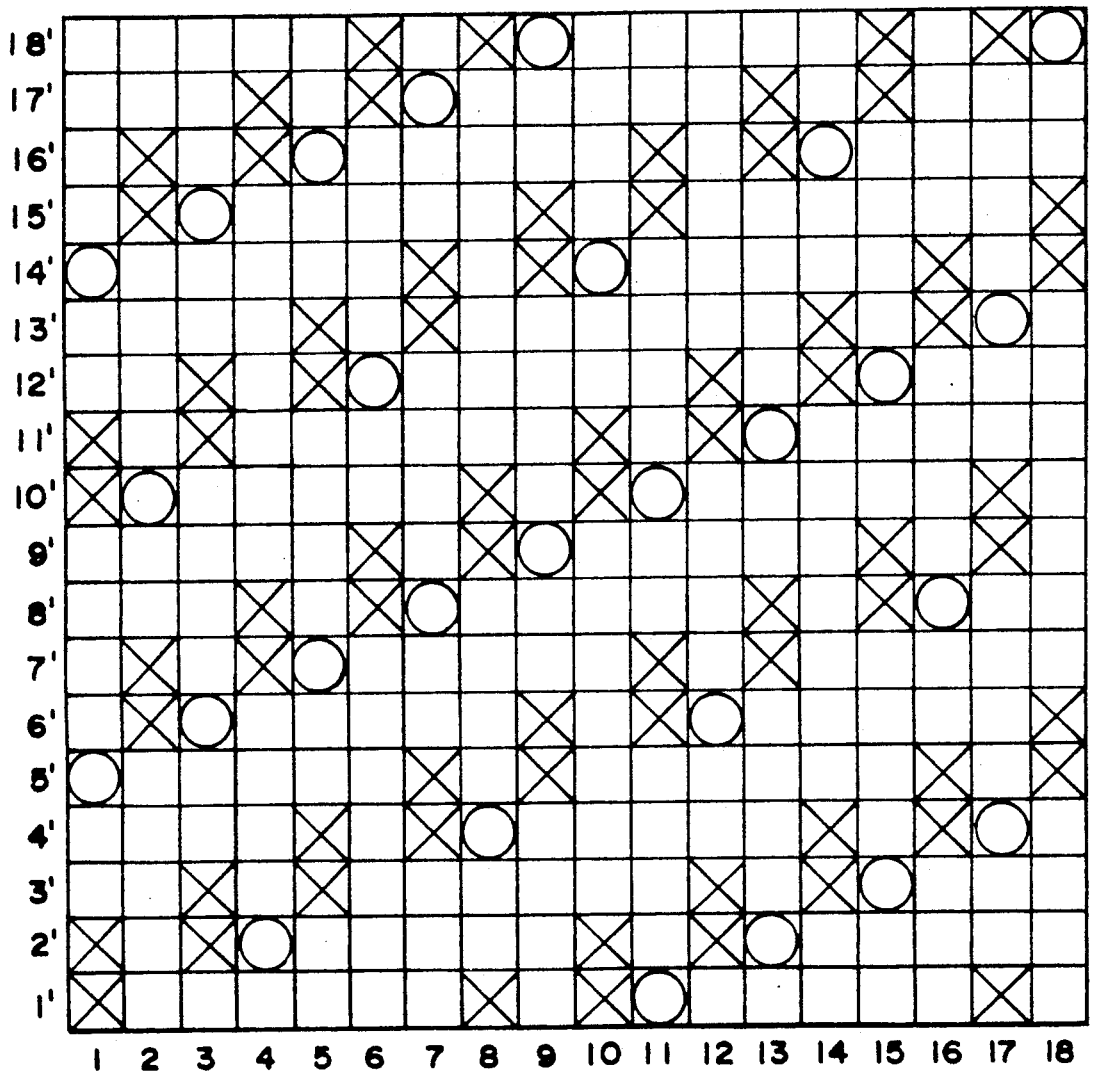
Figure 19:
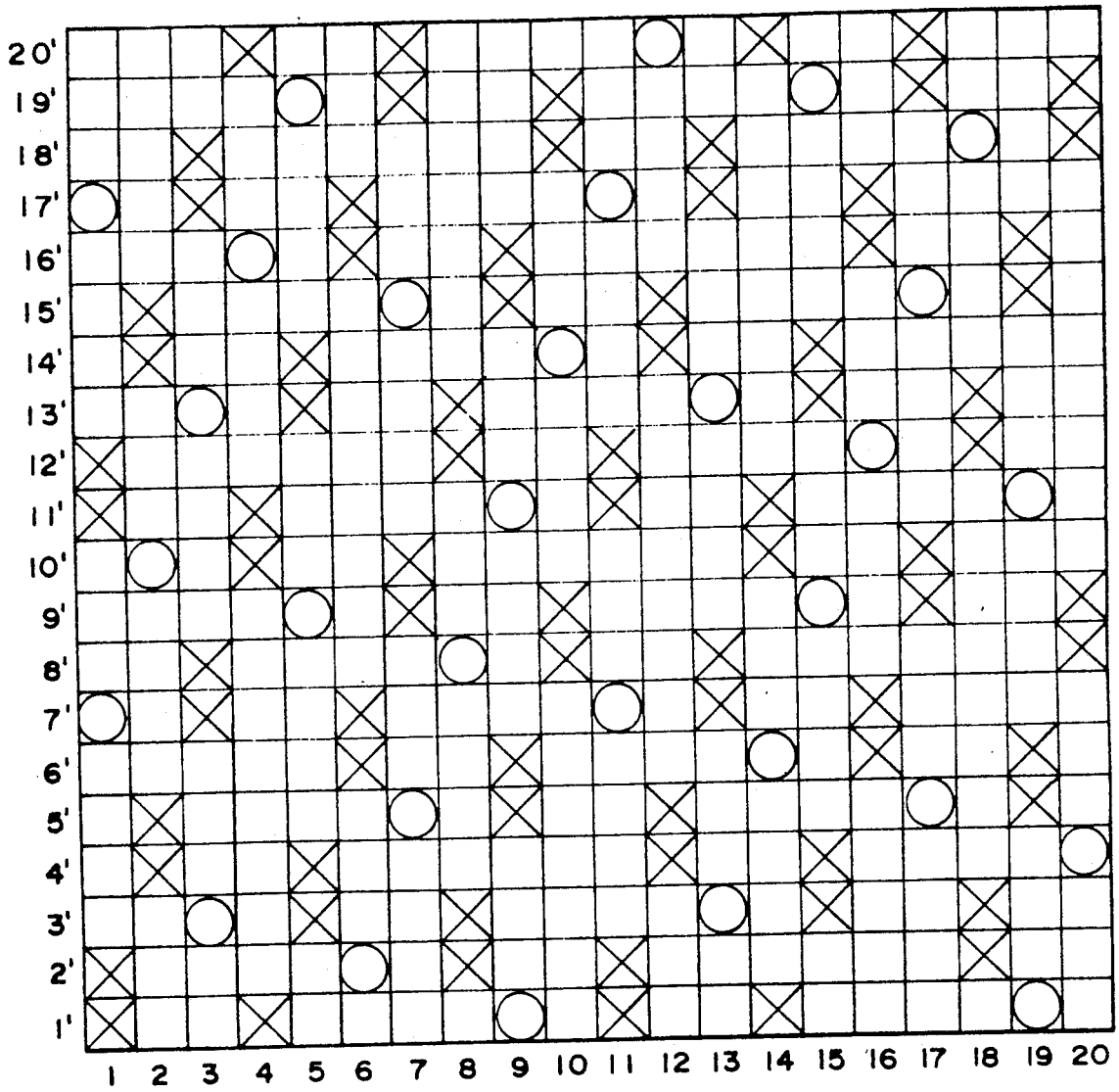
Figure 20:
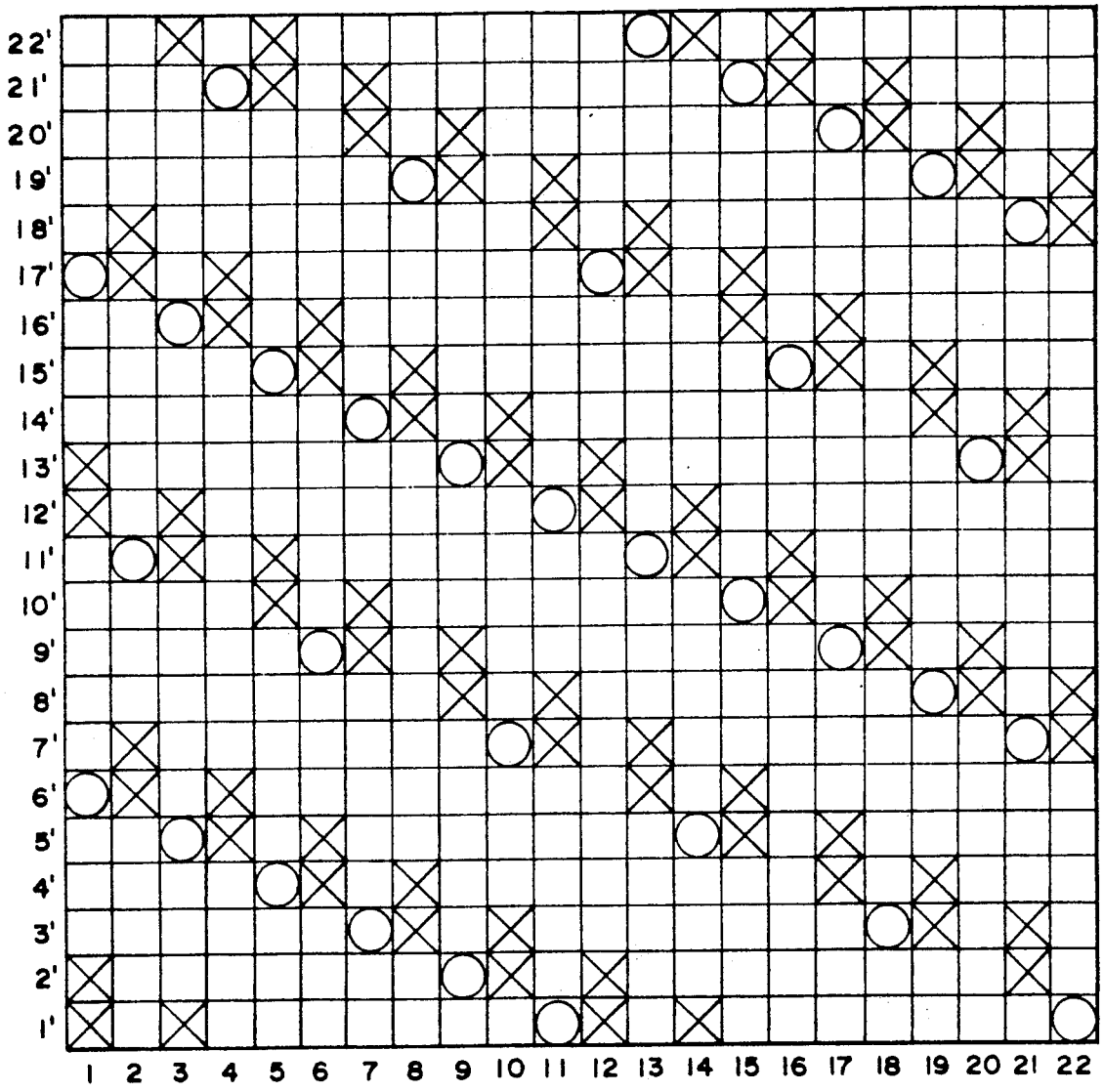
Figure 21:
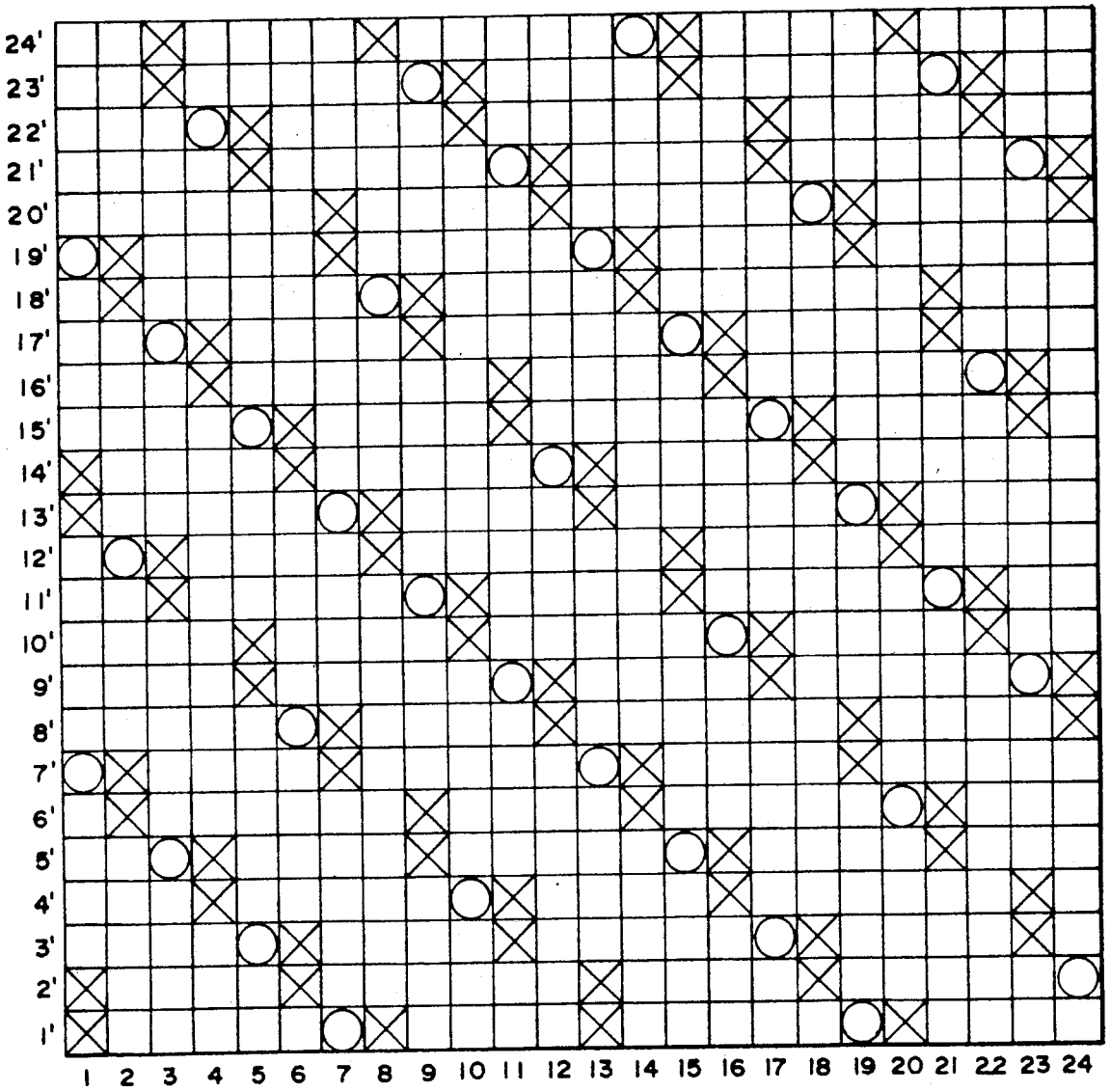
Figure 27:
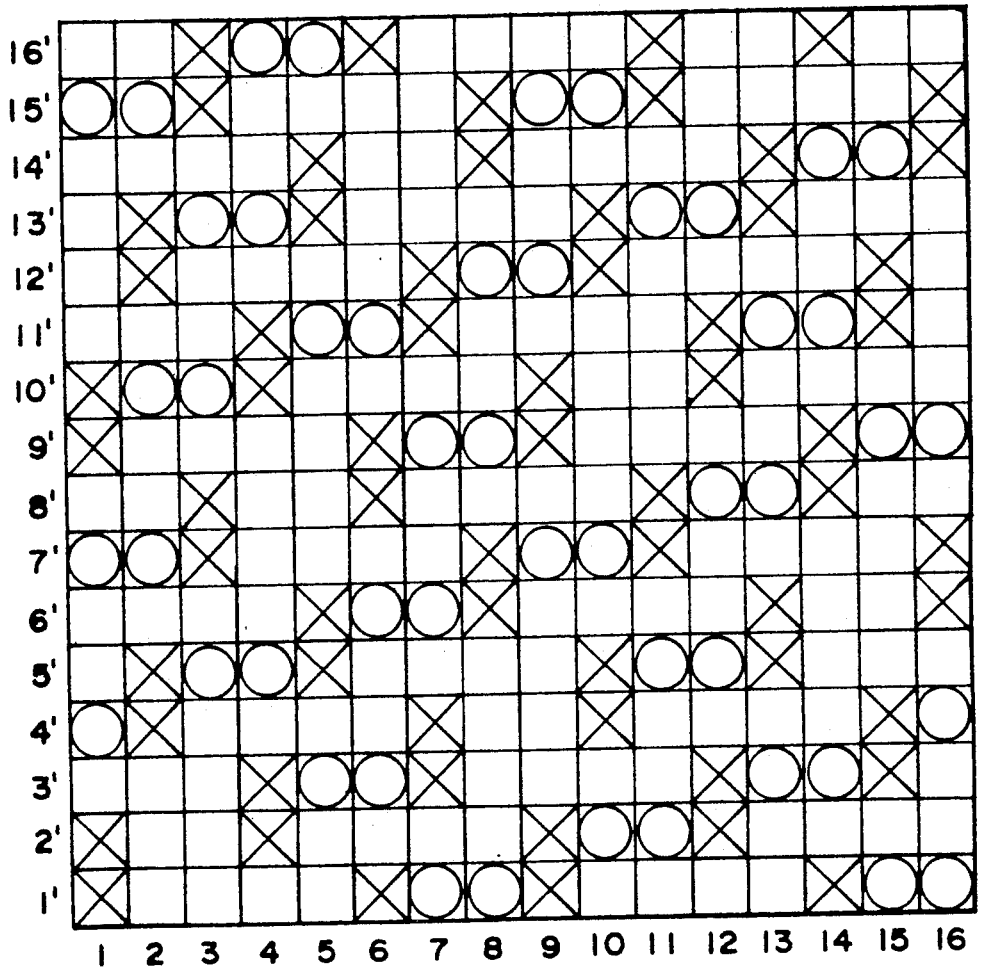
Figure 39:
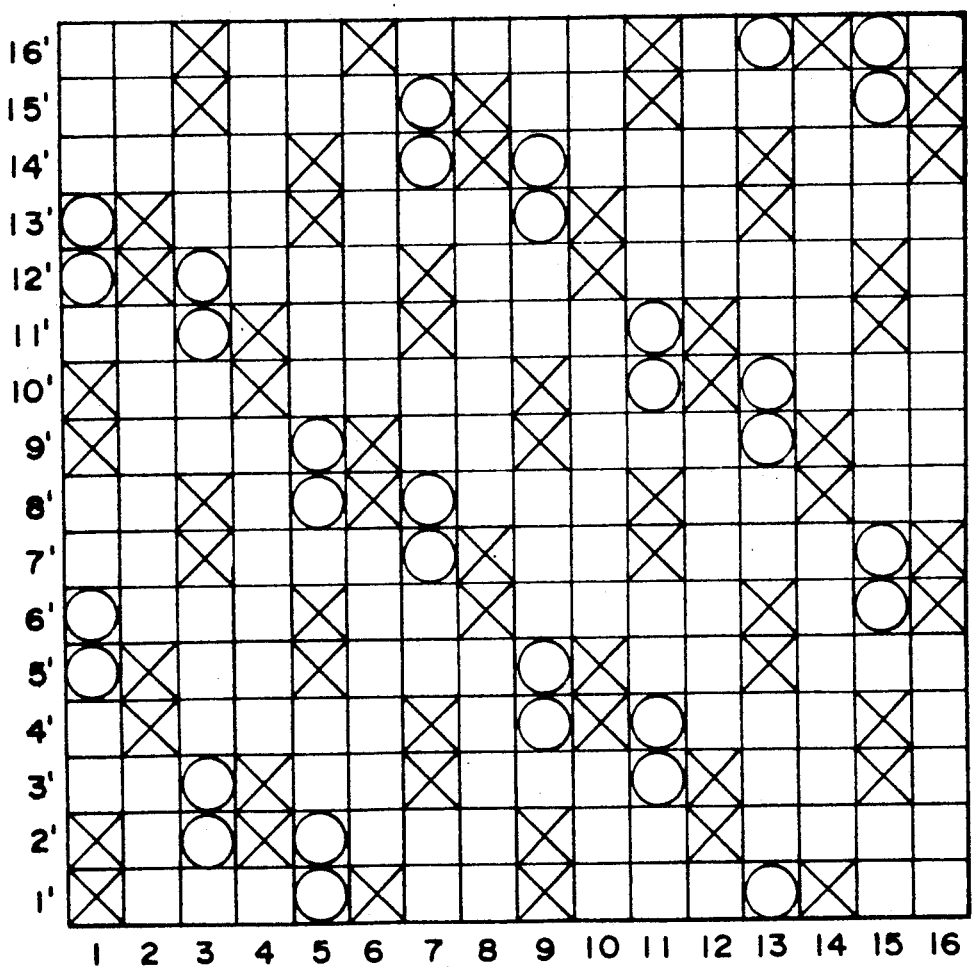
Figure 51B:
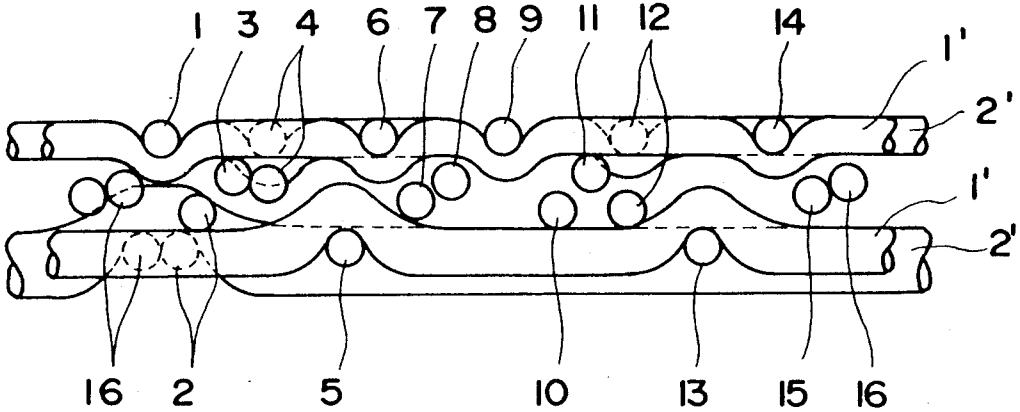
Figure 40:
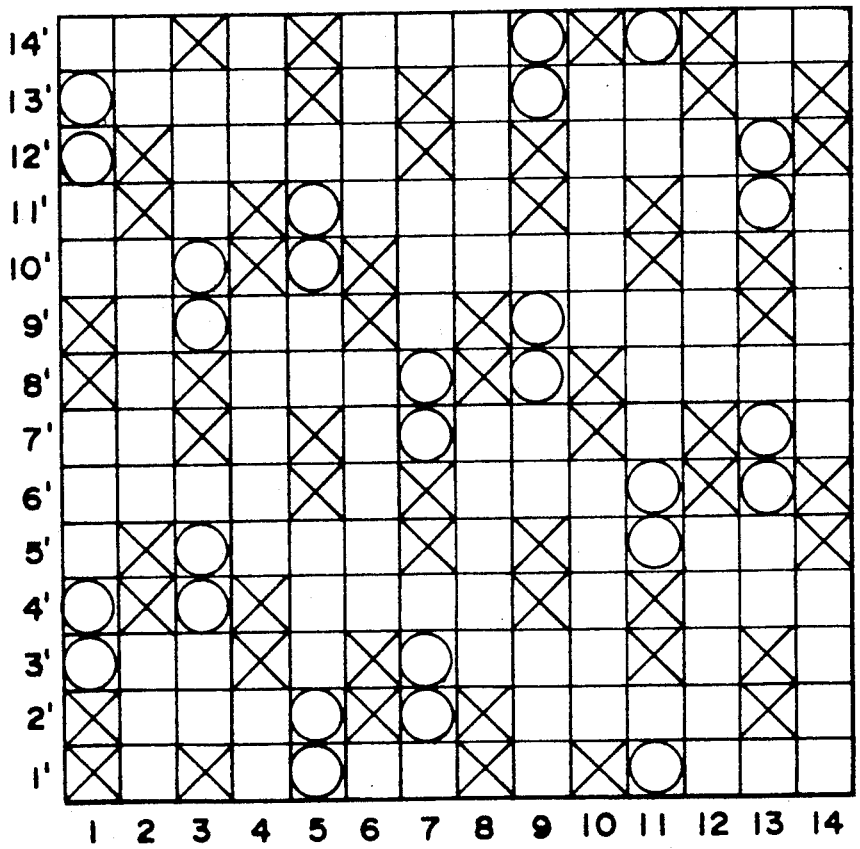
Figure 41:
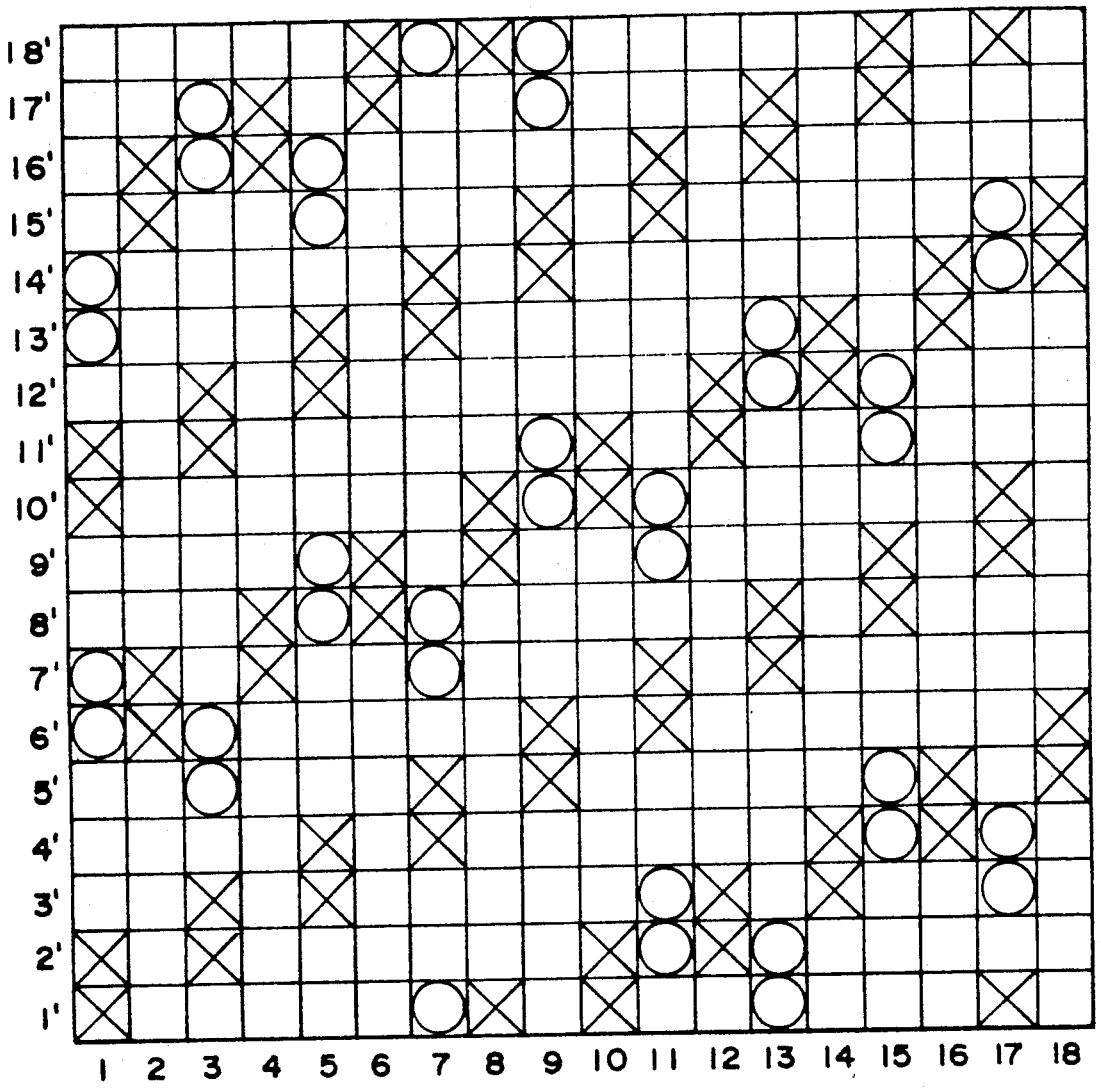
Figure 42:
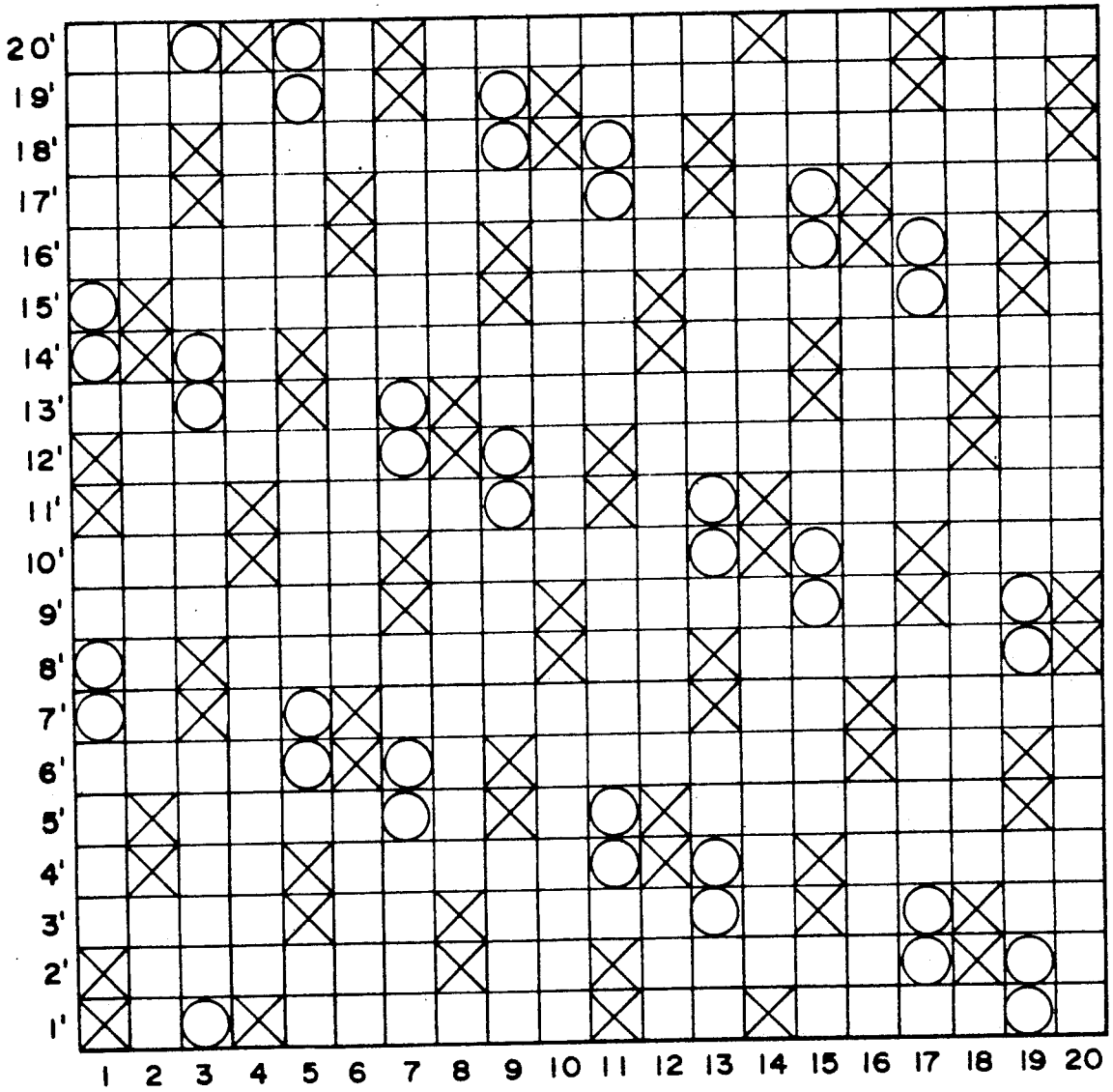
Figure 51:
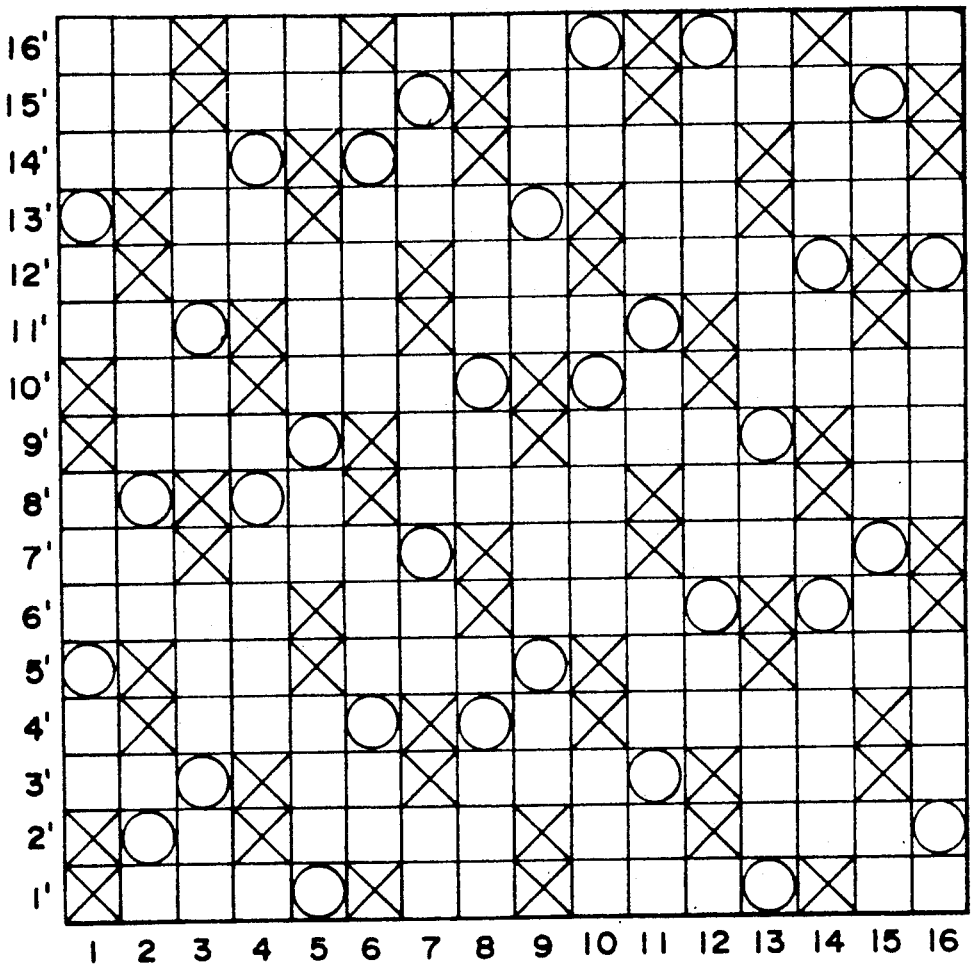
Figure 59:
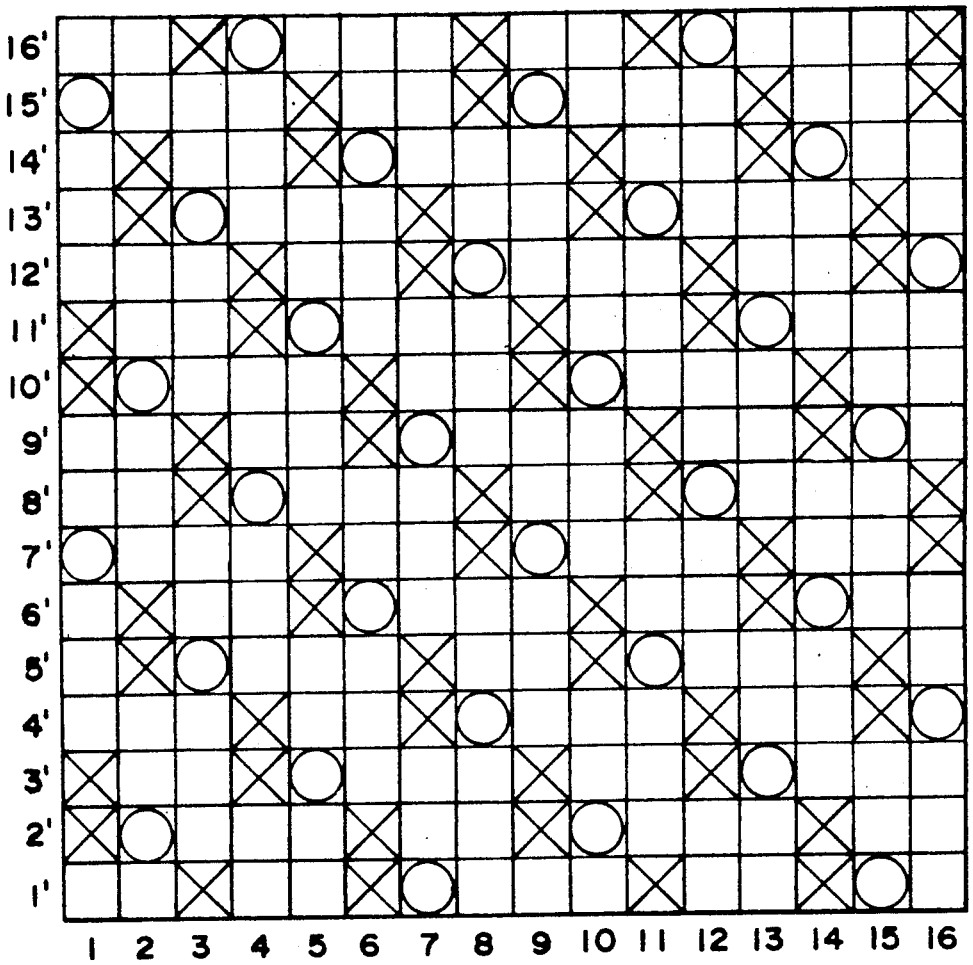
FIG. 59 is a complete design (one repeat) showing a conventional papermakers' double layer type fabric of the prior art described in the following comparative example.
Figure 59A:
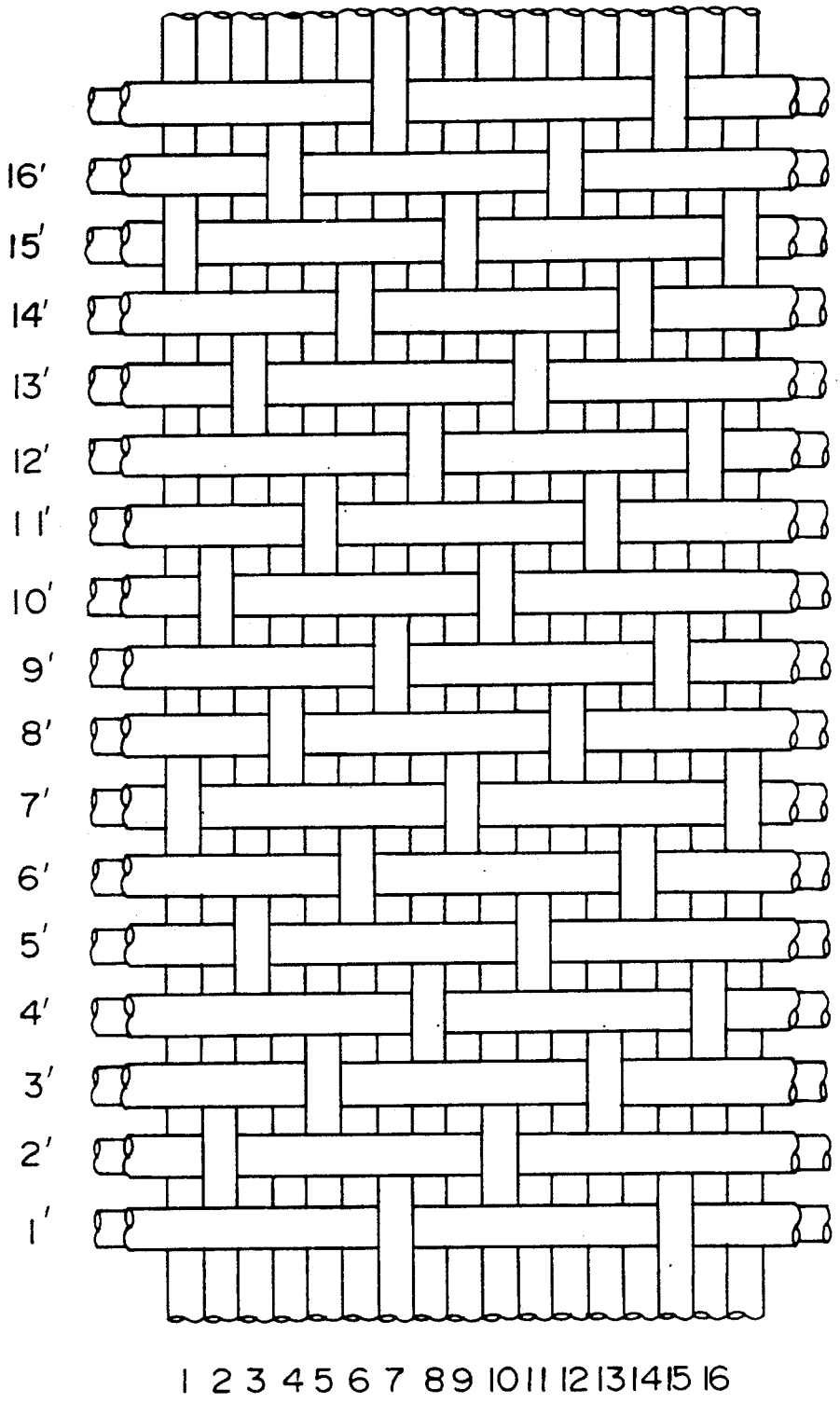

FIGS. 1A, 10A, 16A, 27A, 39A and 51A are plan views showing the running side surfaces (lower surfaces) of the fabrics of this invention shown in FIG. 1 (Example 1), FIG. 10 (Example 7), FIG. 16 (Example 13), FIG. 27 (Example 24), FIG. 39 (Example 35) and FIG. 51 (Example 47); and FIG. 59A is a plan view showing the running side surface (lower surface) of the fabric of the prior art shown in FIG. 59 (Comparative Example 1).

PREFERRED EMBODIMENTS OF THE INVENTION

Figure 10A:
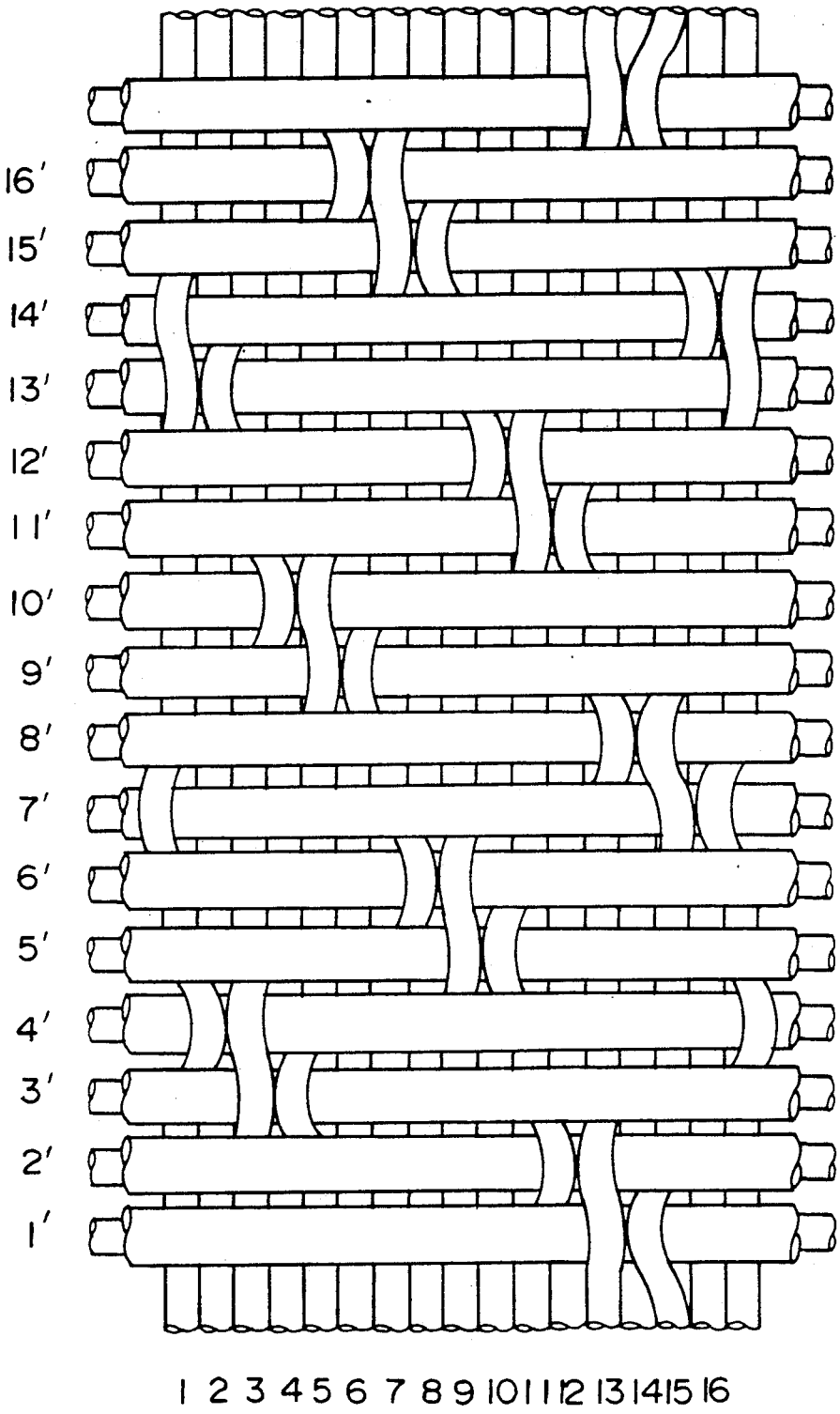
Figure 10C:
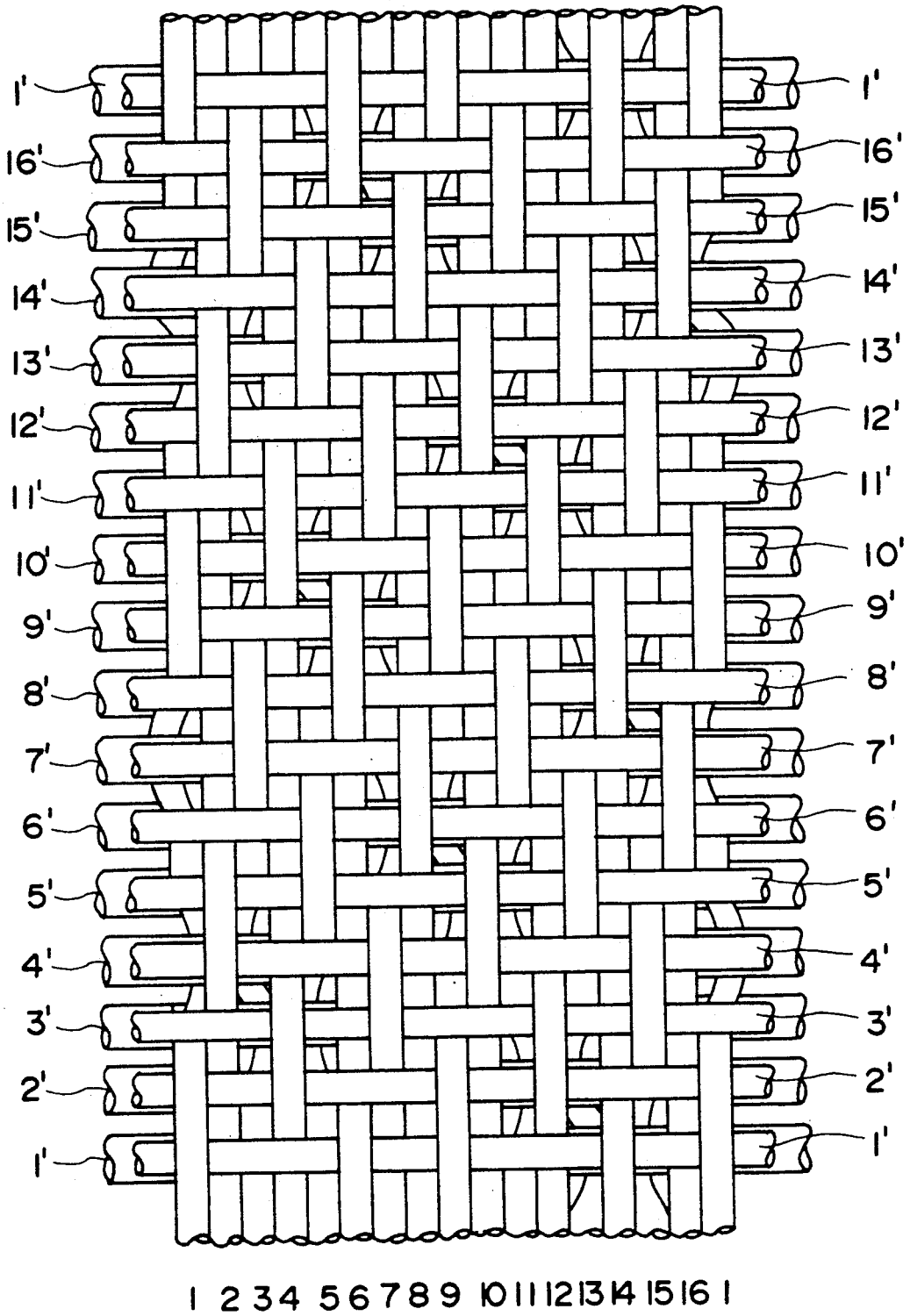
Figure 11:
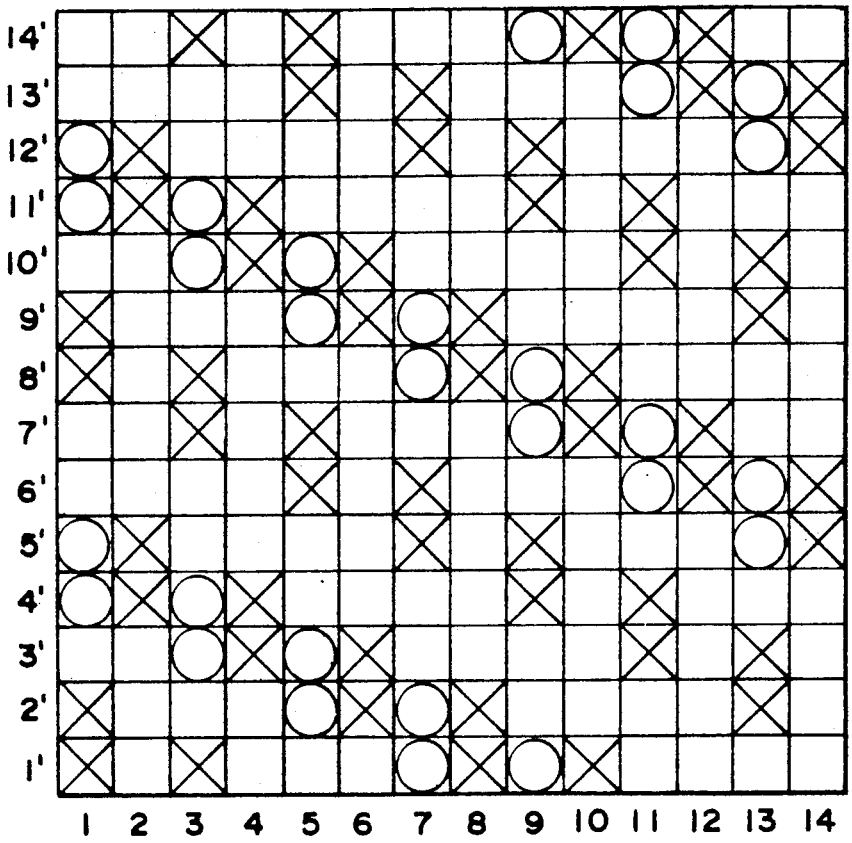
Figure 12:
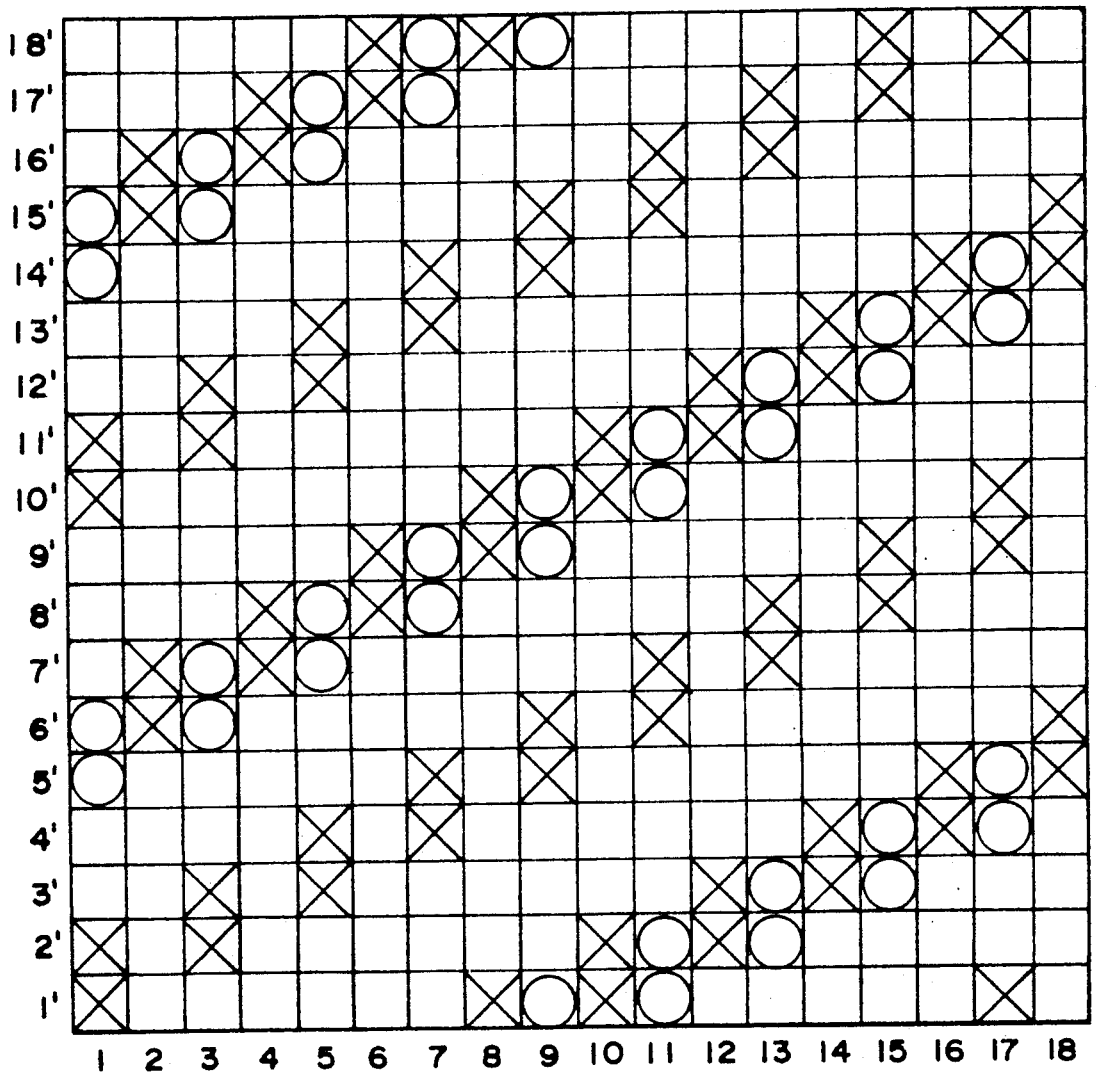
Figure 13:
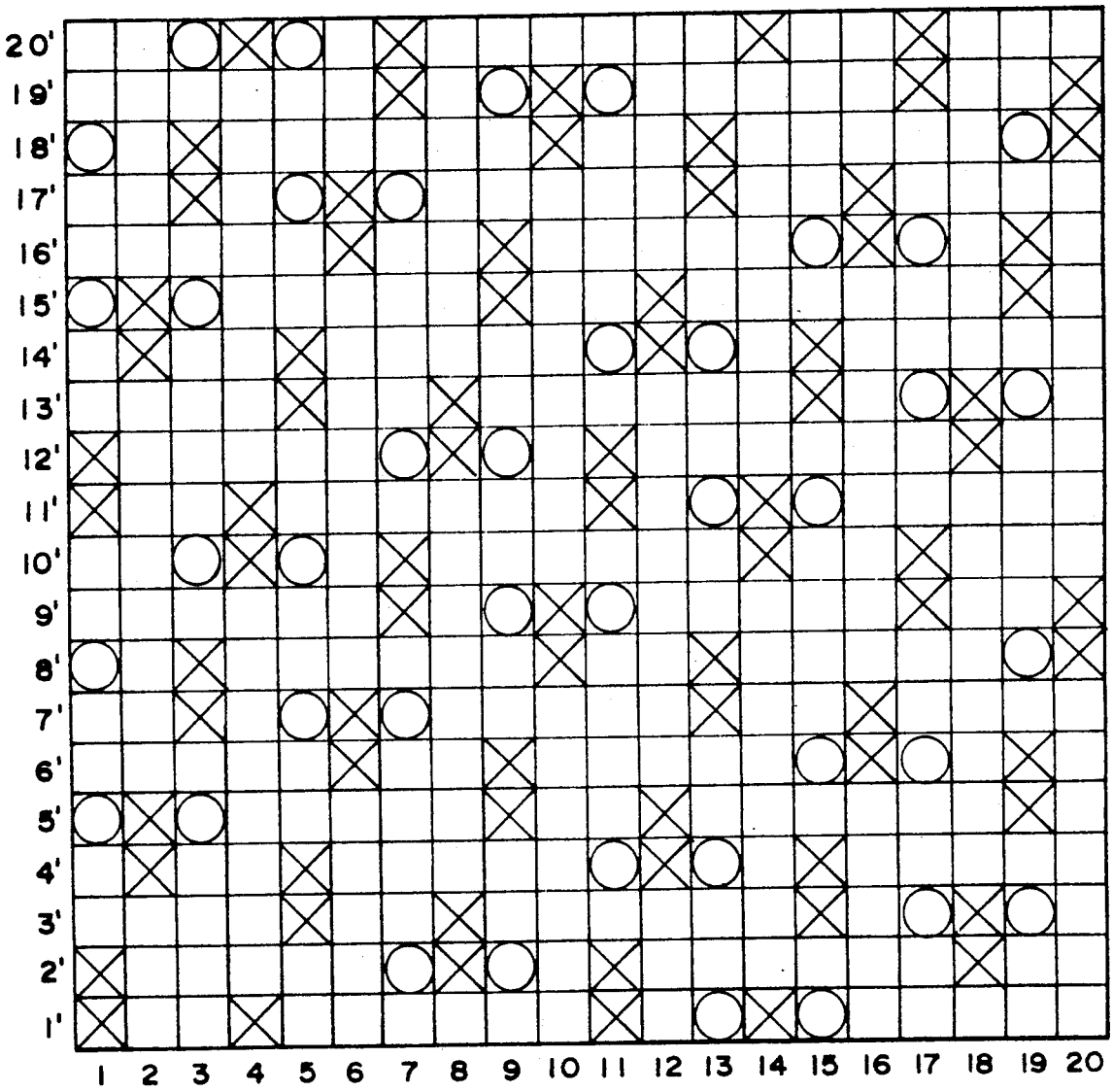
Figure 14:
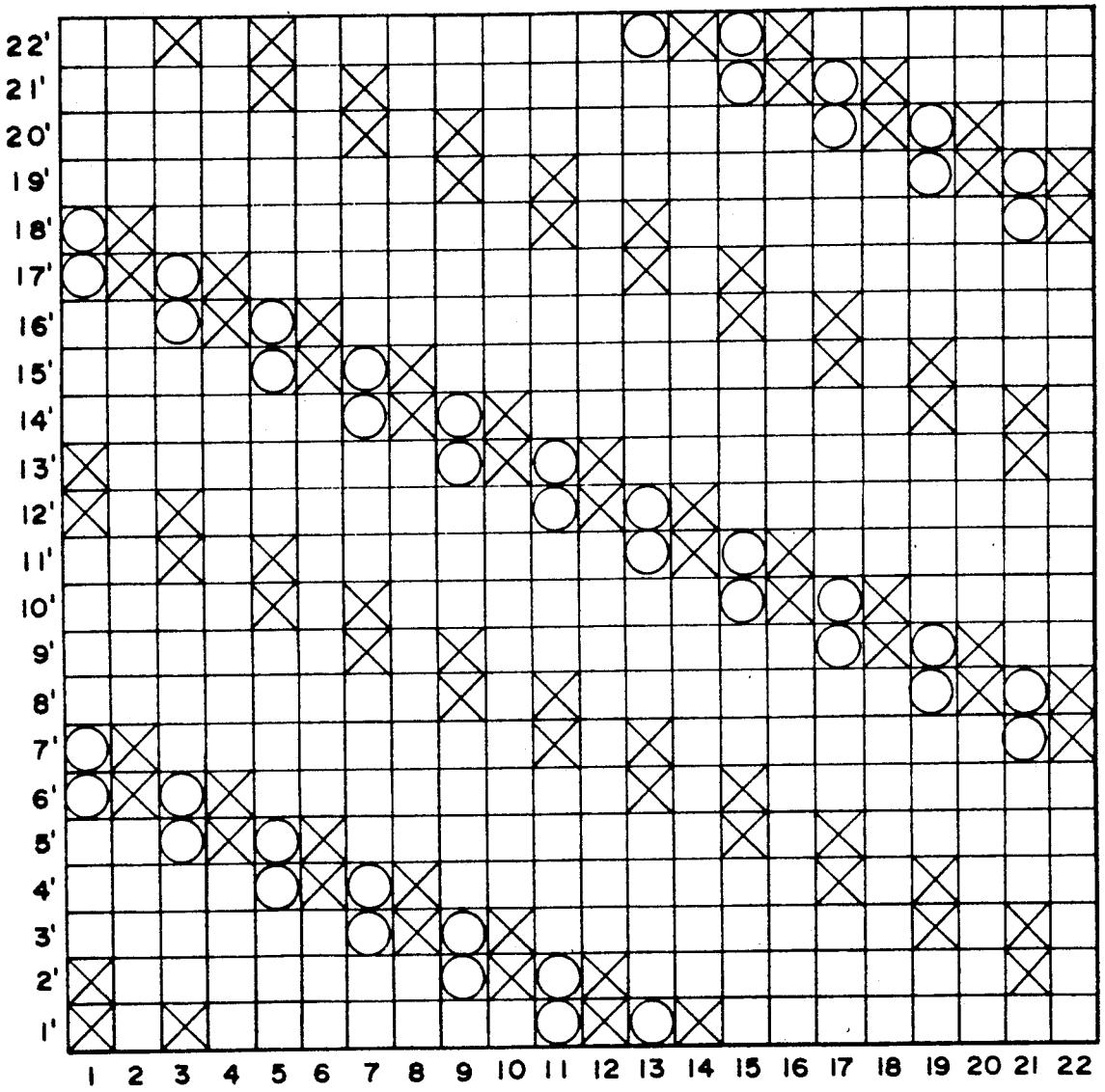
Figure 15:
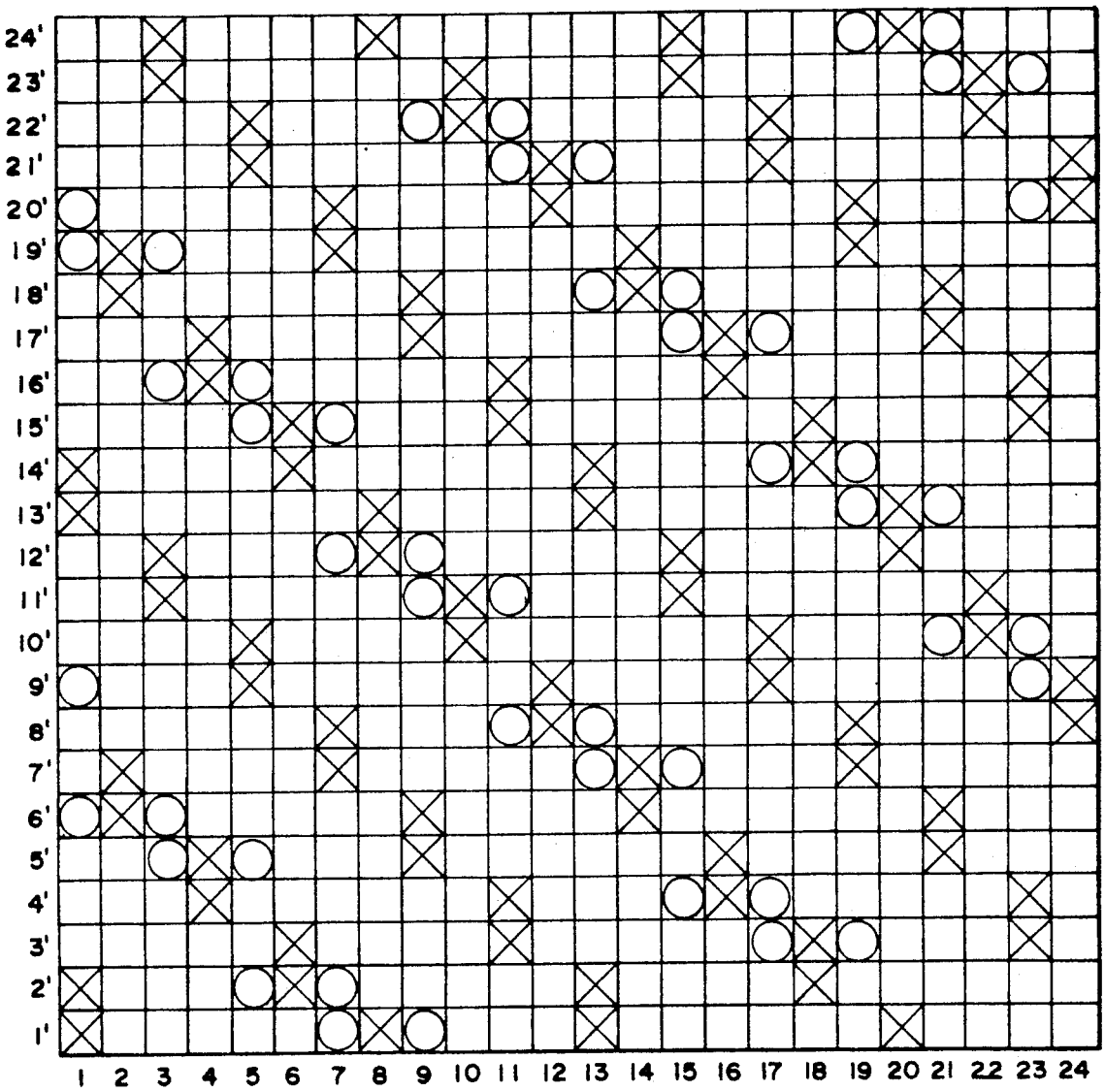
Figure 59B:
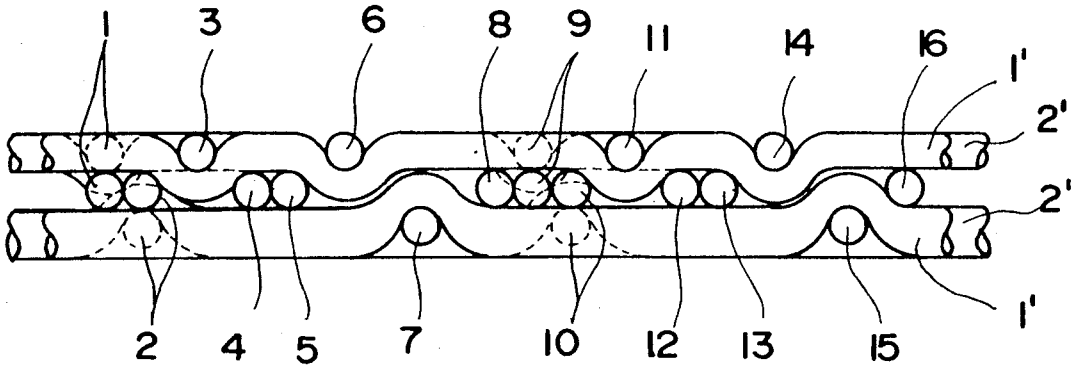

FIGS. 1B, 10B, 16B, 27B, 39B and 51B are warp cross sectional drawings for the first two wefts 1' and 2' of the fabrics of this invention shown in FIG. 1 (Example 1), FIG. 10 (Example 7), FIG. 16 (Example 13), FIG. 27 (Example 24), FIG. 39 (Example 35) and FIG. 51 (Example 47);

FIG. 59B is a warp cross sectional drawing for the first two wefts 1' and 2' of the fabric of the prior art shown in FIG. 59 (Comparative Example 1); and FIG. 10C is a plan view showing the papermaking side surface (upper surface) of the fabric of this invention shown in FIG. 10 (Example 7).

EXAMPLES 1–6 AND COMPARATIVE EXAMPLE 1

FIGS. 1–6 are each a complete design (one repeat) of a papermakers' double layer type fabric of this invention indicated as a fabric A in each of Examples 1–6. The respective numbers of warps, upper surface wefts and lower surface wefts used in these repeats are 16 (16-shaft: Example 1), 14 (14-shaft: Example 2), 18 (18-shaft: Example 3), 20 (20-shaft: Example 4), 22 (22-shaft: Example 5) and 24 (24-shaft: Example 6). FIG. 59 is a complete design (one repeat) of a conventional papermakers' double layer type fabric in which the respective numbers of warps, upper surface wefts and lower surface wefts used are 16 (16-shaft). shaft).

In the Figures, reference numbers indicate the warps and wefts, and numbers (1, 2, 3 . . . ) indicate polyester warps while numbers dash or prime (1', 2', 3' . . . ) indicate wefts. Further, regarding the wefts, the upper surface (papermaking side surface) wefts and the corresponding lower surface (running side surface) wefts are indicated respectively by the same numerals for the sake of explanation Regarding the upper and lower surface wefts, they will be further explained when required.

In FIGS. 1–6 and 59, with regard to the lower surface wefts, odd numbers with a prime indicate polyester wefts and even numbers with a prime indicate polyamide wefts.

In FIGS. 1–6 and 59, the symbol "O" indicates a position where a warp interlaces with a lower surface (running side surface) weft to form a knuckle, and the symbol "X" indicates a position where a warp interlaces with a upper surface (papermaking side surface) weft. Accordingly, in these Figures, the distance or length of each weft between the two symbols "O" on the weft in one repeat or between the symbol "O" on the weft in this repeat and the symbol "O" on the same weft in the right-hand or left-hand neighboring repeat (not shown), indicates the length of one crimp of wefts (lower surface wefts) which are used in the formation of the running side surface of a papermakers' fabric. In same Figures as above, the distance or length of wefts between the symbols "X" in one repeat indicates the length of one crimp of wefts (upper surface wefts) which are used in the formation of the papermaking side surface of the papermakers' fabric.

Examples 1–6 and Comparative Example 1 will then be explained hereunder with reference to the accompanying Figures.

Figure 1A:
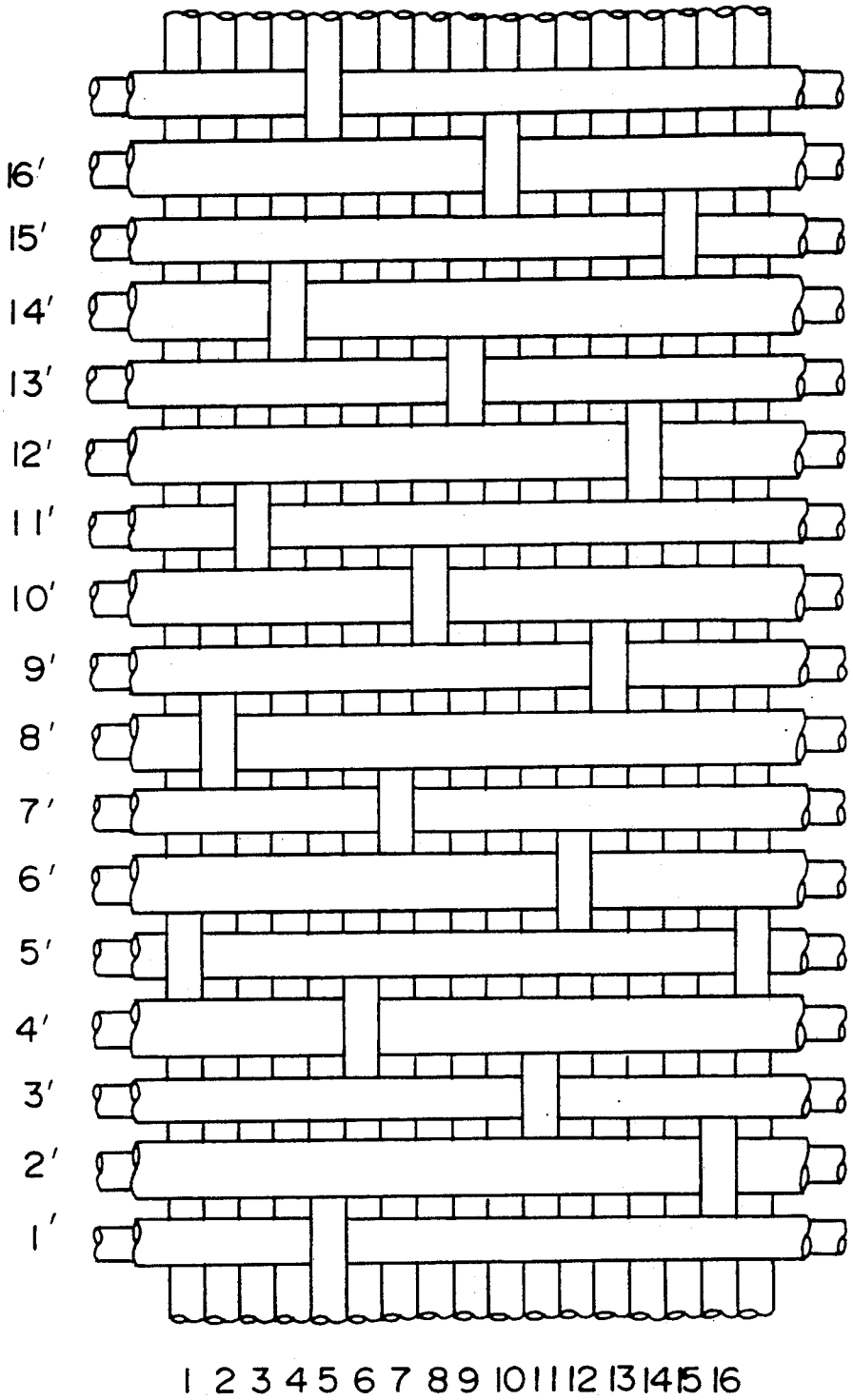
Figure 1B:
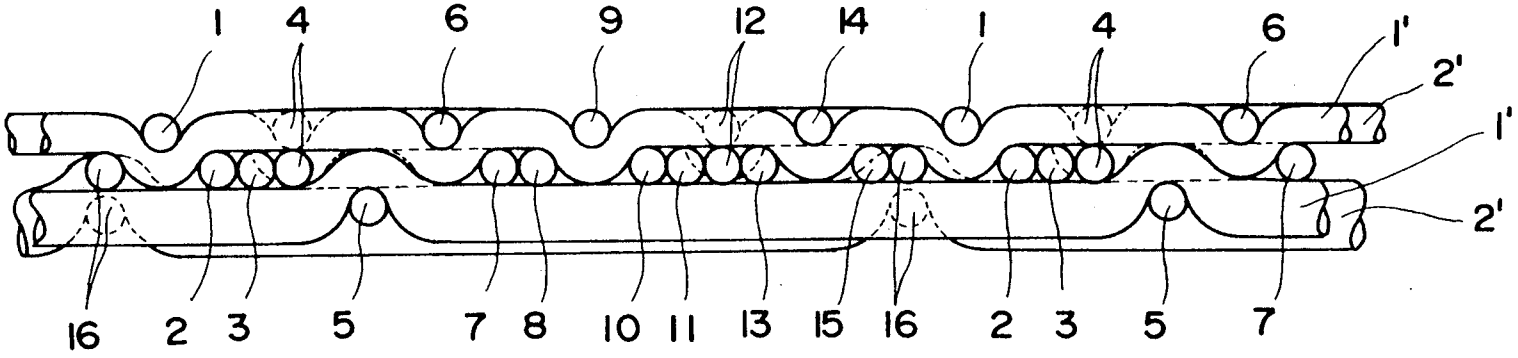

FIG. 1 illustrating the fabric of Example 1, is a complete design (one repeat) of a papermakers' double layer type fabric A consisting of 16 warps, 16 upper surface wefts and 16 lower surface wefts in one repeat. FIGS. 1A and 1B are plan views showing the running side surface and a warp cross sectional drawing respectively for the first two wefts 1' and 2' of the fabric shown in FIG. 1. In the fabric A, a lower surface polyester weft 1' is interlaced once with a warp 5 in this repeat and a lower surface polyamide weft 2' is interlaced once with a warp 16 in this repeat, respectively to form a knuckle. Between one of these knuckles in this repeat and the adjacent knuckle formed on the same weft in the right-hand or left-hand neighboring repeat (not shown), there is formed a crimp which crosses 15 warps. Any crimps which the lower surface polymeric wefts form in Example 1 are longer than those the conventional lower surface wefts form in FIG. 59 illustrating a conventional fabric of Comparative Example 1.

In FIGS. 2–6 (Examples 2–6), as in Example 1, the lower surface polyester wefts and lower surface polyamide wefts are each interlaced once with one warp to form a knuckle in one repeat. Between the knuckle so formed in this repeat and the adjacent knuckle formed on the same weft in the right-hand or left-hand neighboring repeat (not shown), there are formed crimps which cross 13 (Ex. 2), 17 (Ex. 3), 19 (Ex. 4), 21 (Ex. 5) and 23 (Ex. 6) of the warps, respectively Any crimps in these Examples are longer than those of the lower surface wefts of conventional papermakers' double layer type fabrics (the numbers of shafts being the same as those in said Figures, respectively).

FIG. 59 illustrating the fabric of Comparative Example 1, is a complete design (one repeat) of a conventional papermakers' double layer type fabric in which 16 respectively of warps, upper surface wefts and lower surface wefts are used. FIGS. 59A and 59B are plan views showing the running side surface and a warp cross sectional drawing respectively for the first two wefts 1' and 2' of the fabric shown in FIG. 59. In these Figures, the lower surface polyester weft 1' is interlaced twice with the warps 7 and 15 to form two knuckles in one repeat, and the polyamide weft 2' is interlaced twice with the warps 2 and 10 to form two knuckles in one repeat. Thus, between the two knuckles formed on each weft and between one of these knuckles in this repeat and the adjacent knuckle formed on the same weft in the right-hand or left-hand neighboring repeat, there are formed crimps which cross 7 of the warps, respectively. The length of crimps (each crossing 7 of the warps) of the lower surface wefts of the conventional papermakers' double layer type fabrics is far short as compared with the length of crimps (each crossing 13 of the warps) in the papermakers' double layer type fabric of Example 1 (the same 16 shafts) illustrated by FIG. 1.

Figure 7:
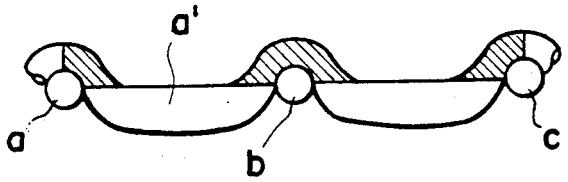
FIGS. 7 and 8 are each a schematic cross-sectional view of knuckles of papermakers' fabrics according to the prior art and the present invention respectively.
Figure 8:
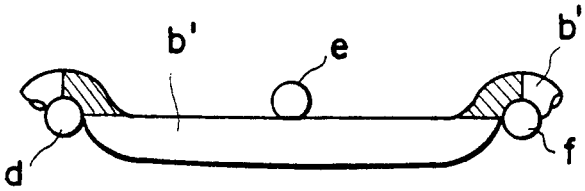

FIGS. 7 and 8 are each a schematic cross-sectional view of knuckles in papermakers' fabrics. In the Figures, a–f indicate warps, and a'–b' indicate wefts (lower surface wefts) in the running side surface of the fabric. FIG. 7 indicates that the warps a, b and c pass beneath the lower surface weft a' to interlace with the weft a' thereby forming knuckles, and FIG. 8 indicates that the warps d and f pass beneath the lower surface weft b' to interlace with the weft b' thereby forming knuckles, but the warp e passes over the lower surface weft b' not to interlace with the weft b' thereby not forming a knuckle. The hatched portions in FIGS. 7 and 8 are areas which are never worn, since these portions of wefts are interlaced with warps and are not exposed to the running side surfaces of the fabrics. It is clear that the hatched portions in FIGS. 7 and 8 do not exert wear-resisting actions. More specifically, as the number of knuckles per unit length of a weft increases, the weft portions having no wear-resisting actions increase thus decreasing an effective to-be-worn volume.

Figure 9:
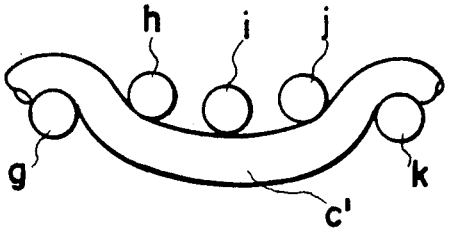
FIG. 9 is a schematic cross-sectional view showing the shape of a crimp of papermakers' fabrics.

FIG. 9 is a schematic cross-sectional view showing the shape of a crimp of papermakers' fabrics. In this Figure, warps g and k push upward a lower surface weft c'. Warps h and j suffer the repulsive force of the lower surface weft c' and, conversely, the push downward the lower surface weft c'. In addition, the warp i pushes downward the lower surface weft c', but its push-downward action is small as compared with that of the warp h or j. Crimpiness is an indicator for warps to press bend wefts against the repulsive force of the wefts, and good crimpiness permits the use of big (in diameter) wefts.

In FIG. 9, the longer the distance between the warps g and k is and the larger the number of warps h, i, j . . . is, the better the crimpiness becomes.

In the fabrics of Examples 1–6, as the lower surface (running side surface) wefts, polyester yarns having excellent rigidity and polyamide yarns having excellent wear resistance are alternately arranged so that the crimps of both the polymer (polyester and polyamide) wefts are elongated. Thus, the crimpiness is improved thereby to permit the use of lower surface wefts which are larger (in diameter) than those having heretofore been used, thus enabling the to-be-worn volume of the fabric to be enlarged.

Particularly, it is possible to further improve the running side surface in wear resistance by using, as the lower surface wefts, excellently wear-resisting polyamide yarns which are larger (in diameter) than usual.

In addition, Examples 1–6 only indicate the fabrics in which the polyester wefts and polyamide wefts are alternately arranged in the running side surface (lower surface) and the former wefts and the latter are used in a ratio (in number) of 1:1, but the fabric A is not limited to the above fabrics.

In a 16-shaft papermakers' fabric of FIG. 1 for example, a fabric provided with predetermined wear resistance may be obtained either by alternately arranging, as the lower surface wefts, 3 polyamide wefts and 1 polyester weft or by alternately arranging 1 polyamide weft and 3 polyester wefts.

Figure 3:
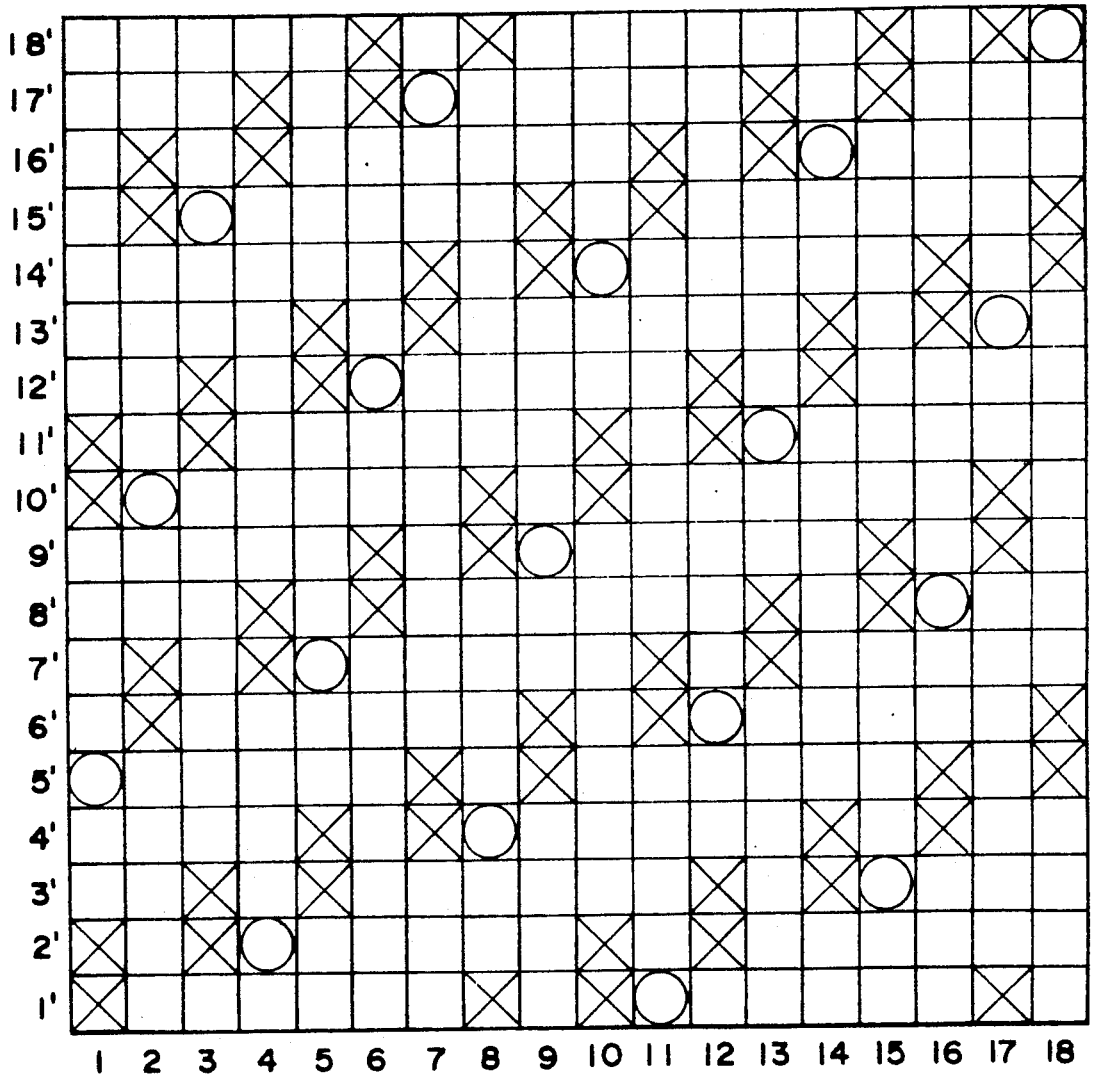

In a 18-shaft papermakers' fabric of FIG. 3, a fabric having predetermined wear resistance may be obtained either by alternately arranging, as the lower surface wefts, 2 polyamide wefts and 1 polyester weft or by alternately arranging 1 polyamide weft and 2 polyester wefts.

Figure 4:
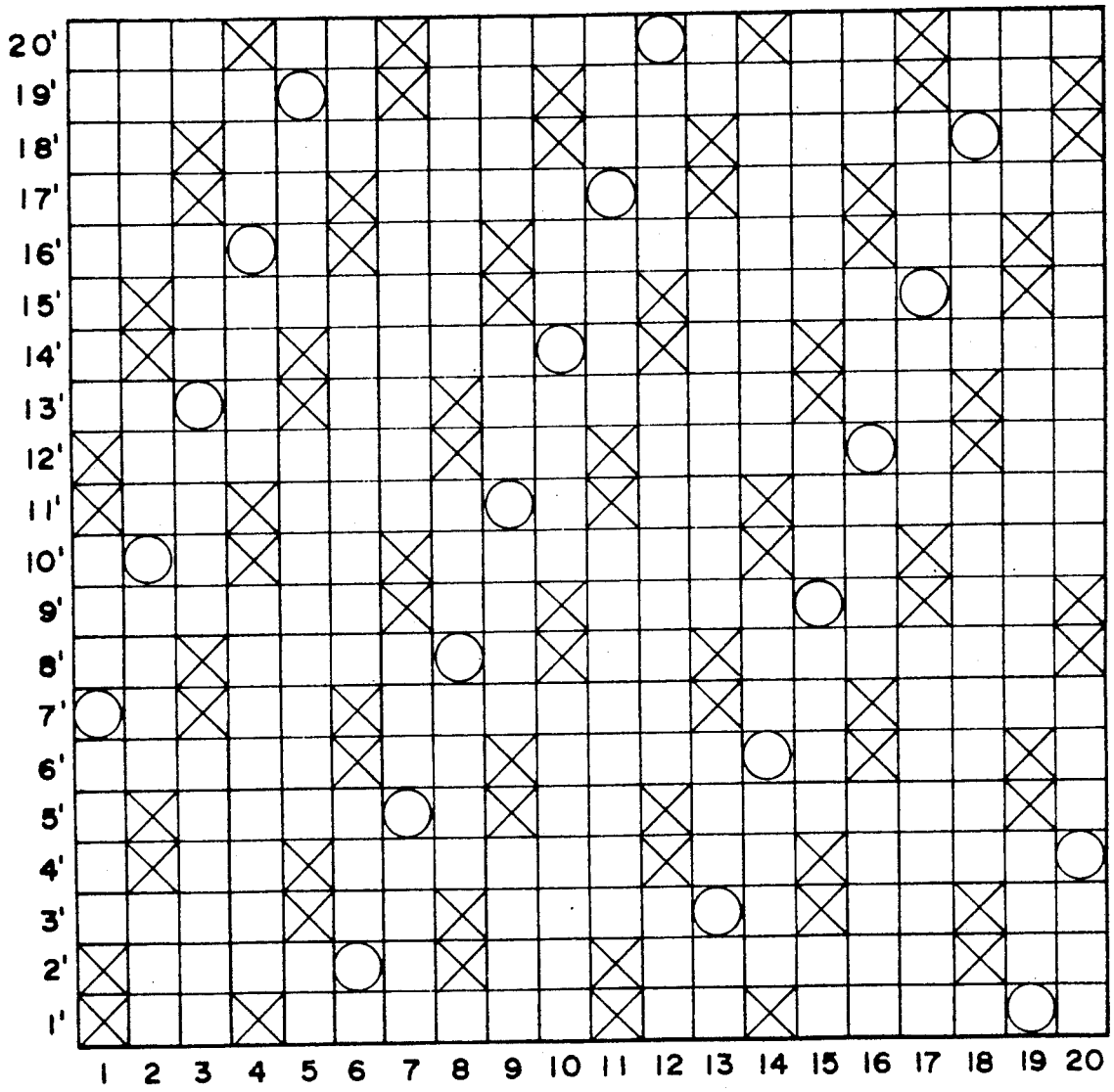
Figure 5:
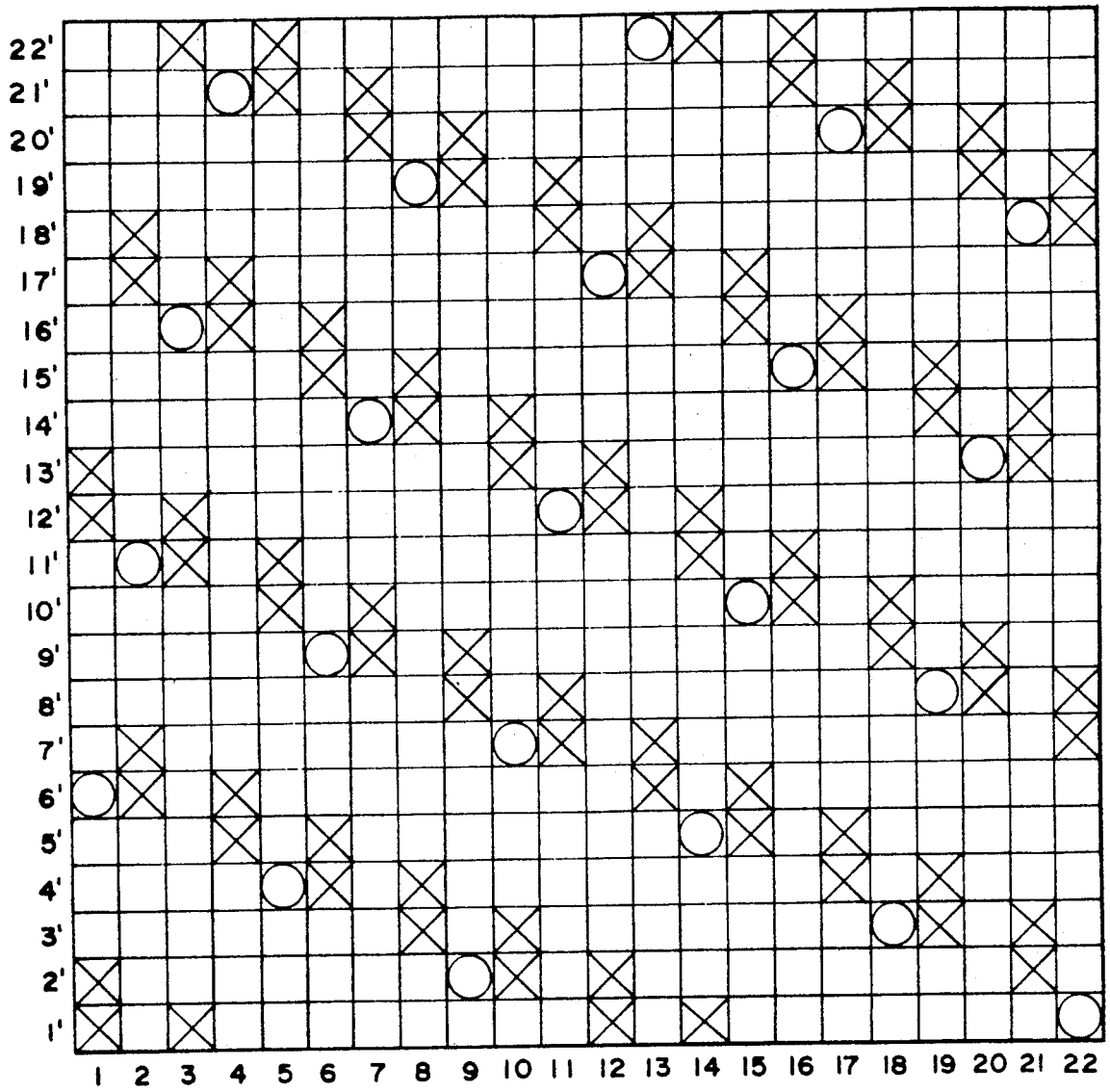
Figure 6:
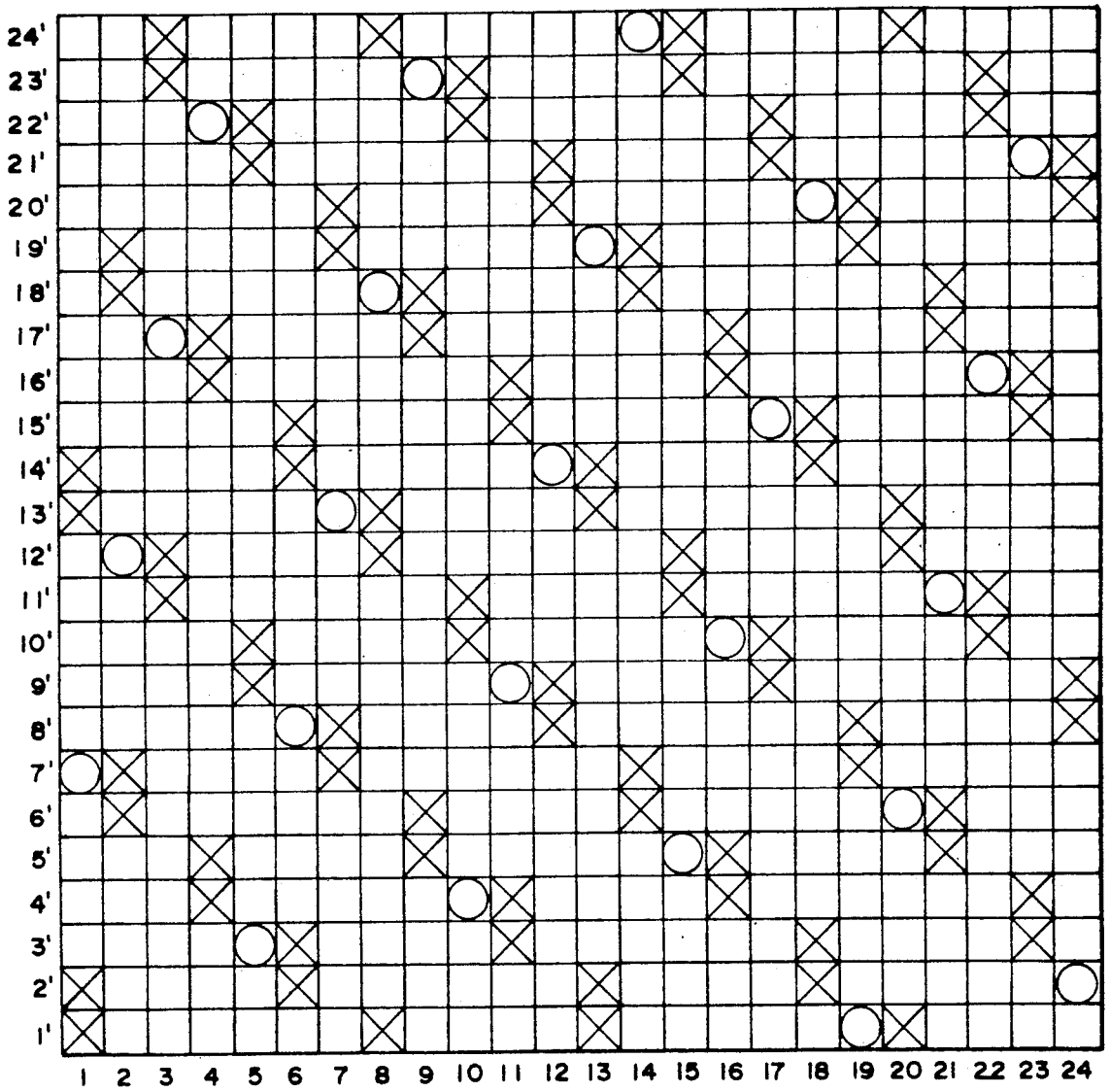

In a 20-shaft papermakers' fabric of FIG. 4, a fabric provided with predetermined wear resistance may also be obtained either by alternately arranging, as the lower surface wefts, 3 polyamide wefts and 2 polyester wefts or by alternately arranging 2 polyamide wefts and 3 polyester wefts.

Further, Examples 1-6 only indicate the fabrics in which both polyester yarns and polyamide yarns are used as the running side surface (lower surface) wefts, but the fabric A, as mentioned before, may be a fabric in which polyester yarns alone or polyamide yarns alone are used as the lower surface wefts.

In this manner, the fabric A of this invention could have a larger effective to-be-worn volume of the lower surface wefts than the conventional fabrics and could be remarkably improved in wear resistance. This will be substantiated by the following comparative tests.

The papermakers' fabric of FIG. 1 (Example 1) which typifies the fabric A of this invention, and the conventional papermakers' fabric of FIG. 59 (Comparative Example 1) are tested to compare wear resistance between the two fabrics.

First of all, for comparison of to-be-worn volumes of the lower surface wefts between said two fabrics, the volumes of the crimps of the wefts are calculated on the assumption that the crimp extending between the two warps respectively situated at both the ends of the crimp is cylindrical in shape. In practice, as explained later, not only some portions of wefts which are bent and form knuckles but also the upper portions of warps are irrelevant to wear or abrasion or are not conducive to the wear resistance of a fabric and, therefore, the conventional fabrics as indicated in Comparative Example 1 have a to-be-worn volume which is smaller than that obtained by calculation.

To compare the to-be-worn volumes of lower surface wefts between the fabric of Example 1 and the fabric of Comparative Example 1, calculation of said volumes are carried out on adjacent two wefts in each of one repeats of said two fabrics.

FIG. 1 (Example 1) and FIG. 59 (Comparative Example 1) are each a complete design (one repeat) of a papermakers' double layer type fabric consisting of 16 warps, 16 upper surface wefts and 16 lower surface wefts.

In FIG. 59 (Comparative Example 1), the lengths of crimps respectively formed on the adjacent lower surface wefts are identical with each other. In this Figure (one repeat), two knuckles (each represented by the symbol "O") are formed on each of the lower surface wefts and this Figure indicates that each lower surface weft forms 2 crimps in total in one repeat of the fabric. One of the crimps of each lower surface weft crosses 7 warps and the length of the crimp is 7 times the diameter of the warp assuming that said 7 warps are arranged in contact with one another. Thus, each lower surface weft in one repeat forms two crimps whose total length is 14 (7×2) times the diameter of the warp, and the adjacent two lower surface wefts form four crimps whose total length is 28 (14×2) times the diameter of the warp. Therefore, in FIG. 59 which is one repeat, the total volume of crimps of the adjacent lower surface wefts is:

$$14\times2\times0.17\times(0.22/2)^2\pi=0.181\ \text{mm}^3$$

assuming that the diameter of the warps used is 0.17 mm, and the diameter of each of the lower surface polyester and polyamide wefts is 0.22 mm.

Likewise, in FIG. 1 which is one repeat of the fabric A of this invention, the lengths of crimps the adjacent lower surface wefts form are identical with each other as in FIG. 59, but the lower surface wefts in FIG. 1 form longer crimps than those in FIG. 59. On each of the former lower surface wefts, one knuckle (symbol "O") is formed in one repeat. Thus, one lower surface weft forms one crimp in total in one repeat of the fabric. The one crimp crosses 15 warps in the fabric and is therefore considered to have a length which is 15 times the diameter of the warp on the assumption that the warps are arranged in contact with one another. It follows from this that each lower surface weft in one repeat forms a crimp whose length is 15 (15×1) times the diameter of the warp.

Longer crimps have better crimpiness and permit wefts having a larger diameter. Particularly, the use of larger polyamide wefts is apt to be conducive to the enhancement of wear resistance of a fabric.

Thus, in one repeat of FIG. 1, the volume of crimps of the adjacent two lower surface wefts is:

$$15\times0.17(0.22/2)^2\pi+15\times0.17\times(0.25/2)^2\pi=0.222\ \text{mm}^3$$

assuming that the diameter of the warp used is 0.17 mm, the diameter of the lower surface polyester weft used is 0.22 mm and the diameter of the lower surface polyamide weft used is 0.25 mm.

The to-be-worn volume of the fabric of FIG. 1 is larger than that of the fabric of FIG. 59 by 22.7% of the latter as is indicated by the following equation:

$$(0.222\div0.181-1)\times100=22.7(\%)$$

It is found even by simple calculation that the fabric A of this invention (Example 1) has a to-be-worn volume which is larger than that of the conventional fabric of Comparative Example 1 by about 20% of the latter.

In addition, the length of each of crimps of lower surface wefts which form the running side surface of the conventional fabric of FIG. 59 was found to be 1.105 mm by actual measurement, while the length of each of crimps of lower surface wefts in the fabric A of this invention shown in FIG. 1 was found to be 2.28 mm.

To further substantiate the above facts, there will be presented Table 9 in which are described the results obtained from comparative tests which were carried out under the test conditions to be described later.

EXAMPLES 7-12

FIGS. 10-15 are respectively complete designs (repeats) of papermakers' double layer type fabrics B of this invention (Examples 7-12). In one repeat of these fabrics B, 16 respectively of warps, upper surface wefts and lower surface wefts are used (16-shaft: Example 7), 14 respectively thereof are used (14-shaft: Example 8), 18 respectively thereof are used (18-shaft: Example 9), 20 respectively thereof are used (29-shaft: Example 10), 22 respectively thereof are used (22-shaft: Example 11) or 24 respectively thereof are used (24-shaft: Example 12).

The reference numbers and symbols used in FIGS. 10-15 have respectively the same meaning as used in FIGS. 1-6. A group of symbols O,X,O arranged in series on wefts in FIGS. 10–15 indicates that adjacent two warps in a pair between which one warp interlacing with a papermaking side surface (upper surface) weft is arranged, interlace with one lower surface weft in the running side surface to form a knuckle.

In FIGS. 10–15, the symbol "O" is not present on the warps indicated by even numbers and this shows that the warps indicated by even numbers interlace with none of the lower surface wefts.

Examples 7–12 will in turn be explained hereunder by reference to the accompanying drawings.

FIG. 10 (Example 7) is a complete design (one repeat) of a papermakers' double layer type fabric comprising 16 respectively of warps, upper surface wefts and lower surface wefts in one repeat. FIGS. 10A, 10B and 10C are plan views showing respectively the running side surface, a warp cross sectional drawing for the first two wefts 1' and 2' and the papermaking side surface of the fabric shown in FIG. 10. In these Figures, a lower surface polyester weft 1' is interlaced once in this repeat with adjacent warps 13 and 15 between which one warp interlacing with none of both the lower surface polymeric wefts is arranged, to form a knuckle. A crimp extending between the knuckle in this repeat and its adjacent knuckle formed on the same weft in the right-hand or left-hand neighboring repeat (not shown), crosses 13 warps. A lower surface polyamide weft 2' is interlaced once in this repeat with adjacent warps 11 and 13 between which one warp interlacing with none of both the lower surface polymeric wefts is arranged, to form a knuckle. A crimp extending between the knuckle in this repeat and its adjacent knuckle formed on the same weft in the right-hand or left-hand neighboring repeat (not shown), crosses 13 warps. Any one of said crimps is longer than that of the conventional weft in FIG. 59 (Comparative Example 1). The crimps of other lower surface polyester and polyamide wefts are longer than the conventional ones as in said weft.

In FIG. 10, a warp 14 is sandwiched in between warps 13 and 15 which interlace with a lower surface weft 1', the warp 14 interlaces with upper surface (papermaking side surface) weft 2' at the knuckle where warps 13 and 15 interlace with a lower surface weft 1', the warp 14 extends through between the warps 13 and 15 upward to the papermaking side surface thereby to enable the warps 13 and 15 to approach each other, and the warps 13 and 15 in a pair strongly bend the lower surface weft 1' to interlace therewith whereby higher crimp is achieved. As mentioned above, the warp 14 extends through between the warps 13 and 15 at the knuckle where the warps 13 and 15 interlace with the lower surface weft 1' and upward to the papermaking side surface whereby the warps 13 and 15 approach each other to decrease planar drainage spaces, but three-dimensional drainage spaces due to the presence of the warp 14 are formed at this knuckle thereby preventing the uneven distribution of the drainage spaces.

Further, in FIG. 10, as in the case of said lower surface weft 1', the warps 11 and 13 in a pair strongly bend the lower surface weft 2' to interlace therewith thereby to make crimpiness remarkably satisfactory, and three-dimensional drainage spaces due to the presence of the warp 12 are formed at the knuckle where the warps 11 and 13 approach each other thereby to prevent the drainage spaces from being unevenly distributed.

Moreover, in FIG. 10, a knuckle formed by the warps 11 and 13 which interlace with the lower surface weft 2' is arranged "two warps" laterally away from a knuckle formed by the warps 13 and 15 which interlace with the lower surface weft 1' and, thus, it is understood that said two knuckles are not arranged adjacent to each other. In addition, a knuckle where the lower surface weft 2' is interlaced is arranged "8 warps" laterally away from a knuckle where the lower surface weft 3' is interlaced and, thus, said two knuckles are not arranged adjacent to each other.

In FIGS. 11–15 (Examples 8–12), as in Example 7, lower surface polyester wefts and lower surface polyamide wefts are each interlaced once in one repeat with a pair of warps between which one warp interlacing with none of both the lower surface polymeric wefts is arranged to form a knuckle. Between said knuckle and a knuckle formed on the same weft in the right-hand or left-hand neighboring repeat (not shown), there are formed crimps which cross 11 (Ex. 8), 15 (Ex. 9), 17 (Ex. 10), 19 (Ex. 11) and 21 (Ex. 12) of the warps, respectively.

In FIGS. 11–15 (Examples 8–12), as in Example 7, the lower surface polymeric wefts are each strongly bent and interlaced with the adjacent two warps in a pair between which one warp interlacing with none of both the lower surface polymeric wefts is arranged, thereby to remarkably improve crimpiness. Further, since there is present one warp extending upward to the papermaking side surface through the knuckle where the two warps interlacing with the lower surface weft approach each other, three-dimensional drainage spaces are formed thereby preventing the drainage spaces from being unevenly distributed.

Further, in FIGS. 11–15 (Examples 8–12), as in Example 7, the knuckles formed on the adjacent lower surface wefts are arranged laterally away from each other and are therefore not arranged adjacent to each other.

It is understood from Examples 7–12 that knuckles where the lower surface wefts are interlaced are not unevenly distributed in the fabric B of this invention. Further, in the fabric B, since lower surface wefts forming the running side surface are each interlaced once in one repeat, the crimp of the weft is longer than a conventional one and crimpiness improves thereby to permit the use of bigger (in diameter) lower surface wefts, enlarge the to-be-worn volume and further enhance the wear resistance of the wefts.

In the fabric B of this invention, the polyester yarns and polyamide yarns may be mixedly woven, as mentioned above, or used alone as the lower surface wefts. Further, one or a plurality of polyester yarns and one or plurality of polyamide yarns may be or may not be alternately arranged.

In this manner, in the fabric B of this invention, the effective to-be-worn volume of the running side surface (lower surface) wefts may be further enlarged as compared with conventional fabrics and the wear resistance of the fabric may also be remarkably improved. This will be substantiated, as in Example 1, by the following comparative tests.

The papermakers' fabric indicated in FIG. 10 (Example 7) which is typical of the fabric B of this invention, is compared with the conventional fabric indicated in FIG. 59 (Comparative Example 1) to find differences in wear resistance therebetween.

In FIG. 10 (one repeat) of the fabric B of this invention, as in FIG. 59, crimps formed by the adjacent lower surface wefts are identical in length with each other, and the lower surface wefts in FIG. 10 form longer crimps than those in FIG. 59. In this complete design (FIG. 10), a knuckle "OXO" is formed on each lower surface weft, and, it will be understood in view of this repeat (FIG. 10) and the neighboring repeats that there is formed on one weft in one repeat one crimp in total which crosses 13 of the warps. Giving the above fact the same thought as in Example 1, it may be considered that a crimp whose length is 13 (13×1) times the diameter of the warp is formed on each lower surface weft in one repeat.

In the fabric B of this invention, since the crimp of each of the lower surface wefts is long and, further, the adjacent two warps in a pair between which one warp interlacing with none of both the lower surface wefts interlace with a lower surface weft, there can be used wefts having a further big diameter Accordingly, in FIG. 10 which is one repeat, the volume of crimps of the adjacent two lower surface wefts is:

$$13\times0.17\times(0.30/2)^2\pi+13\times0.17\times(0.30/2)^2\pi=0.31\ \text{mm}^3$$

assuming that the diameter of the warp used is 0.17 mm, the diameter of the lower surface polyester weft used is 0.30 mm and the diameter of the lower surface polyamide weft used is 0.30 mm.

Thus, the to-be-worn volume of the fabric of FIG. 10 is larger than that of the fabric of FIG. 59 as indicated by the following equation:

$$(0.312\div0.181-1)\times100=72.4(\%)$$

As is seen from the above, even the above rough calculation indicates that the to-be-worn volume of the fabric B of this invention is larger than that of the conventional fabric of Comparative Example 1 by 72.4% of the volume of the latter.

To make this further clear, the results of comparative tests carried out under the following test conditions will be indicated in the following Table 9.

EXAMPLES 13-23

FIGS. 16-26 are each a complete design (one repeat) of a papermakers' double layer type fabric C of this invention (Examples 13-23). In one repeat of these fabrics C, the respective numbers of warps, upper surface wefts and lower surface wefts used are 16 (16-shaft: Examples 13, 20 and 21), 14 (14-shaft: Example 14), 18 (18-shaft: Examples 15 and 19), 20 (20-shaft: Examples 16, 22 and 23), 22 (22-shaft: Example 17) and 24 (24-shaft: Example 18).

The numbers and symbols used in FIGS. 16, 17, 19-21 (Examples 13, 14, 16-18) have the same meaning as those used in Examples 1-6. In FIGS. 18, 22-26 (Examples 15, 19-23), lower surface wefts indicated by numbers with a prime such as 1', 2', 3' - - -, are different in material from those used in Examples 1-6, but the other numbers as well as the symbols have the same meaning as those used in Examples 1-6. The materials of lower surface wefts in FIGS. 18 and 22-26 will be concretely clarified in the detailed explanation of the Examples.

Examples 13-23 will in turn be explained hereunder by reference to the accompanying drawings.

FIG. 16 (Example 13) is a complete design (one repeat) of a papermakers' double layer type fabric C in which 16 warps, 16 upper surface wefts and 16 lower surface wefts are used. FIGS. 16A and 16B are plan views showing respectively the running side surface and a warp cross sectional drawing for the first two wefts 1' and 2' of the fabric shown in FIG. 16. In these Figures, a lower surface polyester weft 1' is interlaced twice in one repeat with warps 5 and 13 to form knuckles. Between these knuckles and between one of these knuckles in this repeat and the adjacent knuckle formed on the same weft in the right-hand or left-hand neighboring repeat (not shown), crimps are formed. Each of the crimps so formed crosses 7 warps and is as short as a conventional one. On the other hand, a lower surface polyamide weft 2' is interlaced once in one repeat with a warp 16 to form a knuckle. Between this knuckle in this repeat and its adjacent knuckle formed on the same weft in the right-hand or left-hand neighboring repeat (not shown), there is formed a crimp which crosses 15 warps. This crimp is longer than the conventional one in FIG. 59 (Comparative Example 1). With respect to other lower surface wefts, like the above-mentioned wefts, polyester wefts form short crimps and polyamide wefts form long crimps.

In FIGS. 17-21 (Examples 14-18), as in said Example 13, lower surface polyester wefts are respectively interlaced twice in one repeat with a warp to form knuckles and form short crimps On the other hand, lower surface polyamide wefts are respectively interlaced once in one repeat with a warp to form a knuckle and form long crimps. It is to be noted that in Example 15 (FIG. 18), with regard to the lower surface wefts, odd numbers having a prime such as 1', 3', 5' - - -, indicate polyamide wefts while even numbers having a prime such as 2', 4', 6' - - -, indicate polyester wefts. The lengths of crimps of the lower surface polyester and polyamide wefts in said Examples 14-18 correspond respectively to distances over which the crimps extend across the warps the numbers of which are indicated in the following Table 1.

TABLE 1

| | Length of crimp (Number of warps crossed by crimp) | |
|---|---|---|
| | Polyester weft | Polyamide weft |
| Example 14 | 6 | 13 |
| Example 15 | 8 | 17 |
| Example 16 | 9 | 19 |
| Example 17 | 10 | 21 |
| Example 18 | 11 | 23 |

The crimps of the lower surface polyamide wefts in FIGS. 17-21 (Examples 14-18) are longer than those of the lower surface wefts of conventional papermakers' double layer type fabrics (not shown) having the same number of shafts as those in said Figures, respectively.

It is apparent from FIGS. 16-21 that in Examples 13-18, every other lower surface weft forms long crimps, and the long crimps are identical in length with one another.

In the fabric C of this invention, since it is possible to differentiate in length of crimps between the polyester wefts and polyamide wefts in the running side surface (lower surface) of the fabric and to use, as long crimp-forming polyamide wefts, those which have larger diameter than conventionally used ones, the to-be-worn volume of the lower surface wefts can be increased and the wear resistance of the fabric can be enhanced.

Further, in the running side surface (lower surface) of the fabric C, as explained with reference to FIGS. 22-26 (Examples 19-23), it is not always necessary to alternately arrange the wefts having crimps of different length so that they are situated adjacent to one another. It is neither always necessary to arrange the long crimp-forming wefts and the short crimp-forming wefts in equal number in the fabric. It is preferable that the long crimp-forming lower surface polyamide wefts and the short crimp-forming lower surface polyester wefts be arranged in a ratio (in number) of from 3:1 to 1:3.

Figure 22:
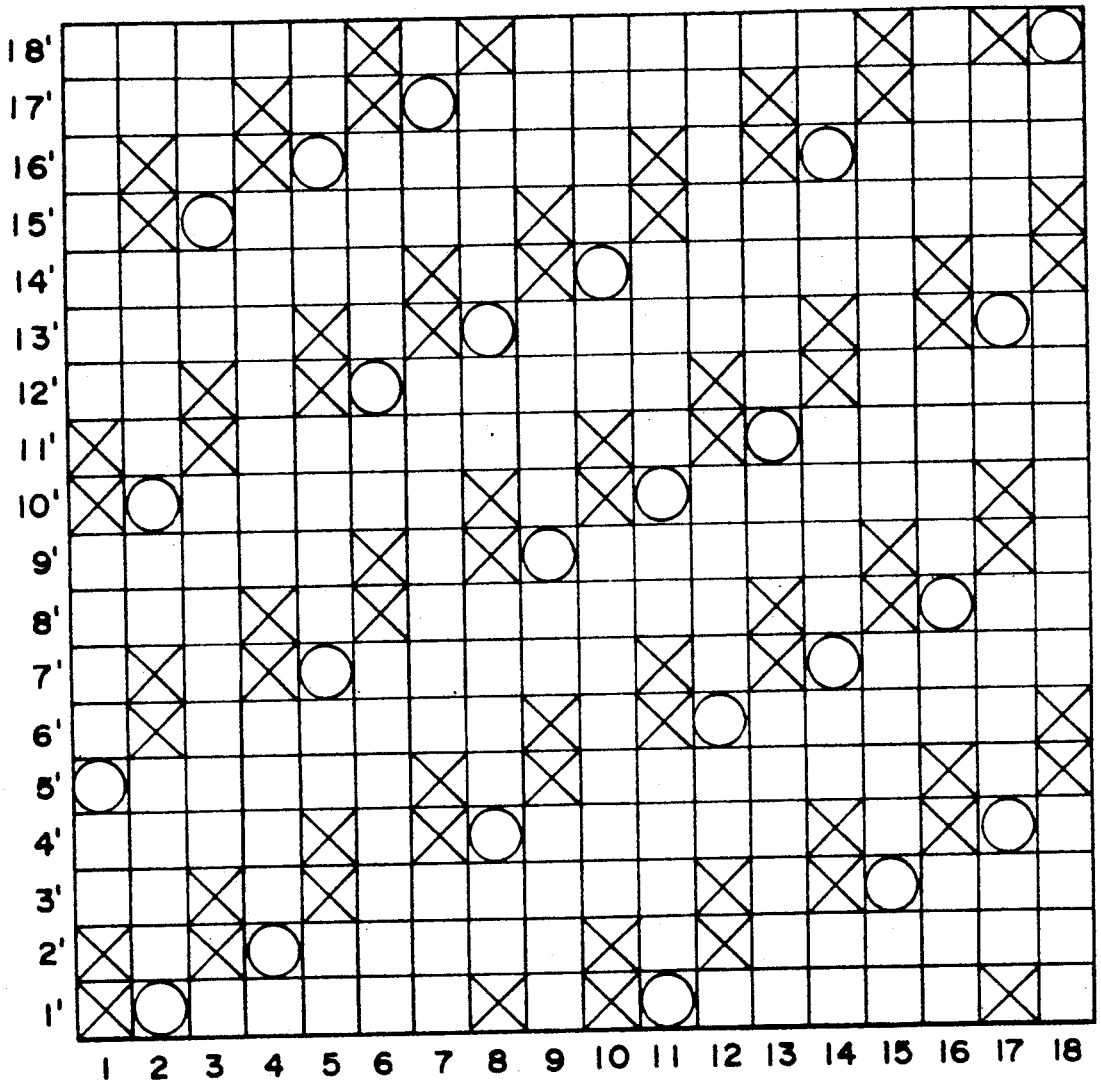

FIG. 22 (Example 19) shows one repeat of a papermakers' double layer type fabric C (18-shaft) in which as lower surface wefts, two long crimp-forming polyamide wefts and one short crimp-forming polyester weft are alternately arranged and in which the lower surface polyamide wefts and the lower surface polyester wefts are mixedly woven in a ratio (in number) of 2:1. In FIG. 22, the lower surface polyamide wefts are designated at 2', 3', 5', 6', 8', 9', 11', 12', 14', 15', 17' and 18', and the other wefts are polyester wefts.

Figure 23:
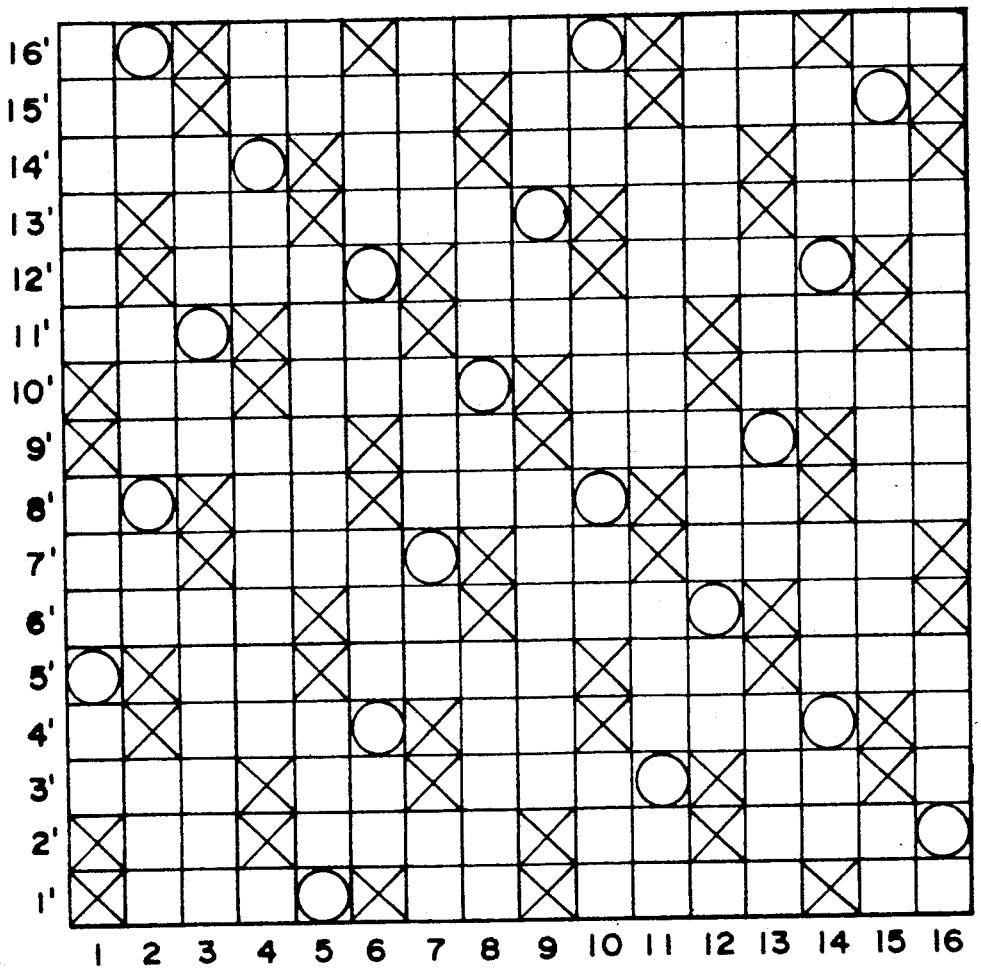

FIG. 23 (Example 20) shows one repeat of a papermakers' double layer type fabric C (16-shaft) in which as the lower surface wefts, 3 long crimp-forming polyamide wefts and one short crimp-forming polyester weft are alternately arranged and in which said polyamide wefts and said polyester wefts are mixedly woven in a ratio (in number) of 3:1. In FIG. 23, the lower surface polyamide wefts are designated at 1', 2', 3', 5', 6', 7', 9', 10', 11', 13', 14' and 15', and the other wefts are polyester wefts.

Figure 24:
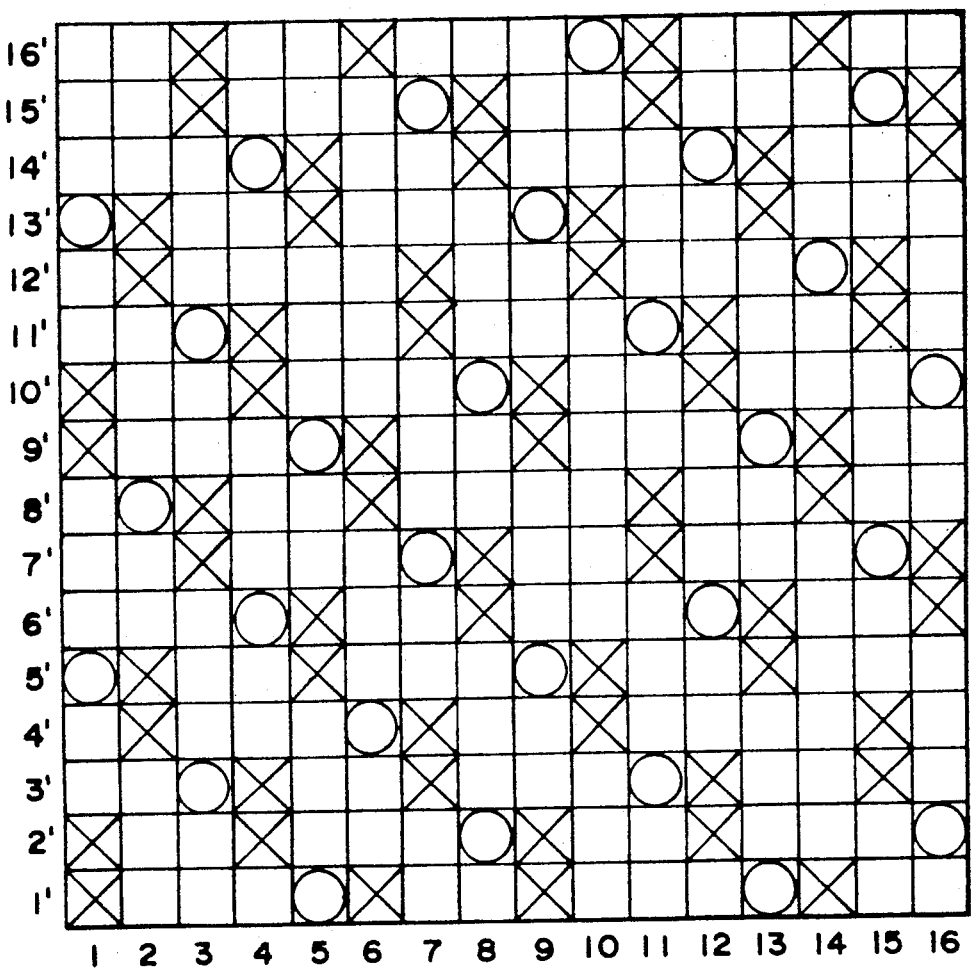

FIG. 24 (Example 21) shows one repeat of a papermakers' double layer type fabric C (16-shaft) in which as lower surface wefts, one long crimp-forming polyamide weft and three short crimp-forming polyester wefts are alternately arranged and in which the lower surface polyamide wefts and the lower surface polyester wefts are mixedly woven in a ratio (in number) of 1:3. In FIG. 24, the lower surface polyamide wefts are designated at 4', 8', 12' and 16', and the other wefts are polyester wefts.

Figure 25:
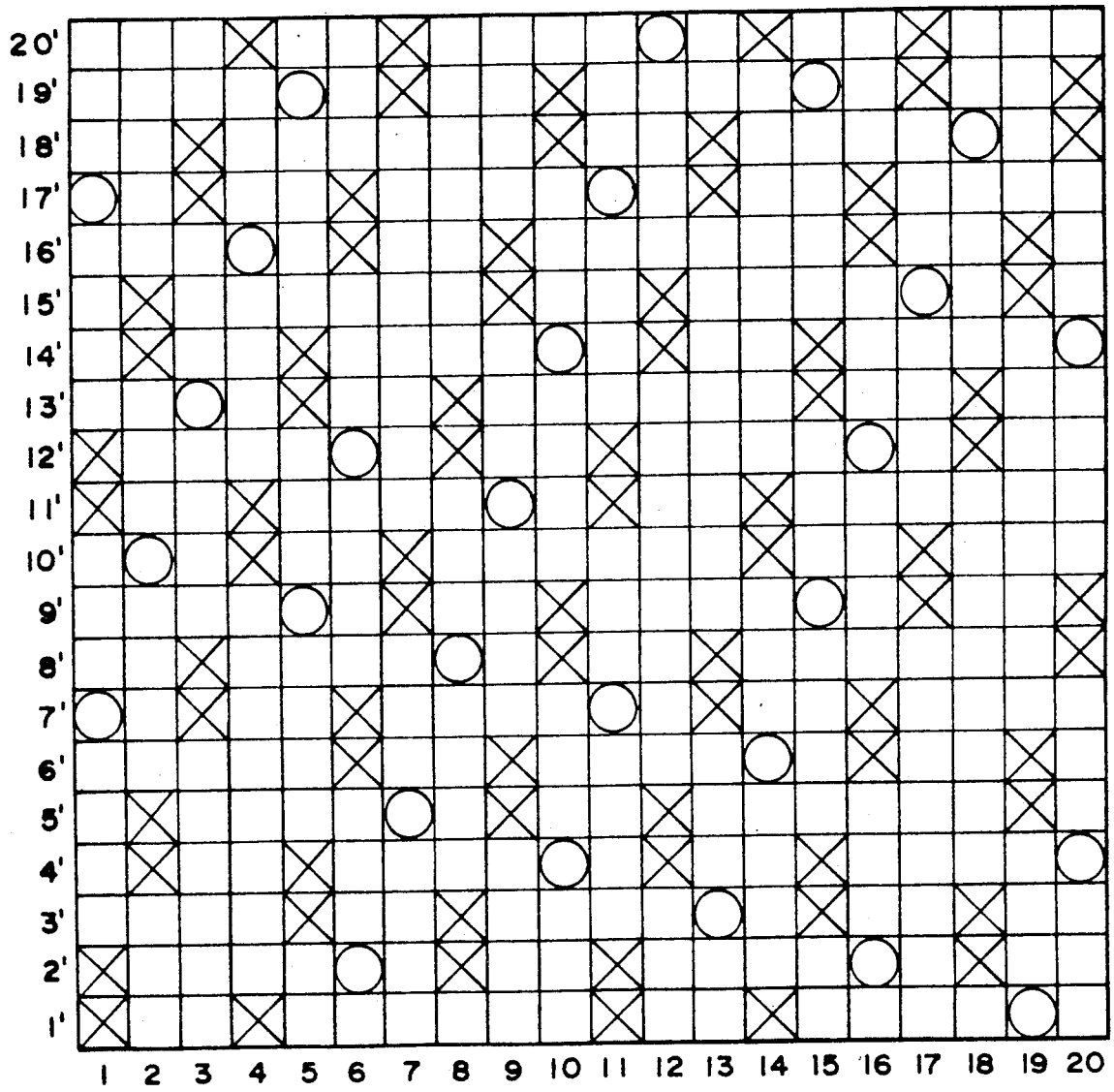

FIG. 25 (Example 22) shows one repeat of a papermakers' double layer type fabric C (20-shaft) in which long crimp-forming lower surface polyamide wefts and short crimp-forming lower surface polyester wefts are mixedly woven in a ratio (in number) of 3:2. In FIG. 25, the lower surface polyamide wefts are designated at 1', 3', 5', 6', 8', 10', 11', 13', 15', 16', 18' and 20', and the other wefts are polyester wefts.

Figure 26:
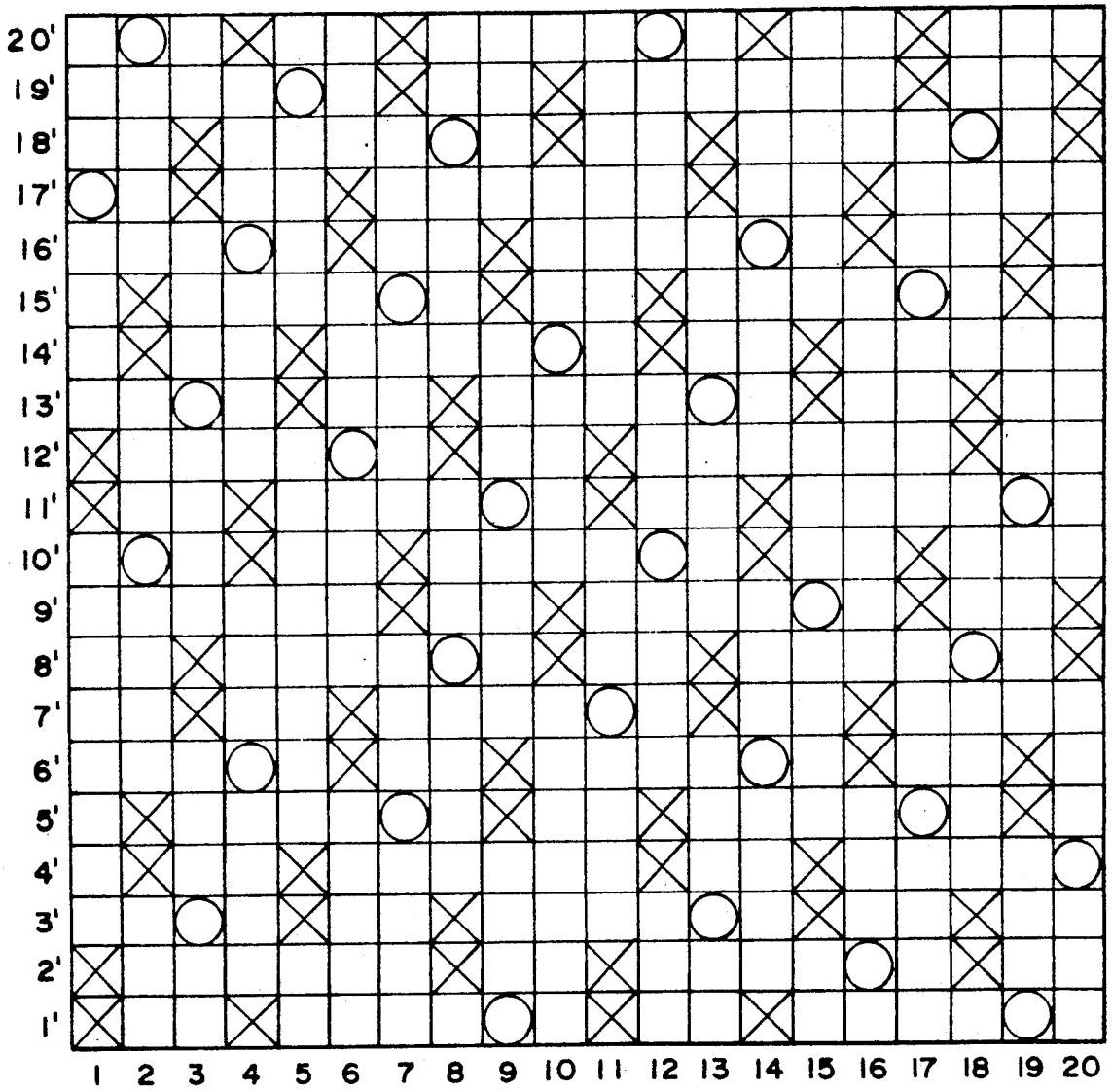

FIG. 26 (Example 23) shows one repeat of a papermakers' double layer type fabric C (20-shaft) wherein long crimp-forming lower surface polyamide wefts and short crimp-forming lower surface polyester wefts are mixedly woven in a ratio (in number) of 2:3. In FIG. 26, the lower surface polyamide wefts are designated at 2', 4', 7', 9', 12', 14', 17' and 19', and the other wefts are polyester ones.

In FIGS. 22–26 (Examples 19–23), as in said Examples 13–18, lower surface polyester wefts are each interlaced twice in one repeat with a warp to form knuckles, and form short crimps, while lower surface polyamide wefts are each interlaced once in one repeat with a warp to form a knuckle, and form long crimps. The lengths of crimps of the lower surface polyester and polyamide wefts in said Examples 19–23 correspond respectively to distances over which the crimps extend across the warps the numbers of which are indicated in the following Table 2.

TABLE 2

| | Length of crimp (Number of warps crossed by crimp) | |
|---|---|---|
| | Polyester weft | Polyamide weft |
| Example 19 | 8 | 17 |
| Example 20 | 7 | 15 |
| Example 21 | 7 | 15 |
| Example 22 | 9 | 19 |
| Example 23 | 9 | 19 |

It is possible that the papermakers' double layer type fabrics in FIGS. 22–26 (Examples 19–23) have a predetermined wear resistance.

There may also be obtained a predetermined wear resistance on a papermakers' double layer type fabric C (18-shaft)(not shown) wherein as the lower surface wefts, one long crimp-forming polyamide weft and two short crimp-forming polyester wefts are alternately arranged and wherein said polyamide wefts and said polyester wefts are mixedly woven in a ratio (in number) of 1:2.

In this manner, in the fabric C of this invention, the effective to-be-worn volume of the lower surface (running side surface) wefts could be remarkably enlarged as compared with that in conventional fabrics, and the wear resistance could be remarkably improved. This will be substantiated, as in Example 1, by the following comparative tests.

The papermakers' fabric of FIG. 16 (Example 13) which may be considered as typical of the fabrics C, and the conventional papermakers' fabric of FIG. 59 (Comparative Example 1), are tested to compare the wear resistance therebetween.

In FIG. 16 (one repeat) showing a fabric C of this invention, long crimp-forming wefts and short crimp-forming wefts are alternately arranged as the lower surface wefts. The short crimp-forming lower surface wefts form crimps having the same length as the lower surface wefts in FIG. 59 and each of the former wefts forms 2 crimps in total in one repeat. One of the crimps of these wefts crosses 7 warps and, therefore, it may be considered from the case of Example 1 that the short crimp-forming lower surface wefts in one repeat each form 2 crimps whose total length corresponds to 14 ($7\times2$) times the diameter of the warp. On the other hand, the long crimp-forming lower surface weft adjacent to said short crimp-forming lower surface weft, forms a longer crimp than the lower surface weft of FIG. 59, and it may be considered that the former weft forms one crimp in total in one repeat, the one crimp crossing 15 warps. Thus, considering likewise in the case of Example 1, the long crimp-forming lower surface wefts in one repeat each form one crimp whose length corresponds to 15 ($15\times1$) times the diameter of the warp.

In the fabric C of this invention, since the lower surface polyamide wefts form long crimps which improve crimpiness, this permitting the use of polyamide wefts having a big diameter.

Thus, in FIG. 16 which is one repeat, the volume of crimps of the adjacent two lower surface wefts is:

$$14\times0.17\times(0.22/2)^2\pi+15\times0.17\times(0.25/2)^2\pi=0.2\text{-}16\ \text{mm}^3$$

assuming that the diameter of the polyester warps used is 0.17 mm, the diameter of the lower surface polyester wefts used is 0.22 mm and the diameter of the lower surface polyamide wefts used is 0.25 mm.

The to-be-worn volume of the fabric of FIG. 16 is larger than that of the fabric of FIG. 59 by 19.3% of the latter as indicated by the following equation:

$$(0.216 \div 0.181 - 1) \times 100 = 19.3(\%)$$

Even the above rough calculation indicates that the fabric C (Example 13) of this invention has a to-be-worn volume which is about 20% larger than the conventional fabric of Comparative Example 1.

In addition, the lower surface polyamide wefts of the fabric C of this invention shown in FIG. 16 is found by actual measurement to have crimps of 2.28 mm in length.

To substantiate this, the results of comparative tests carried out under the test conditions to be later mentioned are shown in the following Table 9.

EXAMPLES 24–34

FIGS. 27–37 (Examples 24–34) are each a complete design (one repeat) of a papermakers' double layer type fabric D of this invention. In one repeat, there are used 16 respectively of warps, upper surface wefts and lower surface wefts (16-shaft Examples 24, 31 and 32), 14 respectively thereof (14-shaft Example 25), 18 respectively thereof (18-shaft: Examples 26 and 30), 20 respectively thereof (20-shaft: Examples 27, 33 and 34), 22 respectively thereof (22-shaft: Example 28) or 24 respectively thereof (24-shaft: Example 29).

The numbers and symbols used in FIG. 27 (Example 24) have the same meaning as those used in Examples 1–6. With respect to lower surface wefts shown in FIGS. 28–37 (Examples 25–34), wefts indicated by numbers with a prime such as 1', 2', 3' - - - , are different in material from those in Examples 1–6, but the other numbers and symbols used in said Figures are the same as those used in said Examples. The materials of lower surface wefts in FIGS. 28–37 will be concretely indicated when the Examples are explained in detail.

In FIGS. 27–37, the arrangement of two symbols "O" in series (OO) on lower surface wefts indicates that two adjacent warps interlace with one weft in the running side surface (lower surface) to form a knuckle. Thus, the distance between knuckles "OO" and "OO" in each (one repeat) of FIGS. 27–37 or the distance between "OO" in the Figure (one repeat) and "OO" formed on the same weft in the right-hand or left-hand neighboring repeat (not shown), indicates the length of one crimp of lower surface wefts which are used in the running side surface of the fabric.

Examples 24–34 will in turn be explained hereunder by reference to the accompanying drawings.

Figure 27A:
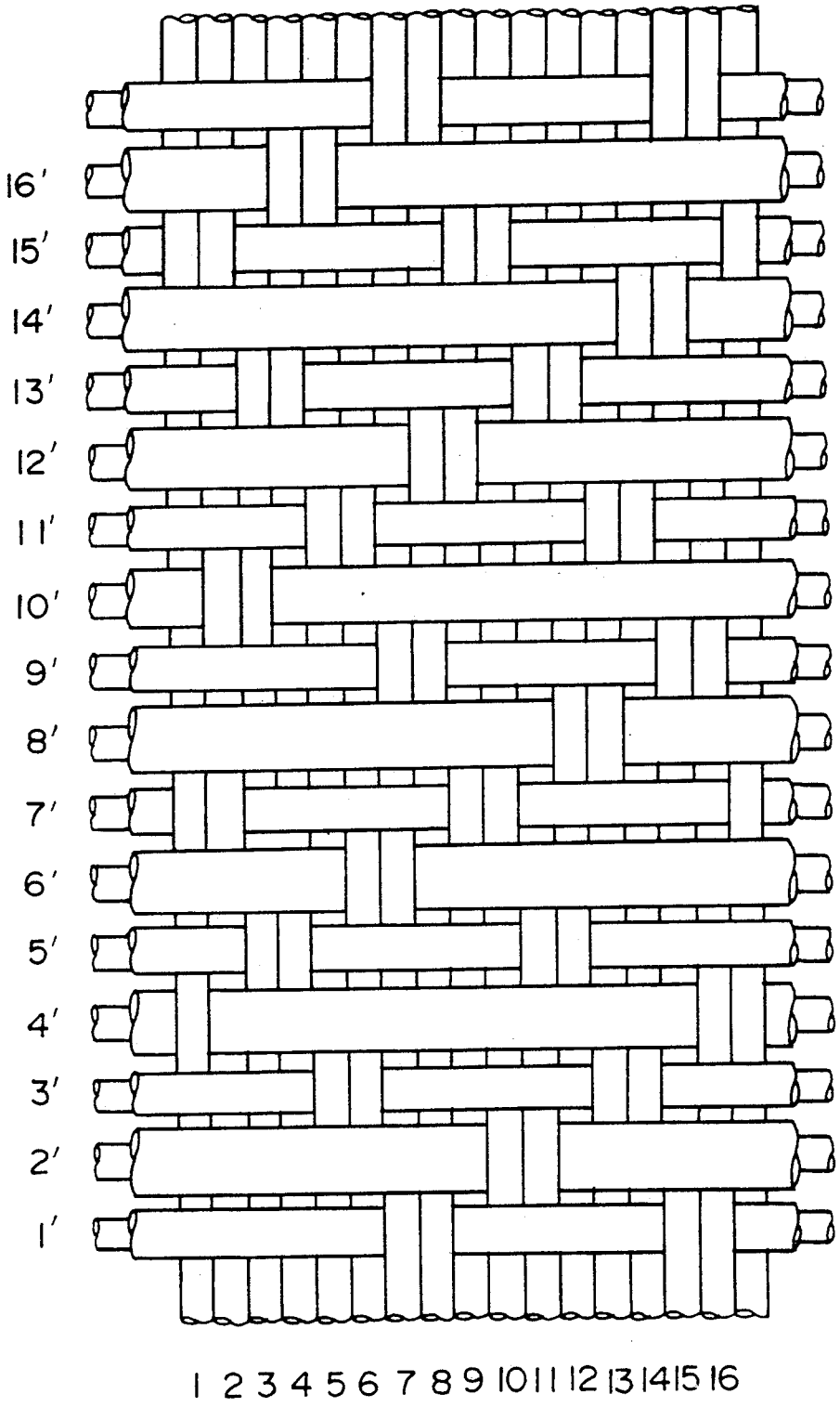
Figure 28:
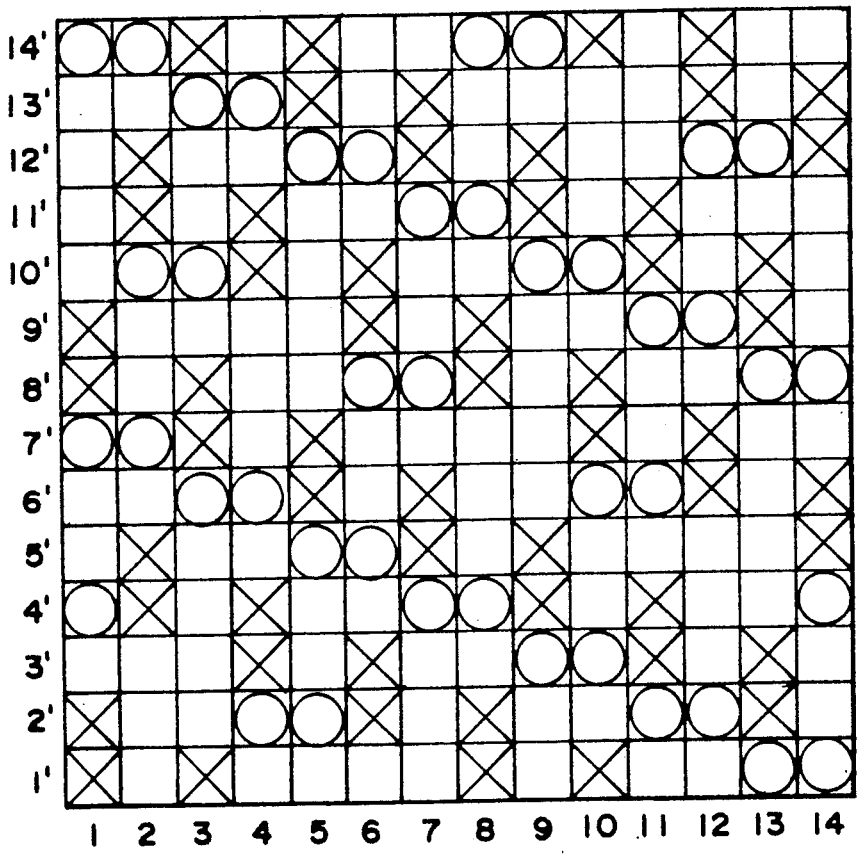
Figure 29:
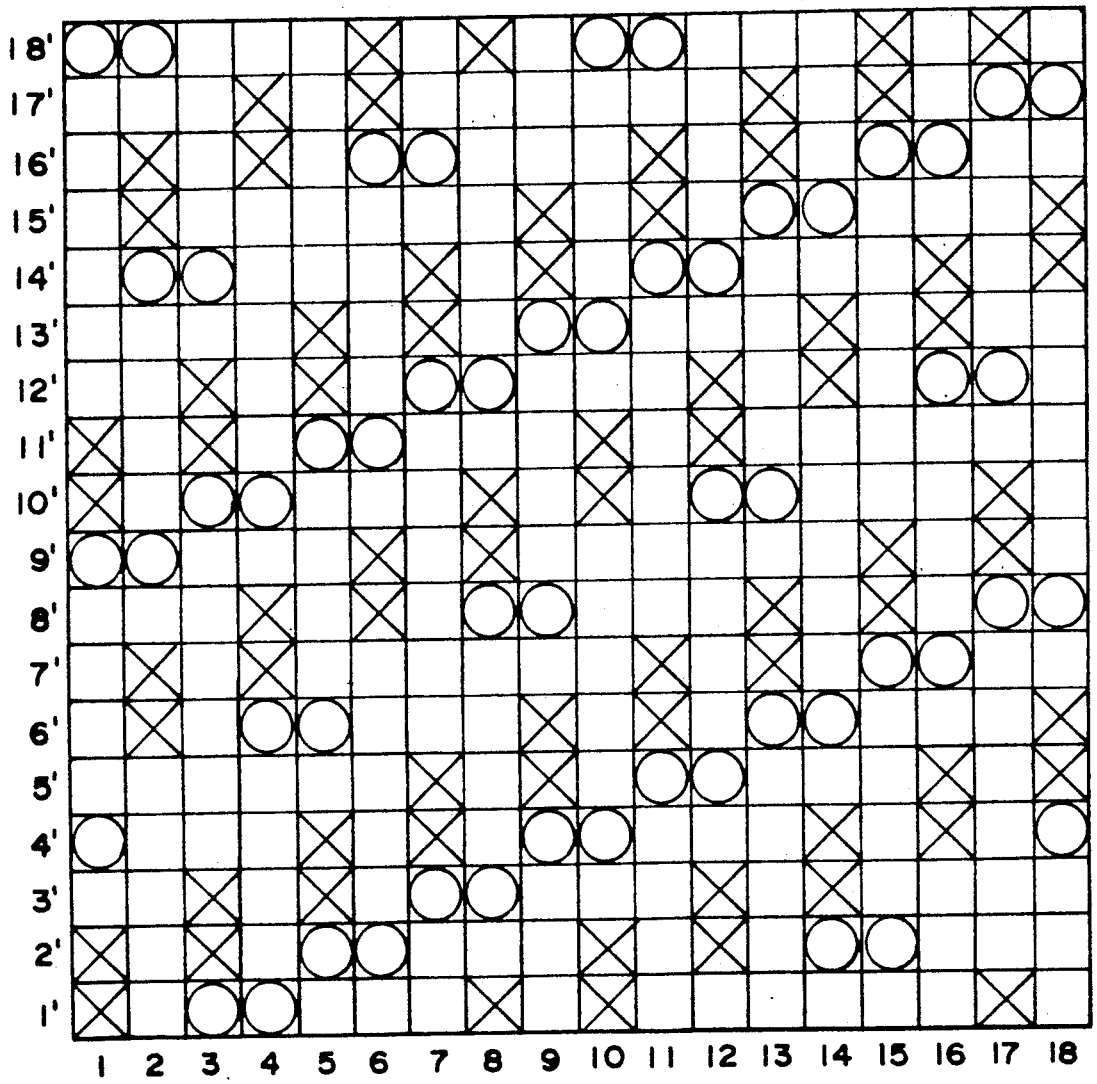
Figure 30:
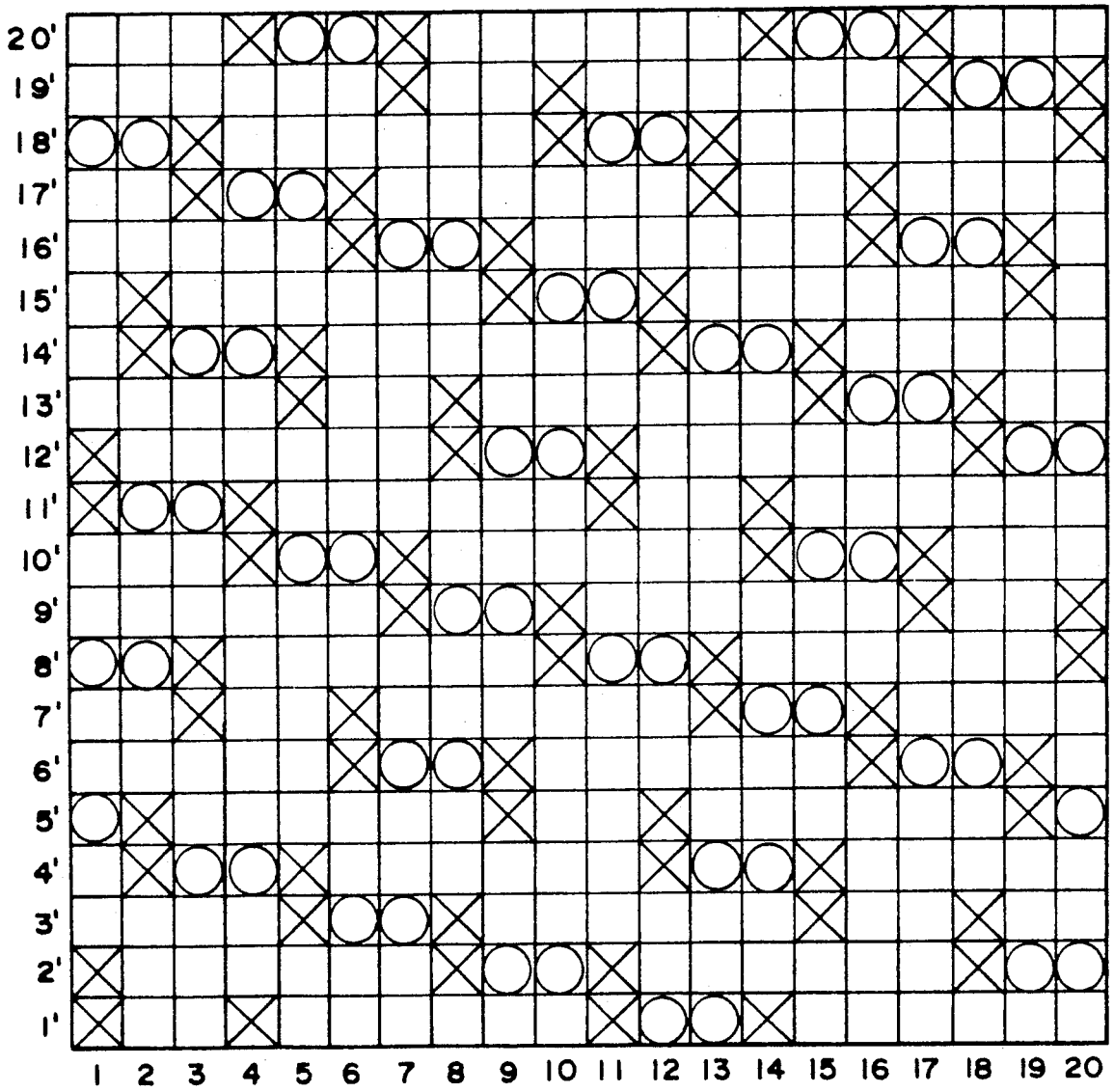
Figure 31:
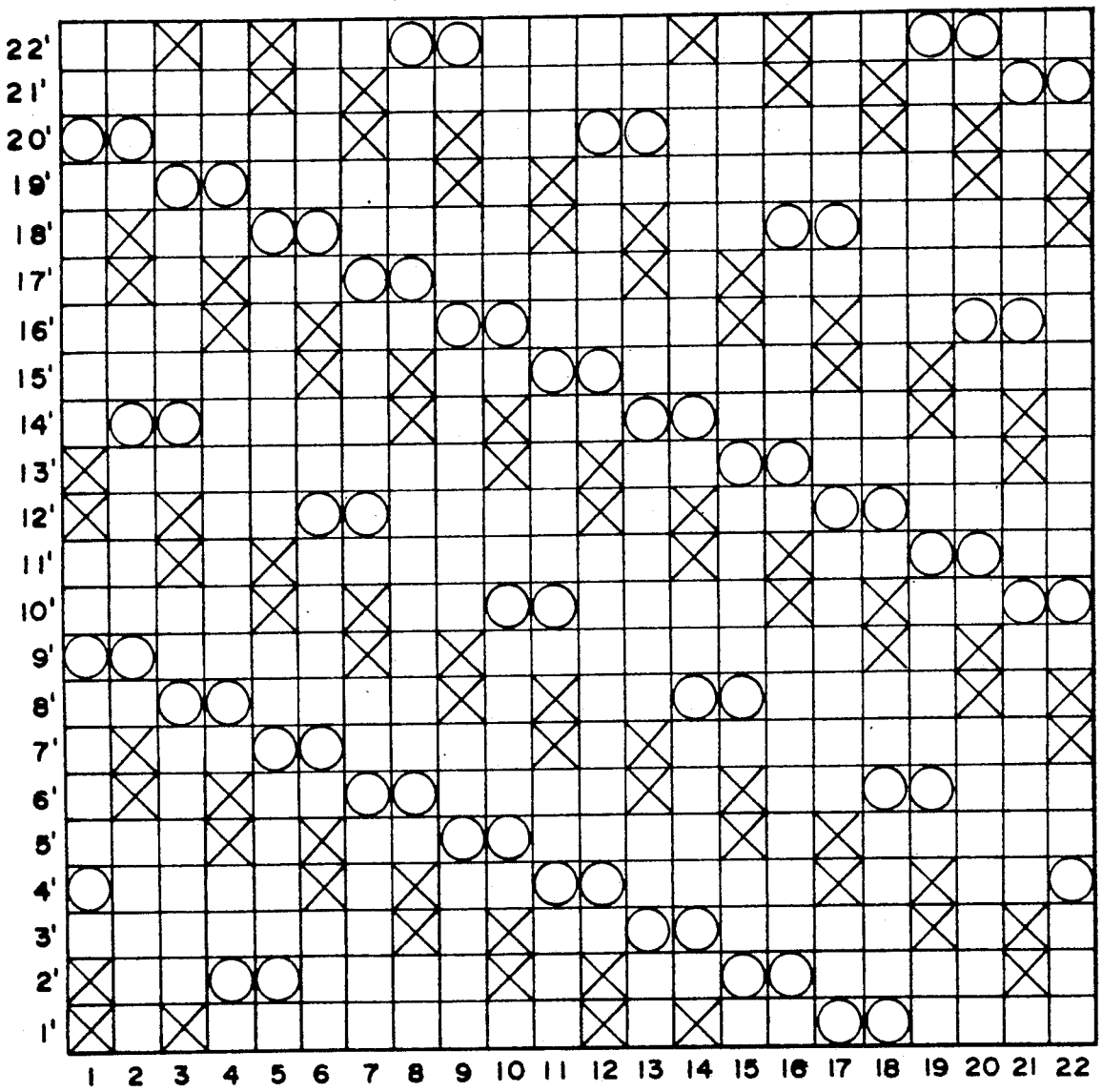
Figure 32:
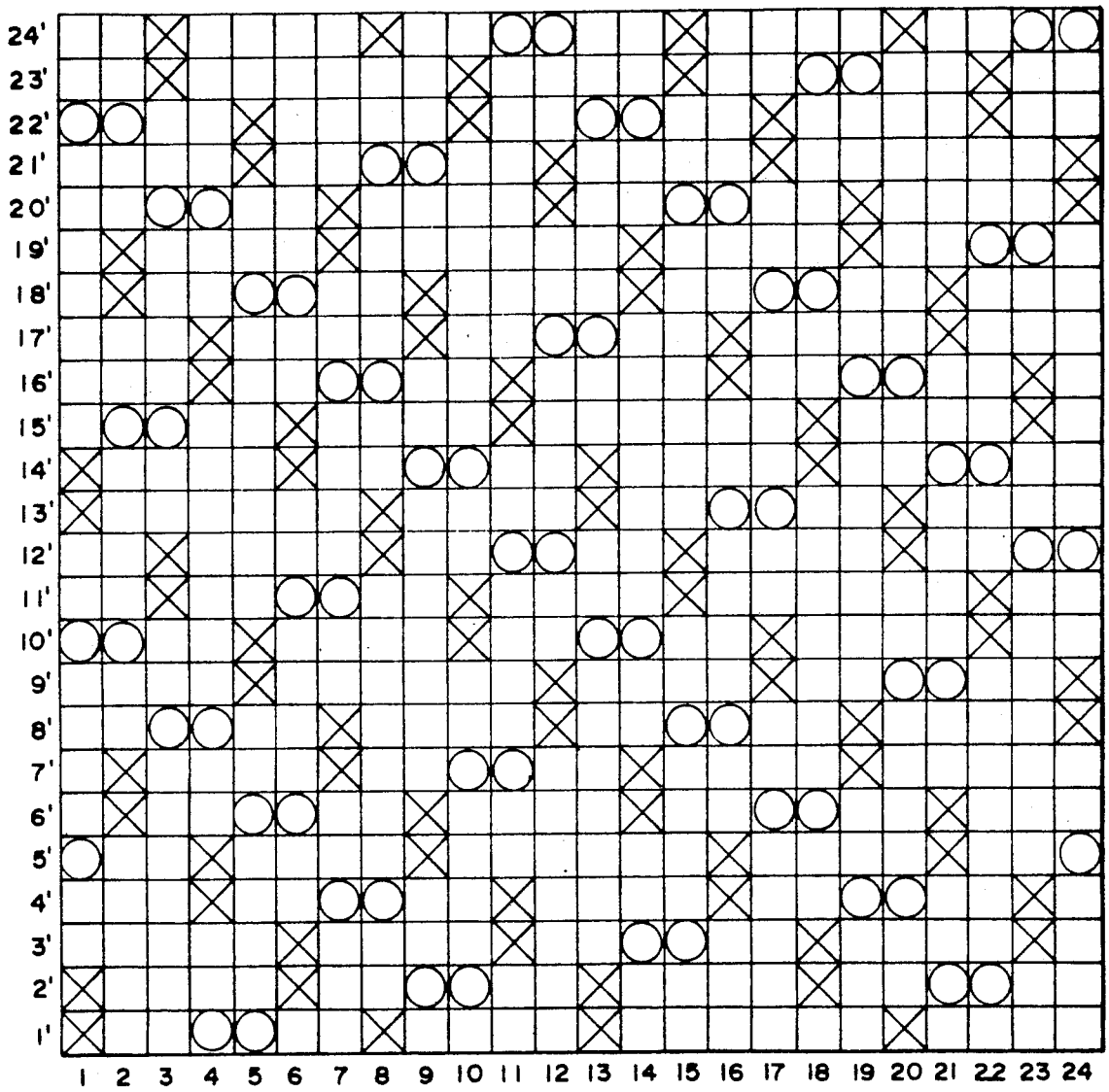

FIG. 27 (Example 24) is a complete design (one repeat) of a papermakers' double layer type fabric D in which 16 respectively of warps, upper surface wefts and lower surface wefts are used. FIGS. 27A and 27B are plan views showing respectively the running side surface and a warp cross sectional drawing for the first two wefts 1' and 2' of the fabric shown in FIG. 27. In these Figures, a lower surface polyester weft 1' is interlaced twice in one repeat with warps 7, 8 and warps 15, 16 respectively to form knuckles (OO) Between "OO" and "OO" and between "OO" in this repeat and "OO" formed on the same weft in the right-hand or left-hand neighboring repeat (not shown), there are formed crimps which cross 6 warps, respectively. The crimp is a short one which is the same as the conventional crimp. On the other hand, a lower surface polyamide weft 2' is interlaced once in one repeat with warps 10 and 11 to form a knuckle (OO). Between "OO" in this repeat and "OO" formed on the same weft in the right-hand or left-hand neighboring repeat (not shown), there is formed a crimp which crosses 14 warps. This crimp is longer than that of the conventional weft in FIG. 59 (Comparative Example 1). With regard to the other lower surface wefts, as in the above-mentioned wefts, polyester wefts form short crimps, while polyamide wefts form long crimps.

In FIGS. 28–32 (Examples 25–29), as in said Example 24, lower surface polyester wefts are each interlaced twice in one repeat with a pair of adjacent warps to form knuckles (OO) and form short crimps. On the other hand, lower surface polyamide wefts are each interlaced once in one repeat with a pair of adjacent warps to form a knuckle and form long crimps. In FIGS. 28–32 (Examples 25–29), with regard to lower surface wefts, odd numbers with a dash indicate polyamide wefts while even numbers with a dash indicate polyester wefts. The lengths of crimps of the lower surface polyester and polyamide wefts in said Examples 25–29 correspond respectively to distances over which the crimps extend across the warps the numbers of which are indicated in the following Table 3.

TABLE 3

| | Length of crimp (Number of warps crossed by crimp) | |
|---|---|---|
| | Polyester weft | Polyamide weft |
| Example 25 | 5 | 12 |
| Example 26 | 7 | 16 |
| Example 27 | 8 | 18 |
| Example 28 | 9 | 20 |
| Example 29 | 10 | 22 |

It is apparent from FIGS. 27–32 that in Examples 24–29, every other lower surface weft forms long crimps, and the long crimps are identical in length with one another.

In the fabric D of this invention, as in the fabric C, lower surface polyester wefts and lower surface polyamide wefts are differentiated in length of crimp from each other thereby to permit the use of long crimp-forming polyamide wefts having a larger diameter than those which have hitherto been used, whereby the to-be-worn volume of the lower surface wefts can be enlarged and the wear resistance of the fabric can be improved.

Figure 38:
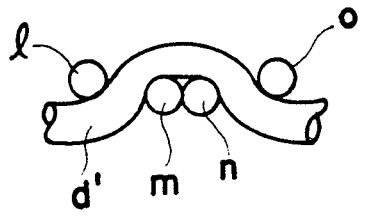
FIG. 38 is a schematic cross-sectional view showing a knuckle of a fabric D of this invention.

FIG. 38 is a schematic cross-sectional view of a knuckle of the fabric D. In the Figure, d' indicates a lower surface weft, and l-o indicate warps of the fabric. In FIG. 38, a weft d' is pushed upward between the warps l and o with a high strength by the warps m and n and is interlaced therewith, whereby the crimpiness of both the lower surface polymer wefts of the fabric D becomes more satisfactory, the texture of the fabric is stabilized, larger (in diameter) lower surface wefts can be used and, therefore, the fabric is not only improved in rigidity but also remarkably improved in wear resistance.

Further, in the fabric D, as explained with regard to FIGS. 33–37 (Examples 30–34), wefts having crimps of different length may not be alternately arranged so that they are situated adjacent to one another. In addition, long crimp-forming wefts and short crimp-forming wefts may not be arranged in equal number. It is preferable that the number of long crimp-forming lower surface polyamide wefts and the number of short crimp-forming lower surface polyester wefts be arranged in a ratio of from 3:1 to 1:3.

Figure 33:
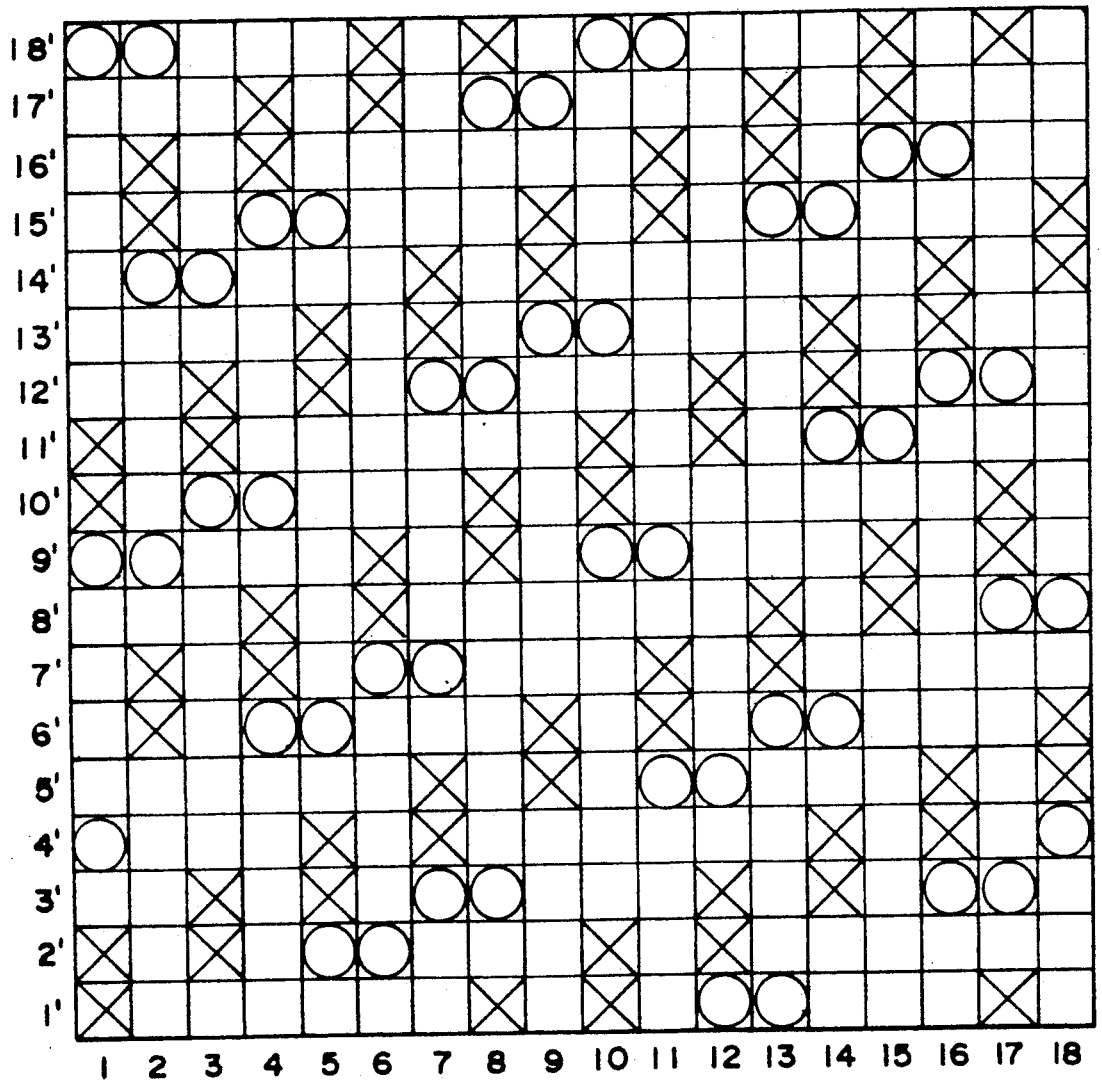

FIG. 33 (Example 30) shows one repeat of a papermakers' double layer type fabric D (18-shaft) wherein as the lower surface wefts, two long crimp-forming polyamide wefts and one short crimp-forming polyester weft are alternately arranged and mixedly woven in a ratio (in number) of 2:1. In FIG. 33, the lower surface polyamide wefts are designated at 1', 2', 4', 5', 7', 8', 10', 11', 13', 14', 16' and 17', and the other wefts are polyester wefts.

Figure 34:
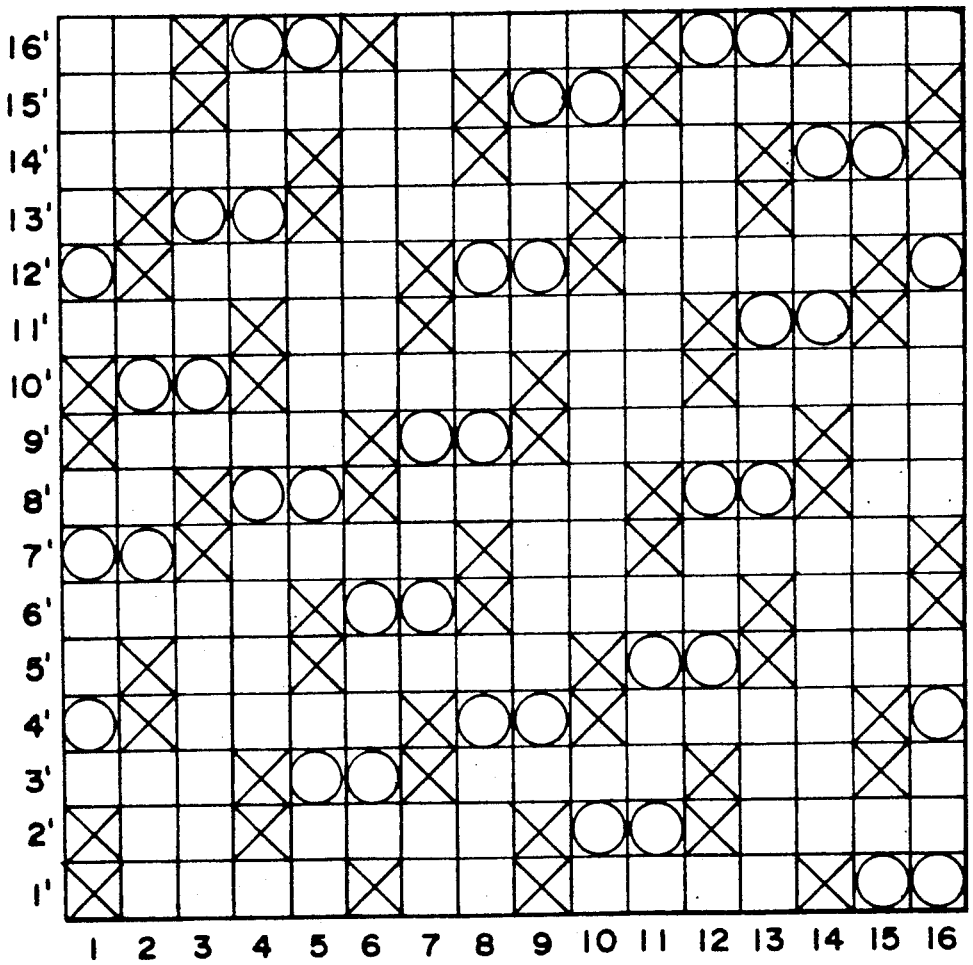

FIG. 34 (Example 31) shows one repeat of a papermakers' double layer type fabric D (16-shaft) wherein as the lower surface wefts, 3 long crimp-forming polyamide wefts and one short crimp-forming polyester wefts are alternately arranged and mixedly mixed in a ratio (in number) of 3:1. In FIG. 34, the lower surface polyamide wefts are designated at 1', 2', 3', 5', 6', 7', 9', 10', 11', 13', 14' and 15', and the other wefts are polyester wefts.

Figure 35:
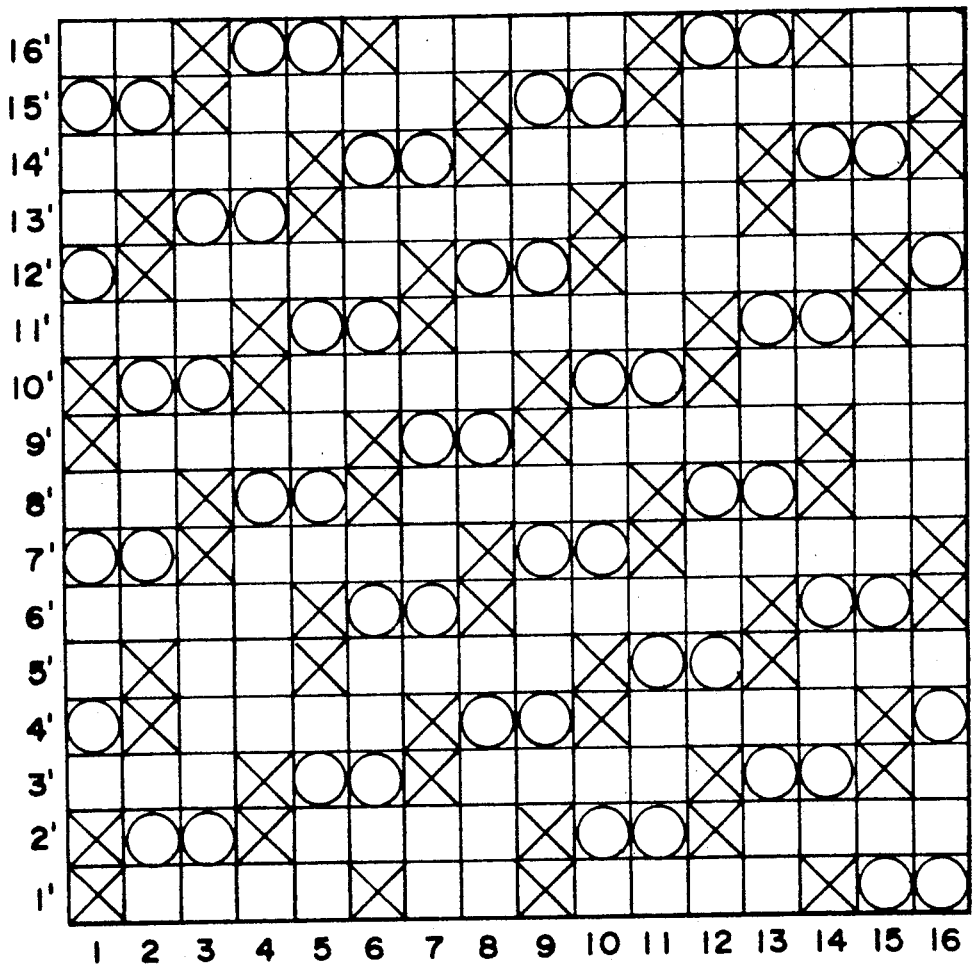

FIG. 35 (Example 32) shows one repeat of a papermakers' double layer type fabric D (16-shaft) in which as the lower surface wefts, one long crimp-forming polyamide weft and 3 short crimp-forming polyester wefts are alternately arranged and mixedly woven in a ratio (in number) of 1:3. In FIG. 35, the lower surface polyamide wefts are designated at 1', 5', 9', and 13', and the other wefts are polyester wefts.

Figure 36:
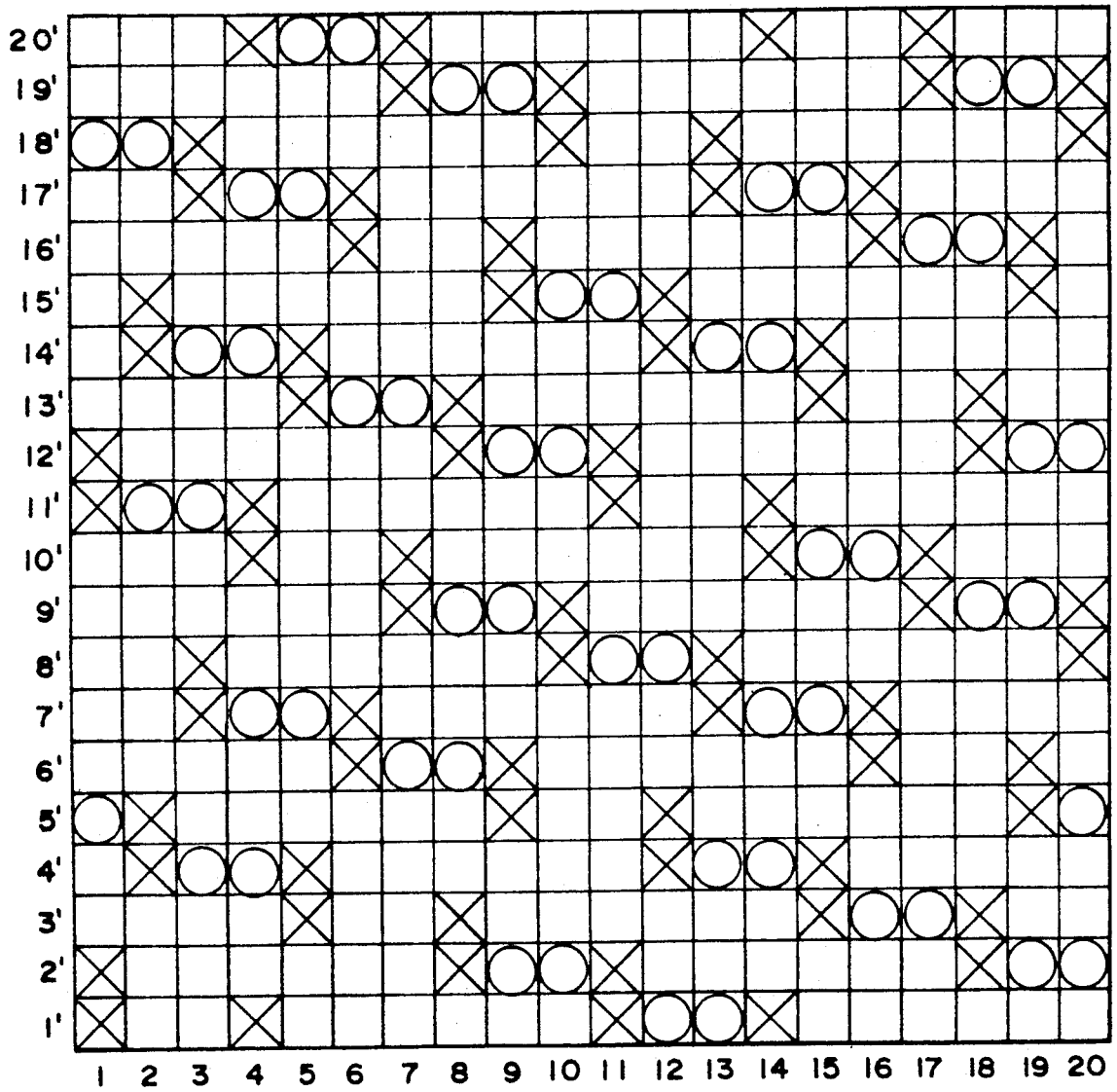

FIG. 36 (Example 33) shows one repeat of a papermakers' double layer type fabric D (20-shaft) wherein long crimp-forming lower surface polyamide wefts and short crimp-forming lower surface polyester wefts are mixedly woven in a ratio (in number) of 3:2. In FIG. 36, the lower surface polyamide wefts are designated at 1', 3', 5', 6', 8', 10', 11', 13', 15', 16', 18' and 20', and the other wefts are polyester wefts.

Figure 37:
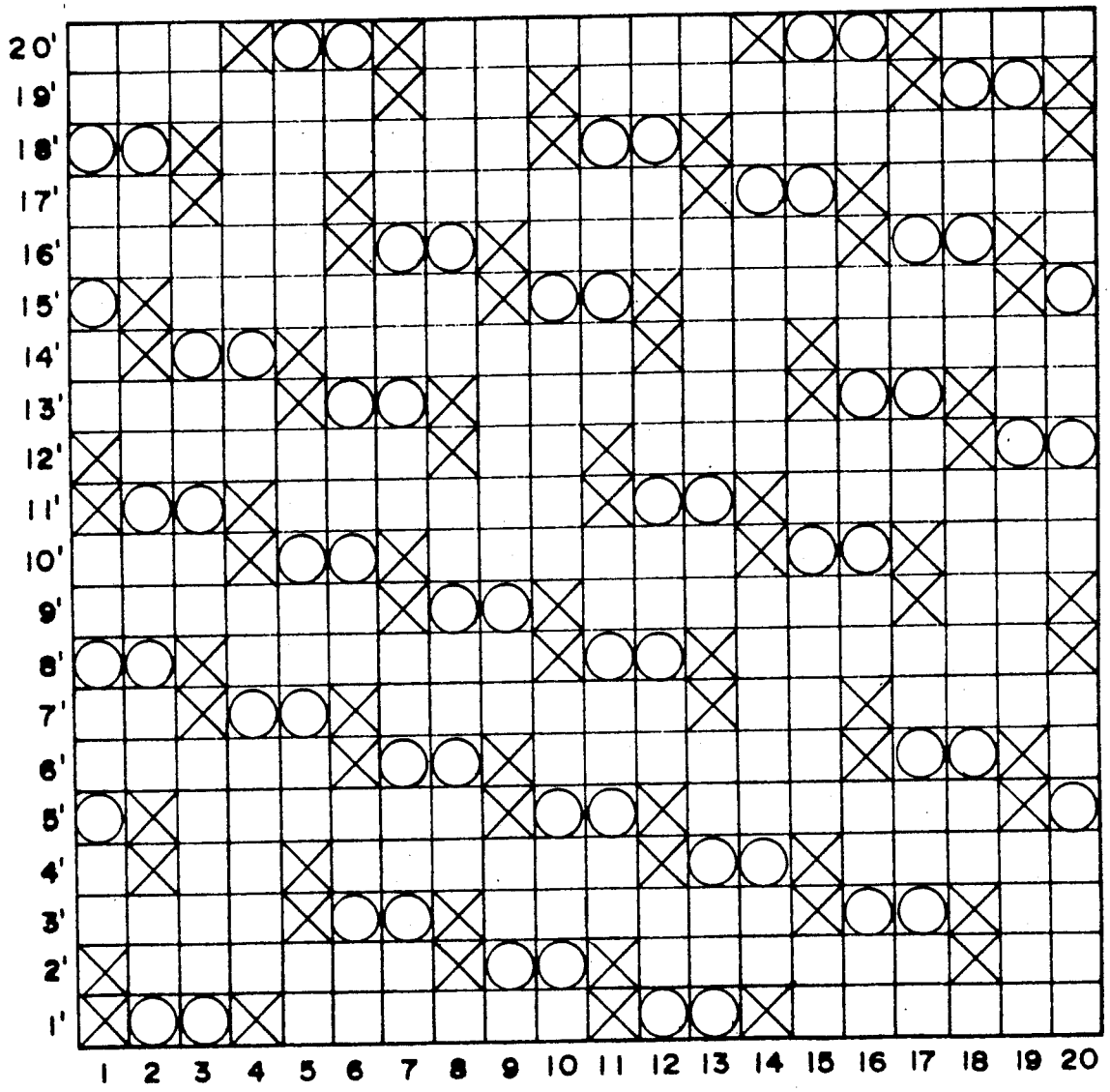

FIG. 37 (Example 34) shows one repeat of a papermakers' double layer type fabric D (20-shaft) wherein long crimp-forming lower surface polyamide wefts and short crimp-forming lower surface polyester wefts are mixedly woven in a ratio (in number) of 2:3. In this Figure, the lower surface polyamide wefts are designated at 2', 4', 7', 9', 12', 14', 17' and 19', and the other wefts are polyester wefts.

In FIGS. 33–37 (Examples 30–34), as in said Examples 24–29, the lower surface polyester wefts are each interlaced twice in one repeat with a pair of adjacent warps to form knuckles and form short crimps, while the lower surface polyamide wefts are each interlaced once in one repeat with a pair of adjacent warps to form a knuckle and form long crimps. The lengths of crimps of the lower surface polyester wefts and polyamide wefts in said Examples 30–34 correspond respectively to distances over which the crimps extend across the warps whose numbers are indicated in the following Table 4.

TABLE 4

| | Length of crimp (Number of warps crossed by crimp) | |
|---|---|---|
| | Polyester weft | Polyamide weft |
| Example 30 | 7 | 16 |
| Example 31 | 6 | 14 |
| Example 32 | 6 | 14 |
| Example 33 | 8 | 18 |
| Example 34 | 8 | 18 |

Papermakers' double layer type fabrics of FIGS. 33–37 (Examples 30–34) can also be provided with a predetermined wear resistance.

Although not shown in Figures, there can also be obtained a predetermined wear resistance in a papermakers' double layer type fabric D (18-shaft) wherein one long crimp-forming lower surface polyamide weft and two short crimp-forming lower surface polyester wefts are alternately arranged and mixedly woven in a ratio (in number) of 1:2.

In this manner, in the fabric D of this invention, the effective to-be-worn volume of lower surface (running side surface) wefts could be further enlarged as compared with that in conventional fabrics, and the wear resistance could further remarkably be improved. This will, as in Example 1, be substantiated by the following comparative tests.

The papermakers' fabric of FIG. 27 (Example 24) which is considered typical of the fabrics D, and the conventional papermakers' fabric of FIG. 59 (Comparative Example 1), are tested to compare the wear resistance between said two fabrics.

In FIG. 27 which is one repeat of the fabric D, long crimp-forming lower surface wefts and short crimp-forming lower surface wefts are alternately arranged. The short crimp-forming lower surface wefts form crimps whose length is the same as that of crimps formed by the lower surface wefts in FIG. 59. Thus, each of the former wefts is considered to form two crimps in total in one repeat. One of the crimps of these wefts extends across 6 warps and, when thought likewise in case of Example 1, each of the short crimp-forming lower surface wefts in one repeat is considered to form 2 crimps whose total length is 12 ($6\times2$) times the diameter of the warps. On the other hand, the long crimp-forming lower surface wefts adjacent to the short crimp-forming lower surface wefts forms longer crimps than the lower surface wefts in FIG. 59, and, thus, each of the former wefts in one repeat is considered to form one crimp in total. This one crimp extends across 14 warps and, when thought likewise in case of Example 1, the long crimp-forming lower surface wefts in one repeat are considered to each form a crimp whose length is 14 ($14\times1$) times the diameter of the warp.

In the fabric D, since the lower surface polyamide wefts form long crimps and, further, the lower surface polymeric wefts are each interlaced with a pair of two adjacent warps, whereby crimpiness becomes remarkably satisfactory and polyamide wefts having a larger diameter can be used.

Accordingly, in one repeat of FIG. 27, the volume of crimps of the adjacent two lower surface wefts is:

$$12\times0.17\times(0.25/2)^2\pi+14\times0.17\times(0.30/2)^2\pi=0.2\text{-}68\ \text{mm}^3$$

assuming that the diameter of the polyester warps used is 0.17 mm, the diameter of the lower surface polyester wefts used is 0.25 mm and the diameter of the lower surface polyamide wefts used is 0.30 mm.

Thus, the to-be-worn volume of the fabric of FIG. 27 is larger than that of the fabric of FIG. 59 by 48.1% of the latter as indicated hereunder:

$$(0.268\div0.181-1)\times100=48.1(\%)$$

Even the above rough calculation indicates that the fabric D of this invention (Example 24) has a to-be-worn volume which is larger than that of the conventional fabric (Comparative Example 1) by about 50% of the latter.

In addition, the length of crimp of the lower surface polyamide weft of the fabric D in FIG. 27 was found to be 2.28 mm by actual measurement.

To further substantiate this, the results of comparative tests carried out under test conditions to be described later will be indicated in the following Table 9.

EXAMPLES 35-46

FIGS. 39-50 are each a complete design (one repeat) of papermakers' double layer type fabrics E (Examples 35-46). The numbers of warps, upper surface wefts and lower surface wefts used in one repeat are 16 respectively thereof (16-shaft: Examples 35, 42 and 43), 14 respectively thereof (14-shaft: Example 36), 18 respectively thereof (18-shaft: Examples 37 and 41), 20 respectively thereof (20-shaft: Examples 38, 44, 45 and 46), 22 respectively thereof (22-shaft: Example 39) and 24 respectively thereof (24-shaft: Example 40).

The numbers and symbols in FIGS. 39-42 and 44 (Examples 35-38 and 40) have the same meaning as those used in Examples 1-6. Further, in FIGS. 43, 45-50 (Examples 39, 41-46), with respect to lower surface wefts, wefts designated at numbers with a dash are different in material from those in Examples 1-6, and the other numbers and symbols have the same meaning as those used in Examples 1-6. The materials of the lower surface wefts in FIGS. 43 and 45-50, will be concretely described when the Examples are detailed later.

A group of symbols O,X,O in series on polyamide wefts in FIGS. 39-50 indicates a knuckle formed by interlacing a lower surface weft in the running side surface with a pair of adjacent two warps between which one warp interlacing with upper surface (papermaking side surface) weft is sandwiched in.

Examples 35-46 will in turn be explained hereunder with reference to the accompanying drawings.

Figure 39A:
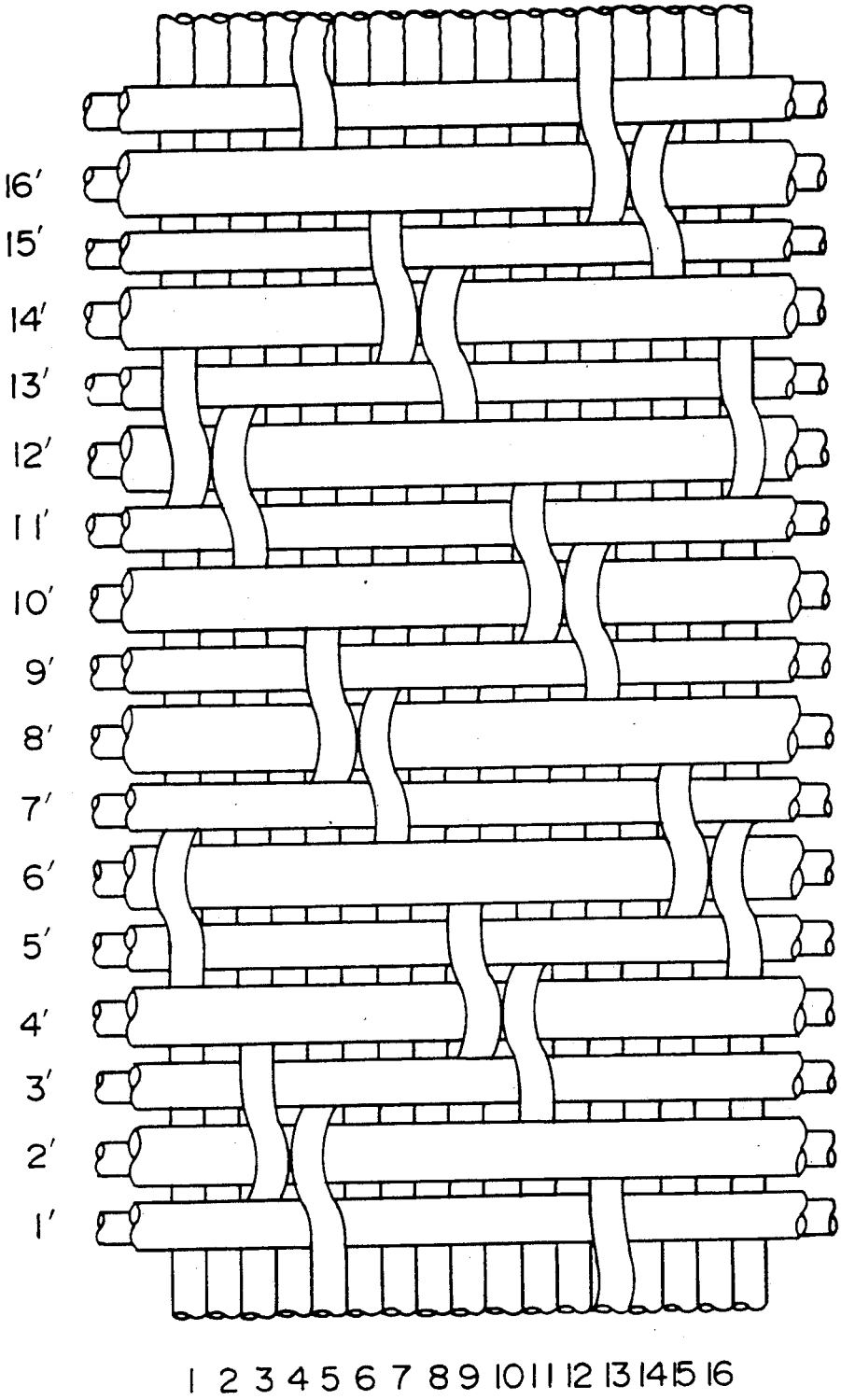
Figure 39B:
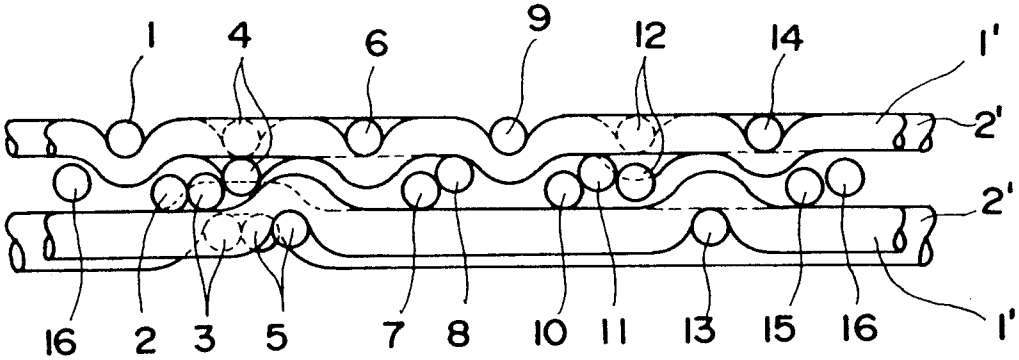

FIG. 39 (Example 35) is a complete design (one repeat) of a papermakers' double layer type fabric E wherein 16 respectively of warps, upper surface wefts and lower surface wefts are used. FIGS. 39A and 39B are plan views showing respectively the running side surface and a warp cross sectional drawing for the first two wefts 1' and 2' of the fabric shown in FIG. 39. In these Figures, a lower surface polyester weft 1' is interlaced twice in one repeat with warps 5 and 13 to form knuckles. Between these knuckles and between one of these knuckles in this repeat and a adjacent knuckle formed on the same weft in the right-hand or left-hand neighboring repeat (not shown), there are formed crimps which extend across 7 warps respectively and are the same short crimp as conventional ones. On the other hand, a lower surface polyamide weft 2' is interlaced once in one repeat with a pair of adjacent two warps 3 and 5 between which a warp 4 interlacing with an upper surface weft 2' is sandwiched in, to form a knuckle. Between this knuckle and a knuckle which is formed on the same weft in the right-hand or left-hand neighboring repeat (not shown), there is formed a crimp which crosses 13 warps. This crimp is longer than that of the conventional weft in FIG. 59 (Comparative Example 1). The above warps 3 and 5 interlace respectively with lower surface polyester wefts 3' and 1' when interlacing with the lower surface polyamide weft 2'. Warps 2, 4 and 6 adjacent to the warp 3 or 5, do not interlace with none of both the lower surface wefts at all. With regard to other lower surface wefts, as in the above wefts, the polyester wefts form short crimps while the polyamide wefts form long crimps In FIG. 39, the warp 4 is sandwiched in between the warps 3 and 5 which interlace with the lower surface polyamide weft 2', the warp 4 interlaces with an upper surface (papermaking side surface) weft 2' at the knuckle where the warps 3 and 5 interlace with the lower surface weft 2', and the warp 4 extends upward through between the warps 3 and 5 to the papermaking side surface, whereby the warps 3 and 5 are enabled to approach each other and they strongly bend in a pair the lower surface weft 2' and interlace therewith to remarkably improve crimpiness. At the knuckle the warp 4 extends through between the warps 3 and 5 whereupon the warps 3 and 5 approach each other to decrease planar drainage spaces, but three-dimensional drainage spaces are formed due to the presence of the warp 4 at the knuckle thus preventing the uneven distribution of drainage spaces.

Figure 43:
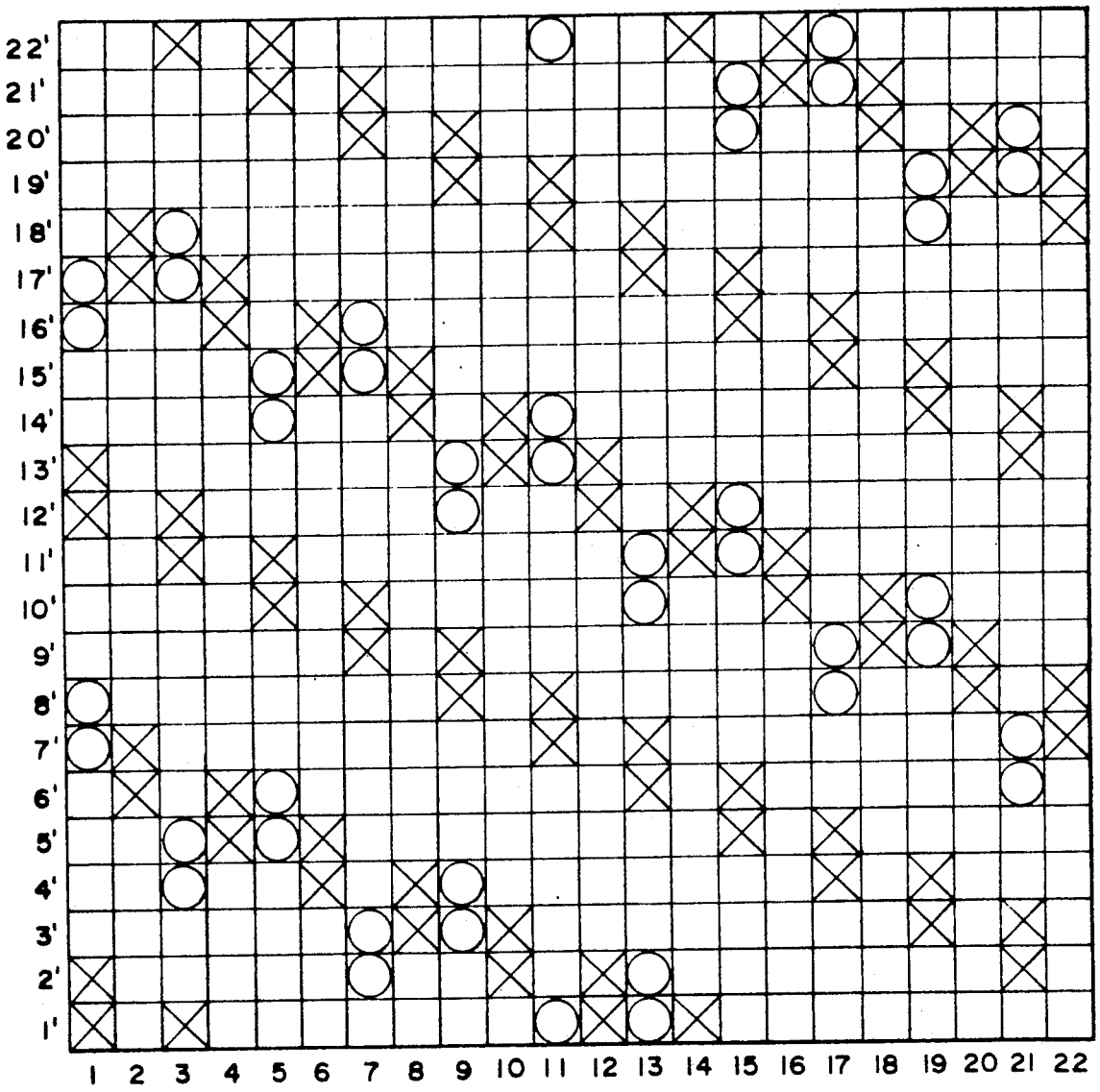
Figure 44:
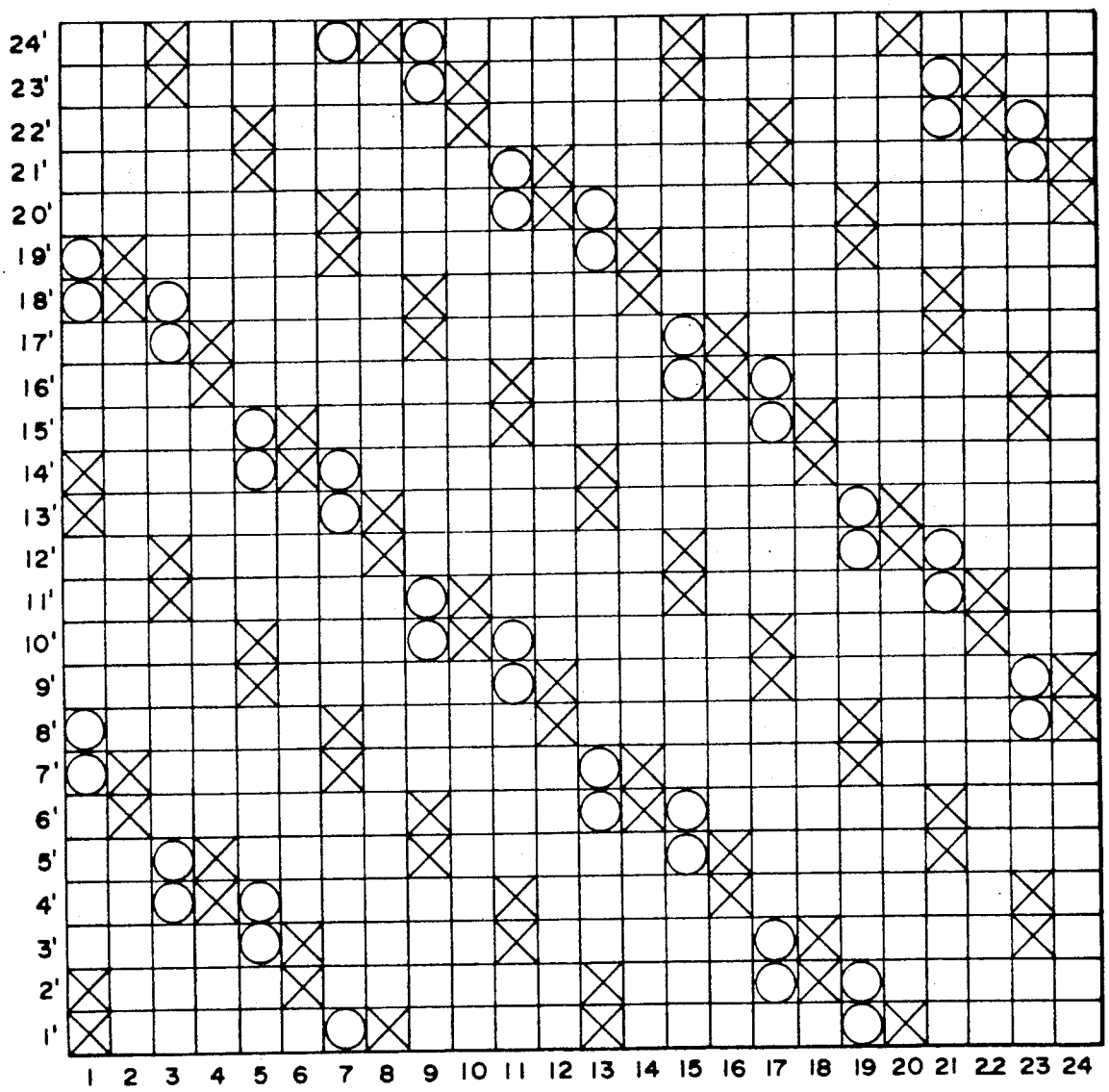

With regard to FIGS. 40-44 (Examples 36-40), as in Example 35, lower surface polyester wefts are each interlaced twice in one repeat with a warp to form knuckles and form short crimps, while lower surface polyamide wefts are each interlaced once in one repeat with a pair of adjacent warps between which one warp is sandwiched in, to form a knuckle and form long crimps. In FIG. 43 (Example 39), with regard to the lower surface wefts, odd numbers with a dash indicate polyamide wefts and the even numbers with a dash indicate polyester wefts. The lengths of crimps of the lower surface polyester and polyamide wefts in Examples 36-40 correspond respectively to distances over which the crimps cross the warps whose numbers are indicated in the following Table 5.

TABLE 5

| | Length of crimp (Number of warps crossed by crimp) | |
|---|---|---|
| | Polyester weft | Polyamide weft |
| Example 36 | 5 or 7 | 11 |
| Example 37 | 5 or 11 | 15 |
| Example 38 | 3 or 15 | 17 |
| Example 39 | 5 or 15 | 19 |
| Example 40 | 11 | 21 |

In FIGS. 40-44 (Examples 36-40), as in Example 35, lower surface polyamide wefts are each strongly bent and interlaced with a pair of adjacent two warps between which a warp interlacing a upper surface weft is sandwiched in, thereby to remarkably improve crimpiness and, further, the warp extending upward to the papermaking side surface is present at the knuckle where the two warps interlacing with said lower surface polyamide weft approach each other whereby three-dimensional drainage spaces are formed and the uneven distribution of drainage spaces is prevented.

In the fabric E of this invention, lower surface polyester wefts and lower surface polyamide wefts are differentiated in length of crimp from each other so that the polyamide wefts form long crimps. Since crimpiness is remarkably satisfactory as mentioned above, lower surface polyamide wefts having a large diameter can be arranged and wear resistance of the fabric can thus be further improved.

As is apparent from FIGS. 39-44 (Examples 35-40), long crimp-forming lower surface wefts and short crimp-forming lower surface wefts are alternately arranged, and, further, the long crimps are identical in length from each other.

As explained in Examples 42–46 (FIGS. 45–50) wherein as the lower surface wefts, long crimp-forming wefts and short crimp-forming wefts are not alternately arranged, it is not always necessary in the fabric E of this invention that wefts whose crimps are different in length are alternately arranged so that they are situated adjacent to one another. It is neither always necessary that long crimp-forming wefts and short crimp-forming wefts are arranged in equal number. In addition, it is preferable that the number of long crimp-forming lower surface polyamide wefts arranged and that of short crimp-forming lower surface polyester wefts arranged be in a ratio of from 3:1 to 1:3.

Figure 45:
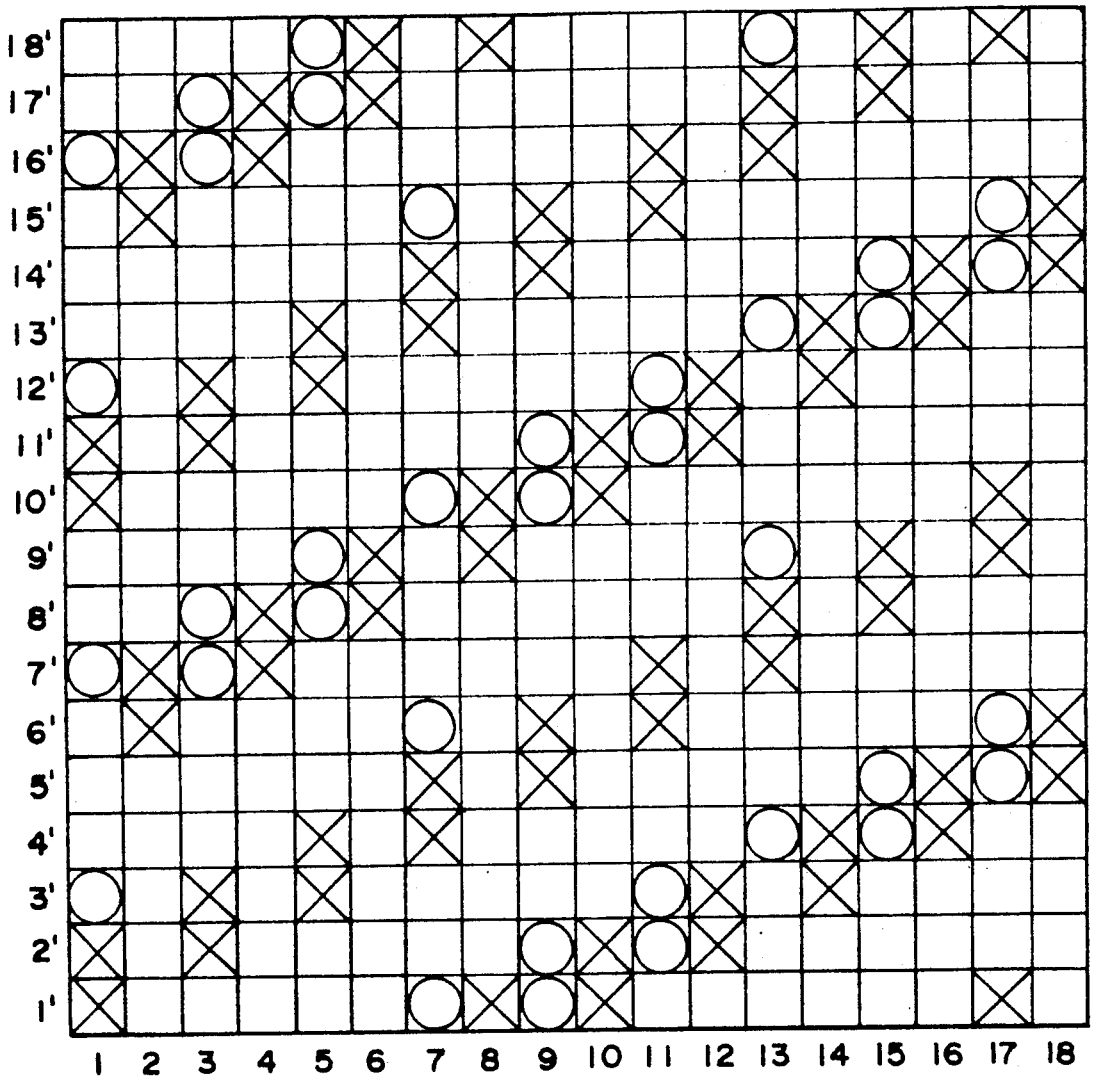

FIG. 45 (Example 41) shows one repeat of a papermakers' double layer type fabric E (18-shaft) wherein two long crimp-forming lower surface polyamide wefts and one short crimp-forming lower surface polyester weft are alternately arranged and mixedly woven in a ratio (in number) of 2:1. In FIG. 45, the lower surface polyamide wefts are designated at 1', 2', 4', 5', 7', 8', 10', 11', 13', 14', 16', and 17', and the other wefts are polyester wefts.

Figure 46:
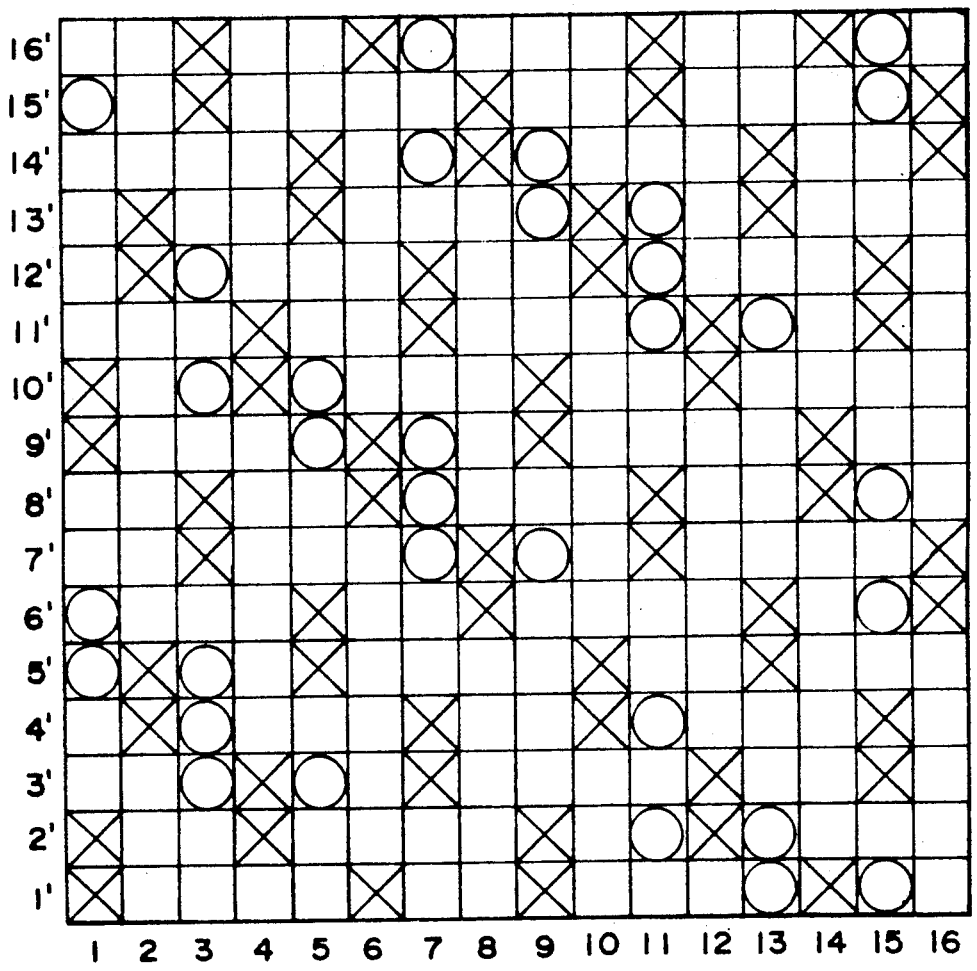

FIG. 46 (Example 42) shows one repeat of a papermakers' double layer type fabric E (16-shaft) wherein as the lower surface wefts, three long crimp-forming polyamide wefts and one short crimp-forming polyester weft are alternately arranged and mixedly woven in a ratio (in number) of 3:1. In FIG. 46, the lower surface polyamide wefts are designated at 1', 2', 3', 5', 6', 7', 9', 10', 11', 13', 14' and 15', and the other wefts are polyester wefts.

Figure 47:
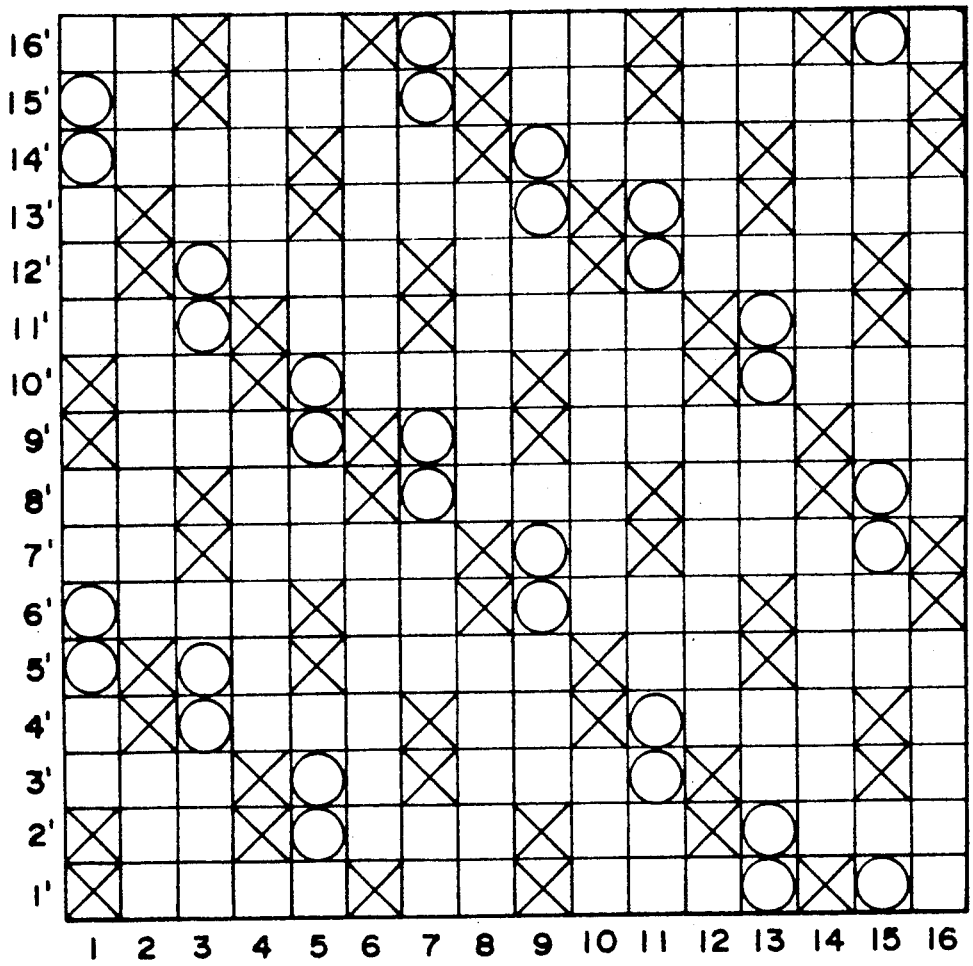

FIG. 47 (Example 43) shows one repeat of a papermakers' double layer type fabric E (16-shaft) wherein one long crimp-forming lower surface polyamide weft and three short crimp-forming lower surface polyester wefts are alternately arranged and mixedly woven in a ratio (in number) of 1:3. In FIG. 47, the lower surface polyamide wefts are designated at 1', 5', 9' and 13', and the other wefts are polyester wefts.

Figure 48:
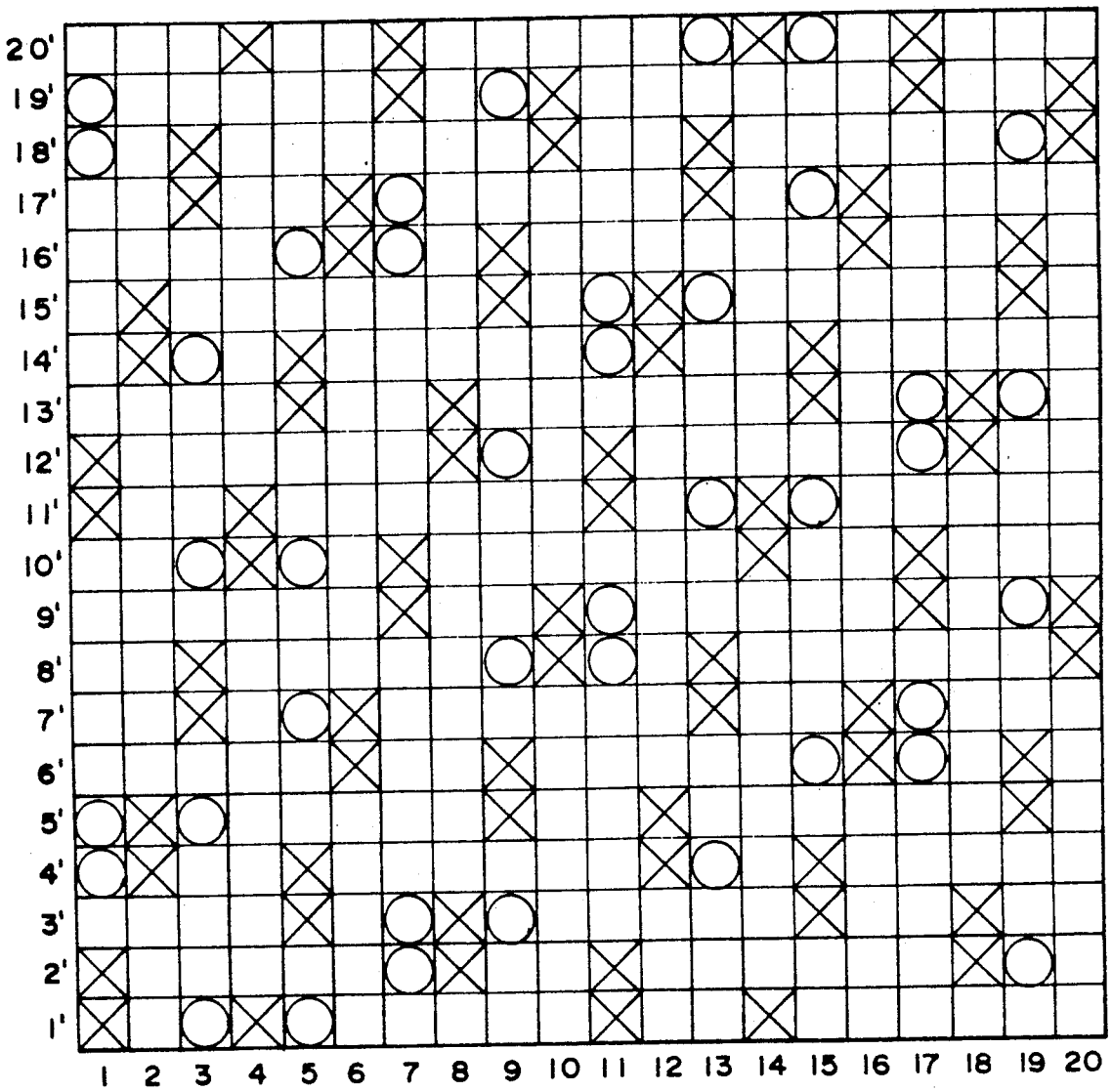

FIG. 48 (Example 44) shows one repeat of a papermakers' double layer type fabric E (20-shaft) wherein long crimp-forming lower surface polyamide wefts and short crimp-forming polyester wefts are mixedly woven in a ratio (in number) of 3:2. In FIG. 48, the lower surface polyamide wefts are designated at 1', 3', 5', 6', 8', 10', 11', 13', 15', 16', 18' and 20', and the other wefts are polyester wefts.

Figure 49:
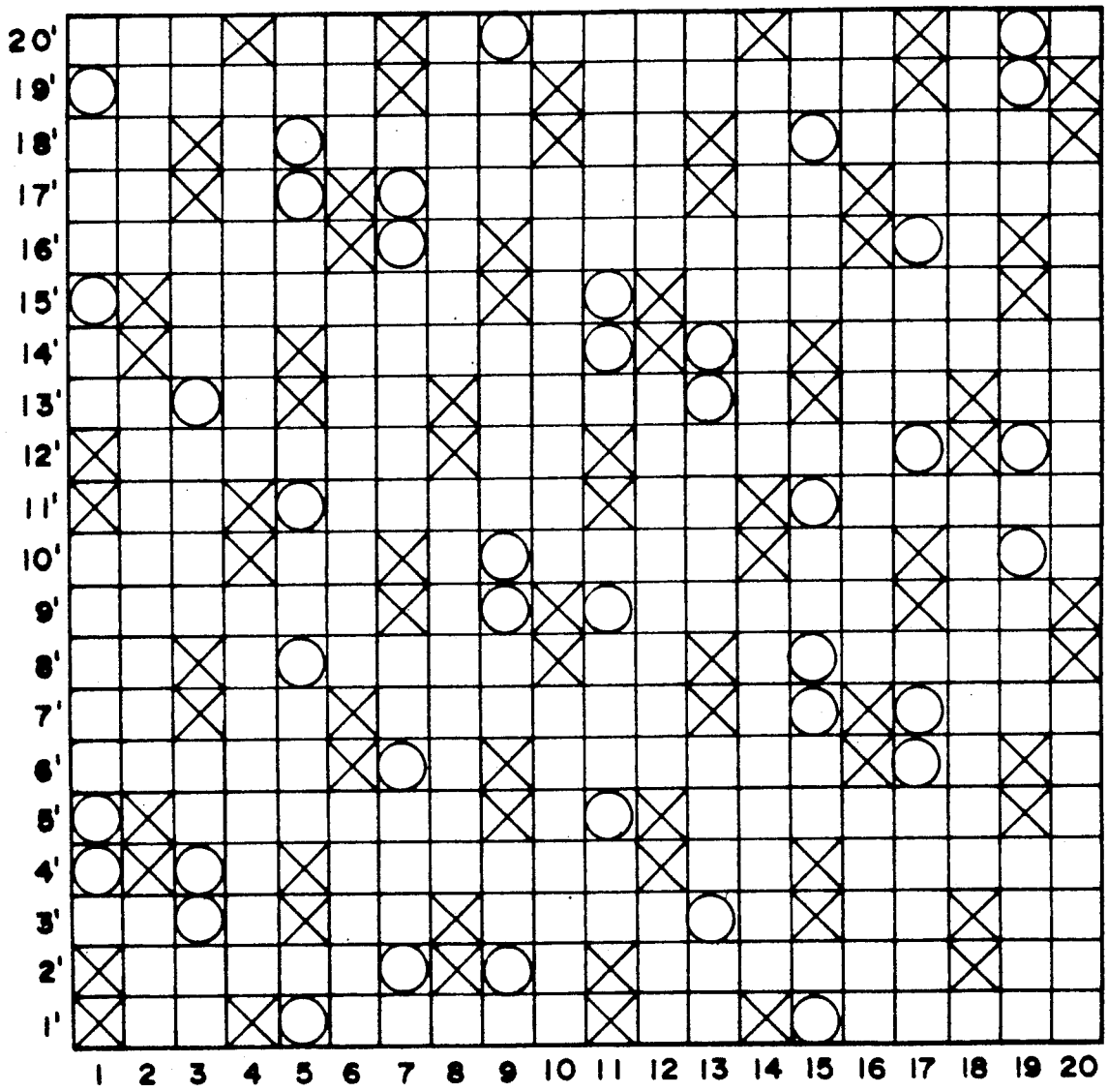

FIG. 49 (Example 45) shows one repeat of a papermakers' double layer type fabric E (20-shaft) wherein long crimp-forming lower surface polyamide wefts and short crimp-forming lower surface polyester wefts are mixedly woven in a ratio (in number) of 2:3. In FIG. 49, the lower surface polyamide wefts are designated at 2', 4', 7', 9', 12', 14', 17' and 19', and the other wefts are polyester wefts.

Figure 50:
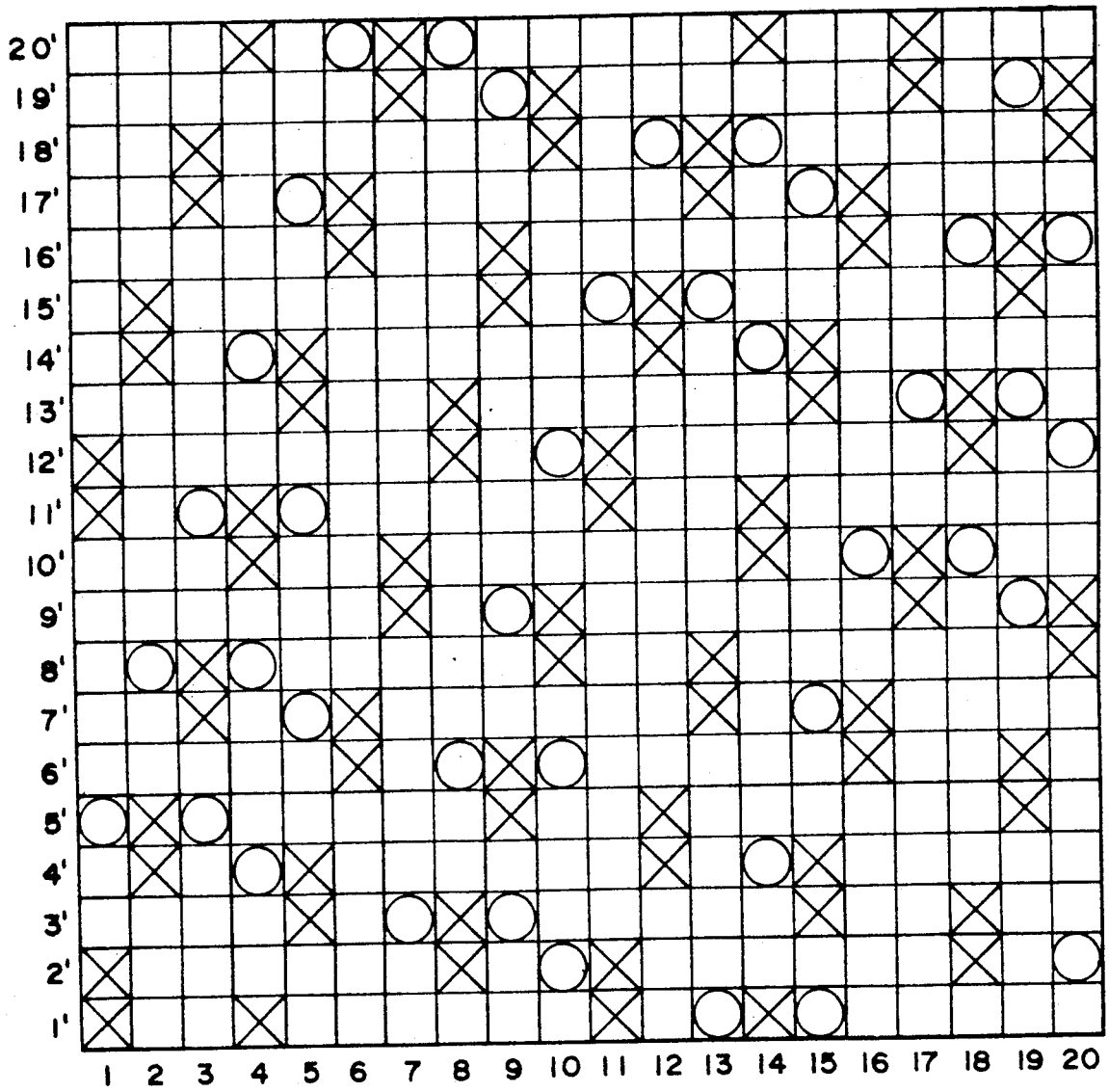

FIG. 50 (Example 46) shows one repeat of a papermakers' double layer type fabric E (20-shaft) wherein long crimp-forming lower surface polyamide wefts and short crimp-forming lower surface polyester wefts are mixedly woven in a ratio (in number) of 3:2. The said polyamide wefts are designated at 1', 3', 5', 6', 8', 10', 11', 13', 15', 16', 18' and 20', and the other wefts are polyester wefts.

In FIGS. 45–50 (Examples 41–46), as in the above Examples 35–40, lower surface polyester wefts are each interlaced twice in one repeat with a warp to form knuckles and form short crimps, while lower surface polyamide wefts are each interlaced once in one repeat with a pair of adjacent warps between which a warp interlacing with a upper surface weft is sandwiched in, to form a knuckle and form long crimps. The lengths of crimps of the lower surface polyester and polyamide wefts in the above Examples 41–46 correspond respectively to distances over which the crimps extend across the warps whose numbers are indicated in the following Table 6.

TABLE 6

| | Length of crimp (Number of warps crossed by crimp) | |
|---|---|---|
| | Polyester weft | Polyamide weft |
| Example 41 | 7 or 9 | 15 |
| Example 42 | 7 | 13 |
| Example 43 | 7 | 13 |
| Example 44 | 7 or 11 | 17 |
| Example 45 | 9 | 17 |
| Example 46 | 9 | 17 |

In FIGS. 45–50 (Examples 41–46), as in the above Examples 35–40, lower surface polyamide wefts are each strongly bent and interlaced with a pair of adjacent warps between a warp interlacing with a upper surface weft at the knuckle where the pair of warps interlacing with the lower surface polyamide weft, is sandwiched in. Thus, crimpiness becomes remarkably satisfactory, and, further, three-dimensional drainage spaces are formed since a warp extends upward to the papermaking side surface (upper surface) at the knuckle where the pair of warps interlacing with said lower surface polyamide weft approach each other whereby the uneven distribution of drainage spaces is prevented.

In papermakers' double layer type fabrics in FIGS. 45–50 (Examples 41–46), a predetermined wear resistance is also obtained.

Although not shown in Figures, there may also be obtained a predetermined wear resistance in a papermakers' double layer type fabric E (18-shaft) wherein as the lower surface wefts, one long crimp-forming polyamide weft and two short crimp-forming polyester wefts are alternately arranged and mixedly woven in a ratio (in number) of 1:2.

In this manner, in the fabric E of this invention, the effective to-be-worn volume of the wefts in the running side surface (lower surface) can be remarkably enlarged thereby to remarkably improve the wear resistance of the fabric. This will be further substantiated by the following comparative tests.

The papermakers' fabric shown in FIG. 39 (Example 35) which is considered typical of the fabric E, and the conventional papermakers' fabric shown in FIG. 59 (Comparative Example 1), are tested to compare wear resistance between the two fabrics.

In one repeat of the fabric E in FIG. 39, long crimp-forming lower surface wefts and short crimp-forming lower surface wefts are alternately arranged. The short crimp-forming lower surface wefts form crimps having the same strength as those of the lower surface wefts in FIG. 59 and, thus, each of the wefts in one repeat is deemed to form two crimps in total. One of these two crimps crosses 7 warps, and, when thought likewise in Example 1, the short crimp-forming lower surface wefts in one repeat are deemed to each form two crimps whose total length is 14 ($7\times2$) times the diameter of the warp. On the other hand, the long crimp-forming lower surface wefts adjacent to the short crimp-forming lower surface wefts, form crimps whose length is longer than those of the lower surface wefts in FIG. 59, and each of the wefts in one repeat is deemed to form one crimp in total. The one crimp of this weft crosses 13 warps and when thought likewise in Example 1, the long crimp-forming lower surface wefts in one repeat are deemed to each form one crimp whose length is 13 (13×1) times the diameter of the warp.

In the fabric E of this invention, the lower surface polyamide wefts have longer crimps and, further, said polyamide wefts are each interlaced with a pair of adjacent warps between which a warp interlacing with a upper surface weft at the knuckle is sandwiched in. Therefore, crimpiness becomes remarkably satisfactory and polyamide wefts having a remarkably big diameter can be used.

Accordingly, in one repeat of FIG. 39, the to-be-worn volume of crimps of adjacent two lower surface wefts is:

$$14\times0.17\times(0.22/2)^2\pi+13\times0.17\times(0.30/2)^2\pi=0.2\text{-}47\ \text{mm}^3$$

assuming that the diameter of polyester warps used is 0.17 mm, the diameter of lower surface polyester wefts used is 0.22 mm and the diameter of lower surface polyamide wefts used is 0.30 mm.

The to-be-worn volume of the fabric in FIG. 39 is larger than that of the fabric in FIG. 59 by 36.5% of the latter as numerically indicated hereunder:

$$(0.247\div0.181-1)\times100=36.5(\%)$$

Even the above rough calculation indicates that the fabric E of this invention (the fabric of Example 35) has a to-be-worn volume which is about 37% larger than that of the conventional fabric of Comparative Example 1.

To further clarify this, the results of comparative tests carried out under test conditions to be described later are indicated in the following Table 9.

EXAMPLES 47–54

FIGS. 51–58 (Examples 47–54) each show a complete design (one repeat) of a papermakers' double layer type fabric F of this invention. In these Figures, the numbers of warps, upper surface wefts and lower surface wefts used in one repeat are 16 respectively thereof (16-shaft: Examples 47 and 54), 14 respectively thereof (14-shaft: Example 48), 18 respectively thereof (18-shaft: Examples 49 and 53), 20 respectively thereof (20-shaft: Example 50), 22 respectively thereof (22-shaft: Example 51) and 24 respectively thereof (24-shaft: Example 52).

Figure 57:
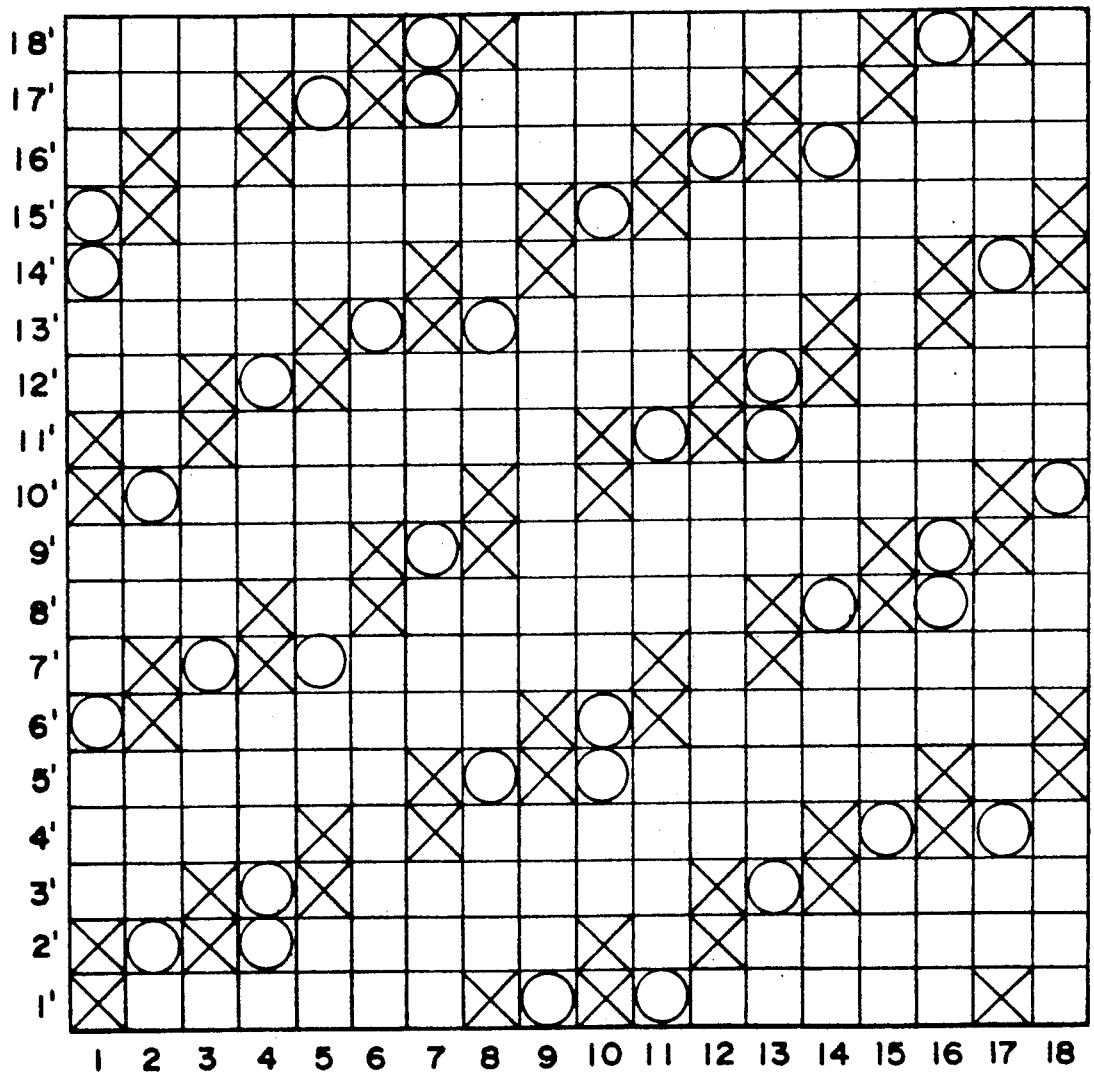
Figure 58:
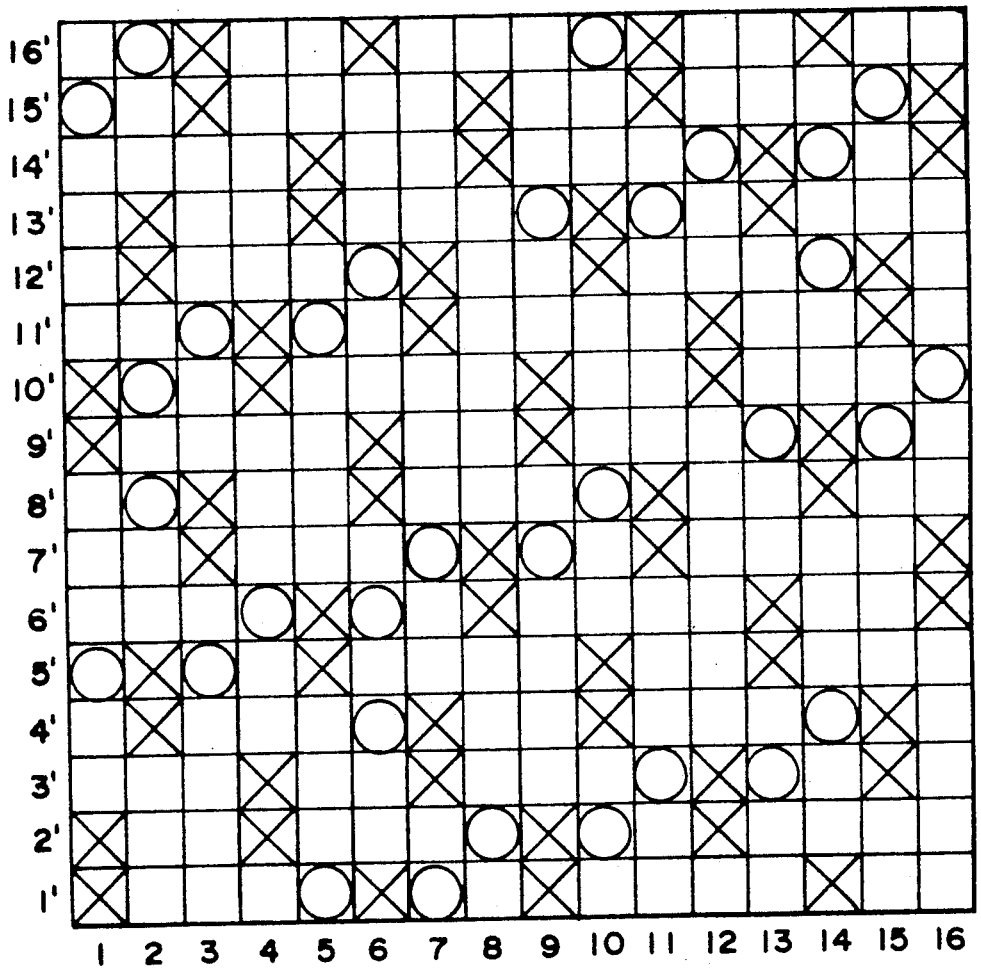

The numbers and symbols used in FIGS. 51–56 (Examples 47–52) have the same meaning as those used in Examples 1–6. In FIGS. 57 and 58 (Examples 53 and 54), with regard to lower surface wefts, wefts indicated by numbers with a prime are different in material from those used in Examples 1–6, and the other numbers and symbols have the same meaning as those used in Examples 1–6. With regard to the materials of lower surface wefts, they will be concretely indicated in the detailed explanation of Examples to be described later.

In the polyamide wefts in FIGS. 51–58, a group of symbols O,X,O in series indicates a knuckle formed by interlacing a lower surface weft in the running side surface with a pair of two adjacent warps between which a warp interlacing with an upper surface (papermaking side surface) weft at the knuckle is sandwiched in.

Examples 47–54 will in turn be explained by reference to the accompanying Figures.

Figure 51A:
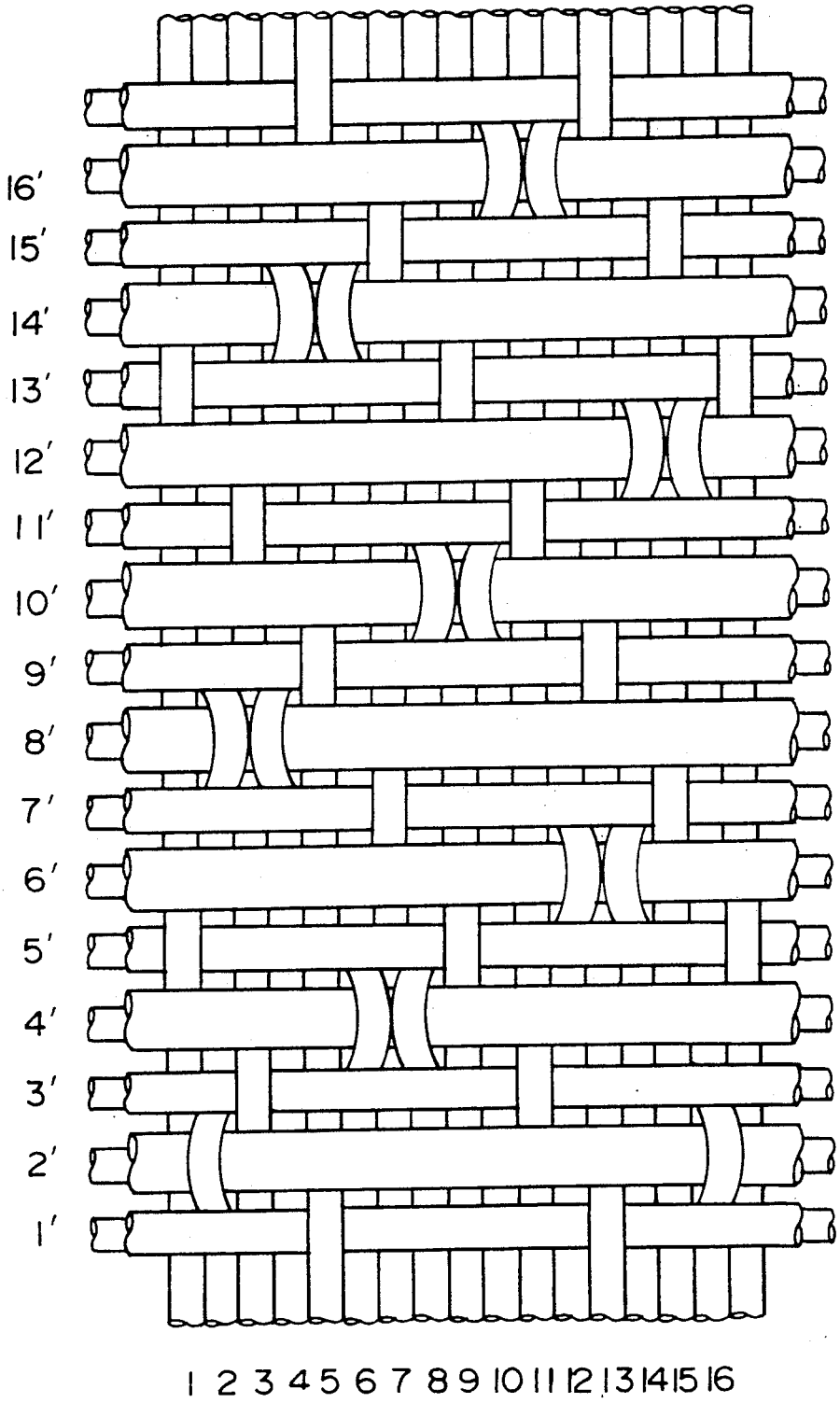
Figure 52:
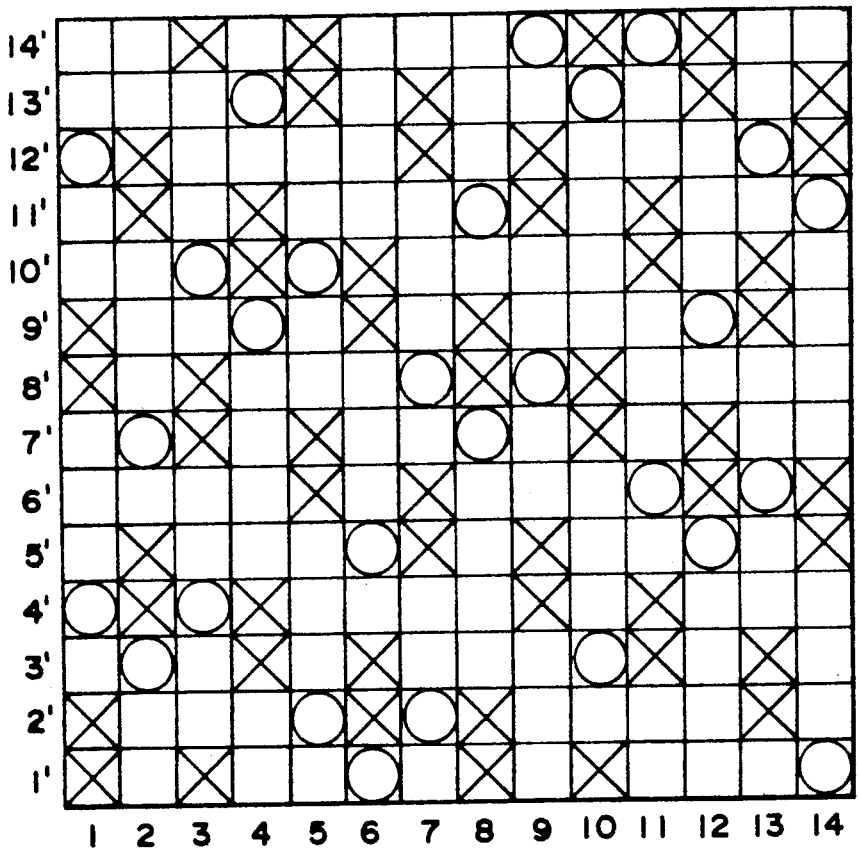
Figure 53:
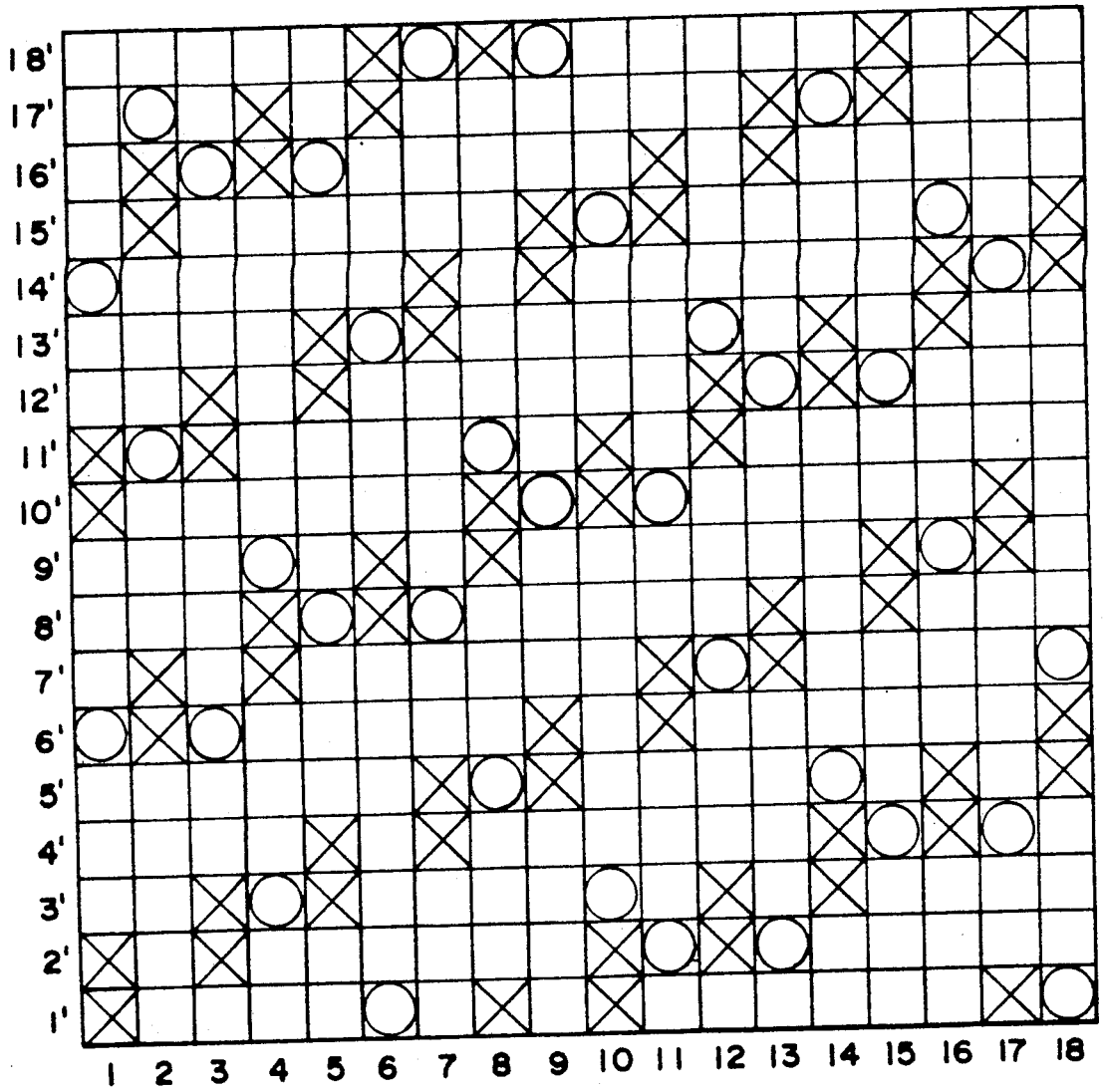
Figure 54:
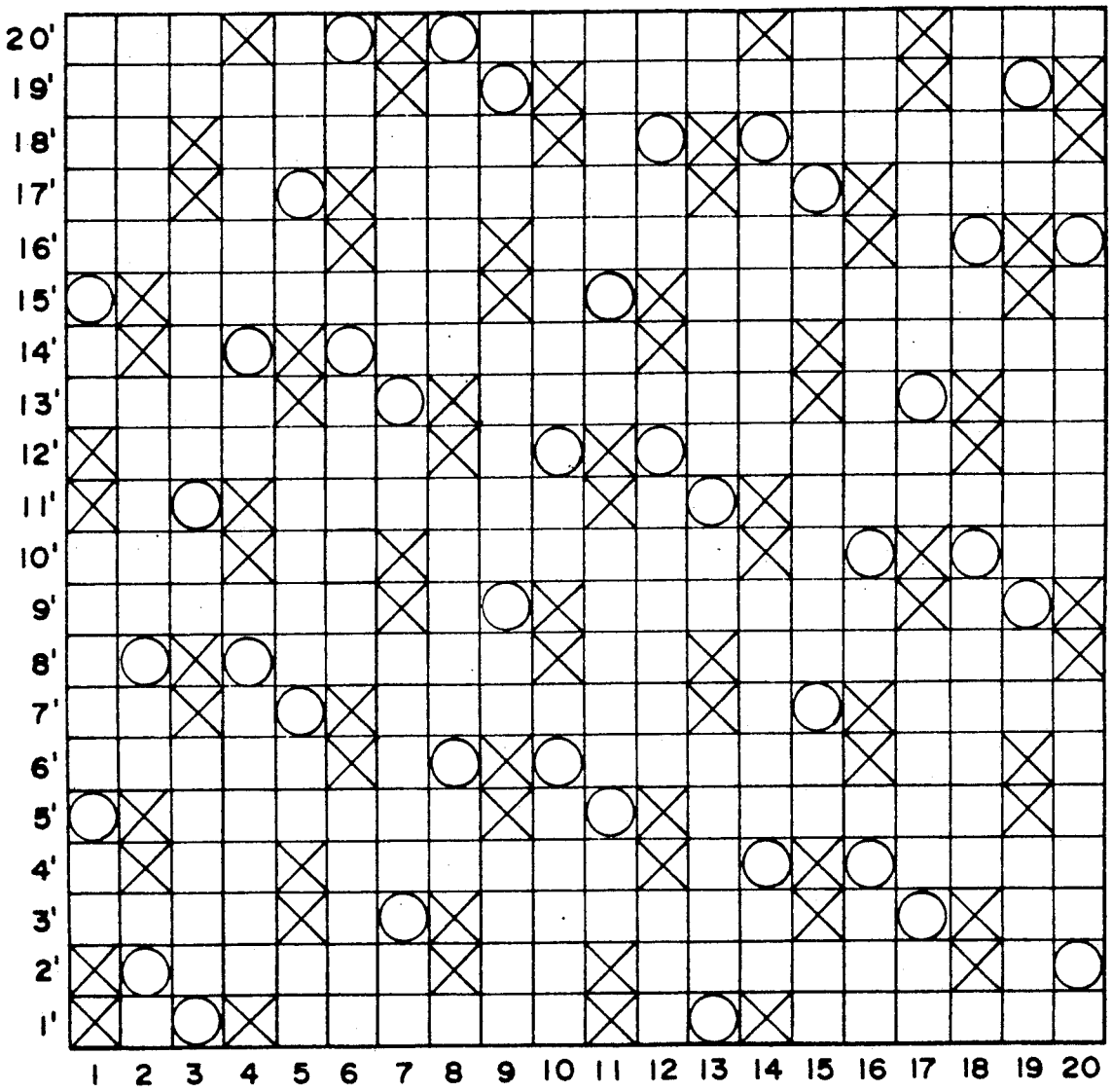
Figure 55:
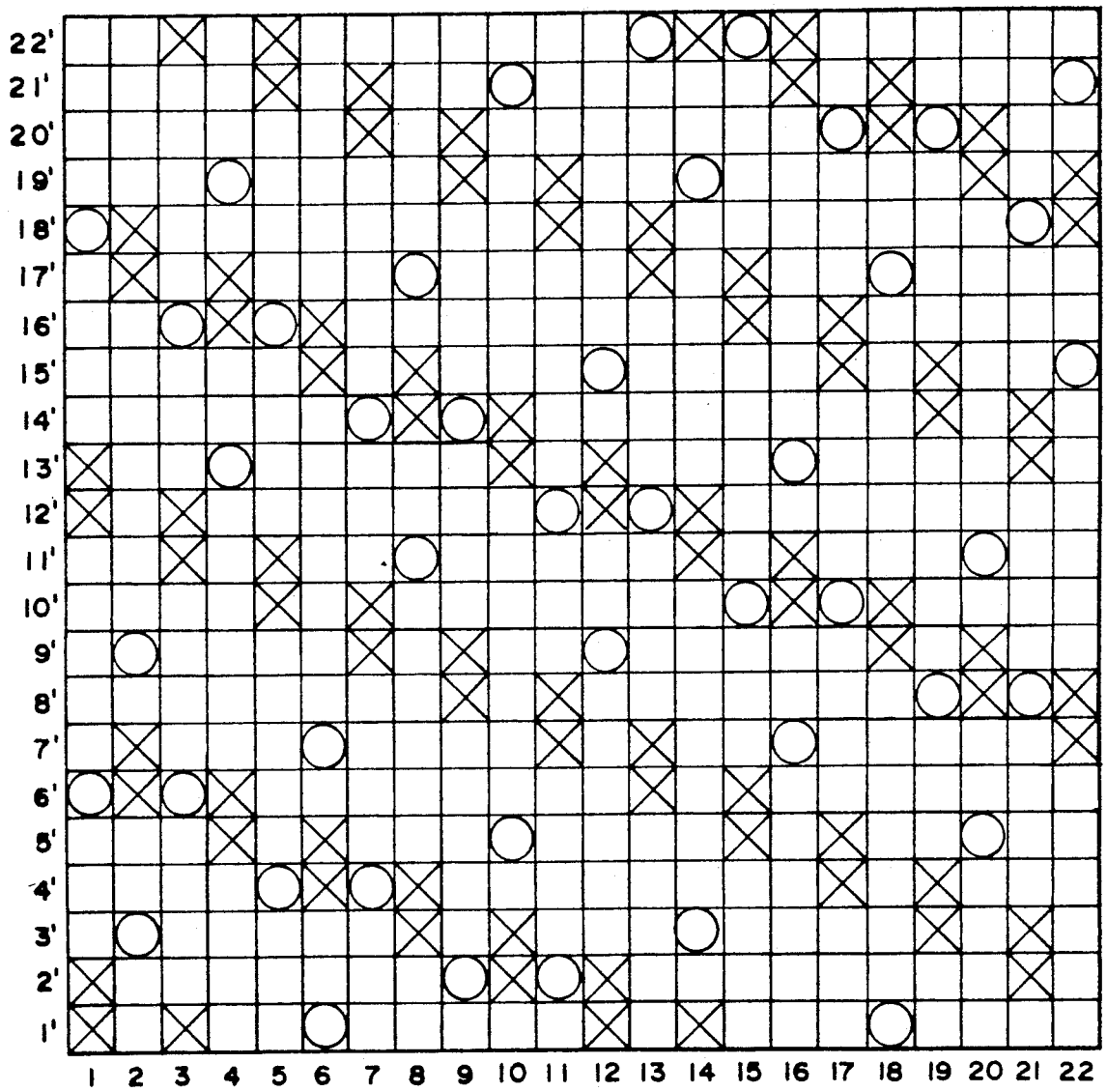
Figure 56:
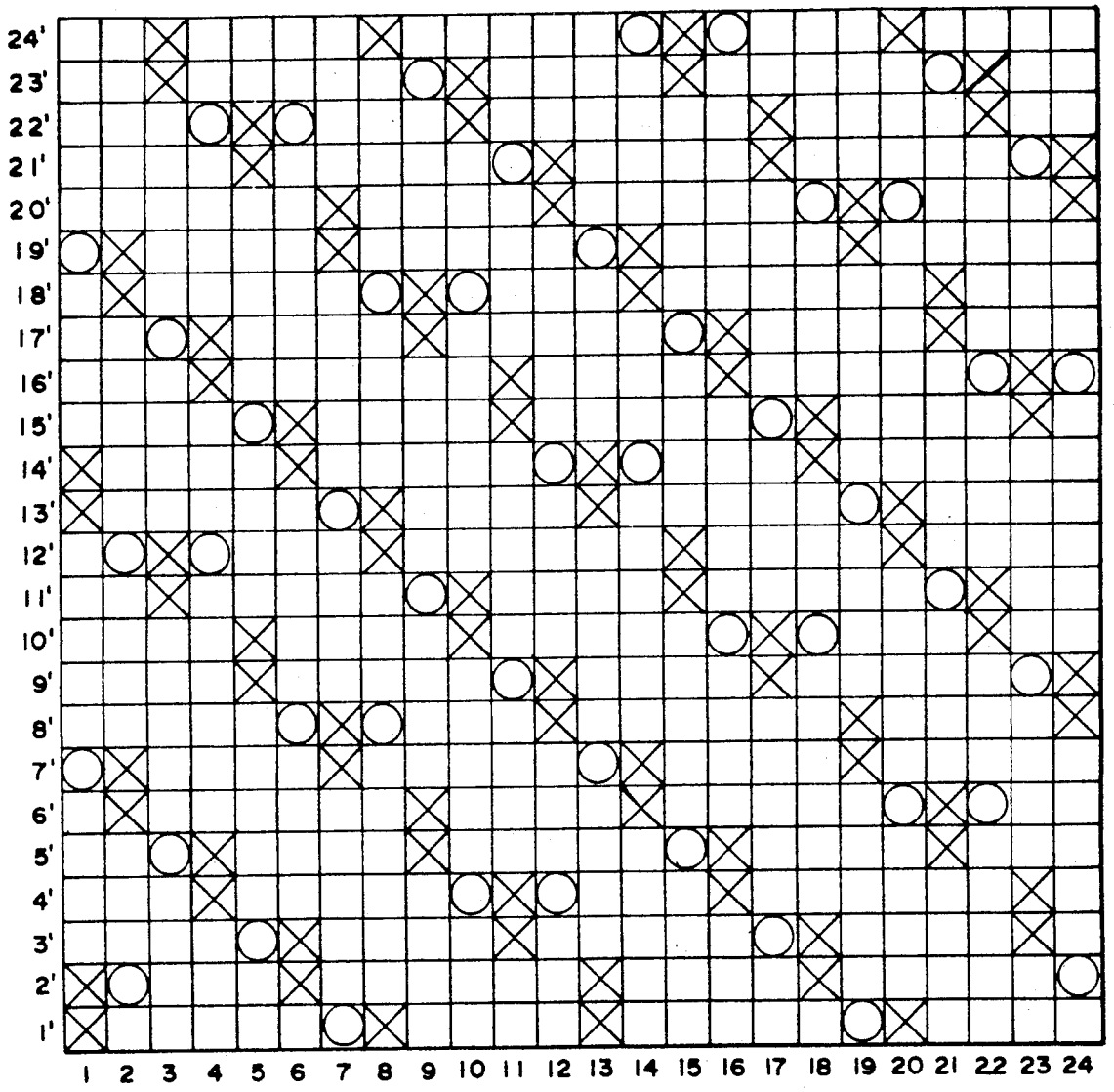

FIG. 51 (Example 47) shows one repeat of a papermakers' double layer type fabric F wherein 16 respectively of warps, upper surface wefts and lower surface wefts are used in the repeat. FIGS. 51A and 51B are plan views showing respectively the running side surface an a warp cross sectional drawing for the first two wefts 1' and 2' of the fabric shown in FIG. 51, respectively. In these Figures, a lower surface polyester weft 3' is interlaced twice in one repeat with warps 3 and 11 to form knuckles. Between these knuckles and between one of these and its adjacent knuckle formed on the same weft in the right-hand or left-hand neighboring repeat (not shown), there are formed crimps which cross 7 warps respectively and are as short as those of conventional papermakers' fabrics. On the other hand, a lower surface polyamide weft 4' is interlaced once in one repeat with a pair of adjacent warps 6 and 8 between which a warp 7 interlacing with an upper surface weft 4' is sandwiched in, thereby to form a knuckle. Between this knuckle and a knuckle formed on the same weft in the right-hand or left-hand neighboring repeat (not shown), there is formed a crimp which crosses 13 warps. This crimp is longer than that of the conventional weft in FIG. 59 (Comparative Example 1). With regard to the other lower surface wefts, likewise in the above wefts, polyester wefts form short crimps, while polyamide wefts form long crimps.

In FIG. 51, the warp 7 is sandwiched in between the warps 6 and 8 which interlace with the lower surface polyamide weft 4', to form a knuckle where the warp 7 interlaces with an upper surface (papermaking side surface) weft 4' and the warp 7 extends through between the warps 6 and 8 upward to the papermaking side surface, whereby the warps 6 and 8 are enabled to approach each other and they, in a pair, strongly bend and interlace with the lower surface weft 4' thus remarkably improving crimpiness. Since the warps 6 and 8 approach each other as mentioned above, planar drainage spaces decrease accordingly and three-dimensional drainage spaces are formed due to the presence of the warp 7 in the above-mentioned knuckle thus preventing the uneven distribution of drainage spaces.

Further, in FIG. 51, a lower surface polyester weft 3' is interlaced at two positions in one repeat with a warp 3 sandwiched in between warps 2 and 4 which interlace with a lower surface polyamide weft 8' and with a warp 11 sandwiched in between warps 10 and 12 which interlace a lower surface polyamide weft 16', to form knuckles. These knuckles and other knuckles where an adjacent lower surface polyamide weft 4' is interlaced, are situated in the staggered relation in the fabric. Thus, the uneven distribution of drainage spaces is further prevented and the generation of wire marking is fully prevented.

In FIGS. 52–56 (Examples 48–52), as in the above Example 47, lower surface polyester wefts are each interlaced twice in one repeat with a warp to form knuckles and form short crimp, while lower surface polyamide wefts are each interlaced once in one repeat with a pair of adjacent warps between which a warp interlacing with a upper surface weft is sandwiched in, to form a knuckle and form long crimps. The lengths of crimps of lower surface polyester wefts and lower surface polyamide wefts in Examples 48–52, correspond respectively to distances over which the crimps extend across the warps whose numbers are indicated in the following Table 7.

TABLE 7

| | Length of crimp (Number of warps crossed by crimp) | |
|---|---|---|
| | Polyester weft | Polyamide weft |
| Example 48 | 5 or 7 | 11 |
| Example 49 | 5 or 11 | 15 |
| Example 50 | 9 | 17 |
| Example 51 | 9 or 11 | 19 |
| Example 52 | 11 | 21 |

In FIGS. 52–56 (Examples 48–52), as in the above Example 47, a lower surface polyamide weft is strongly bent and interlaced with a pair of adjacent two warps between which a warp interlacing with a upper surface weft is sandwiched in, thereby to remarkably improve crimpiness, and since the warp extending through between the two warps is present at the knuckle where said two warps interlacing with the lower surface polyamide weft approach each other whereby three-dimensional drainage spaces are formed and the uneven distribution of drainage spaces is therefore prevented. Further, the lower surface polyester wefts are each interlaced twice (or at two positions) in one repeat with a weft sandwiched in between a pair of warps which interlace with a lower surface polyamide weft, thereby to form knuckles. These knuckles are situated in the staggered relation with those formed on adjacent lower surface polyamide wefts, whereby the uneven distribution of drainage spaces in the fabric is further prevented and the generation of wire marking is fully prevented.

In the fabric F, lower surface polyester wefts and lower surface polyamide wefts are differentiated in length of crimp from each other thereby to form long crimps on the polyamide wefts. Further, as mentioned above, crimpiness becomes remarkably satisfactory and, therefore, big (in diameter) lower surface polyamide wefts can be arranged, wear resistance of the fabric can be further improved and the uneven distribution of drainage spaces in the fabric is fully prevented.

In Examples 47–52, as is apparent from FIGS. 51–56, long crimp-forming lower surface wefts and short crimp-forming lower surface wefts are alternately arranged, and the long crimps are identical in length from one another.

In the fabric F of this invention, as explained in FIGS. 57 and 58 (Examples 53 and 54) in which long crimp-forming lower surface wefts and short crimp-forming lower surface wefts are not alternately arranged, such wefts which are different in length of crimp may not be alternately arranged so that they are situated adjacent to one another. Further, the long crimp-forming wefts and the short crimp-forming wefts may not be used in equal number. It is preferable that the number of long crimp-forming lower surface polyamide wefts used and that of short crimp-forming lower surface polyester wefts used be in a ratio of from 3:1 to 1:3.

FIG. 57 (Example 53) shows one repeat of a papermakers' double layer type fabric F (18-shaft) wherein as the low surface wefts, two long crimp-forming polyamide wefts and one short crimp-forming polyester weft are alternately arranged and mixedly woven in a ratio (in number) of 2:1. In FIG. 57, the lower surface polyamide wefts are designated at 1', 2', 4', 5', 7', 8', 10', 11', 13', 14', 16' and 17', and the other wefts are polyester wefts.

FIG. 58 (Example 54) shows one repeat of a papermakers' double layer type fabric F (16-shaft) wherein as the lower surface wefts, three long crimp-forming polyamide wefts and one short crimp-forming polyester wefts are alternately arranged and mixedly woven in a ratio (in number) of 3:1. In FIG. 58, the lower surface polyamide wefts are designated at 1', 2', 3', 5', 6', 7', 9', 10', 11', 13', 14' and 15', and the other wefts are polyester wefts.

In FIGS. 57 and 58 (Examples 53 and 54), as in the above Examples 47–52, lower surface polyester wefts are each interlaced twice in one repeat with a warp to form knuckles and form short crimps, while lower surface polyamide wefts are interlaced once in one repeat with a pair of adjacent warps between which a warp interlacing with a upper surface weft is sandwiched in, to form a knuckle and form long crimps. The lengths of crimps of the lower surface polyester and polyamide wefts in said Examples 53 and 54 correspond respectively to distances over which the crimps extend across the warps whose numbers are indicated in the following Table 8.

TABLE 8

| | Length of crimp (Number of warps crossed by crimp) | |
|---|---|---|
| | Polyester weft | Polyamide weft |
| Example 53 | 8 | 15 |
| Example 54 | 7 | 13 |

In FIGS. 57 and 58 (Examples 53 and 54), as in the above Examples 47–52, lower surface polyamide wefts are each strongly bent and interlaced with a pair of adjacent warps between which a warp interlacing with a upper surface weft is sandwiched in, thereby to remarkably improve crimpiness, and since the warp extending through between the two warps is present at the knuckle where said two warps approach each other whereby three-dimensional drainage spaces are formed and the uneven distribution of drainage spaces in the fabric is therefore prevented. Further, the lower surface polyester wefts are each interlaced at two positions in one repeat with a warp sandwiched in between a pair of warps which interlace with a lower surface polyamide weft, to form knuckles. These knuckles are situated in the staggered relation with those formed on the adjacent lower surface polyamide wefts and, therefore, drainage spaces are further prevented from being unevenly distributed and wire marks are fully prevented from being generated.

In the papermakers' double layer type fabrics in FIGS. 57 an 58 (Examples 53 and 54), a predetermined wear resistance is achieved.

Although not shown in Figures, there is also obtained a predetermined wear resistance on a papermakers' double layer type fabric F (18-shaft) wherein as the lower surface wefts, one long crimp-forming polyamide weft and two short crimp-forming polyester wefts are alternately arranged and mixedly woven in a ratio (in number) of 1:2.

In this manner, in the fabric F of this invention, the effective to-be-worn volume of lower surface wefts could be remarkably enlarged as compared with that of conventional fabrics, and the wear resistance of the fabric could be remarkably improved. This will, as in Example 1, be indicated by the following comparative tests.

The papermakers' fabric in FIG. 51 (Example 47), which is deemed typical of the fabrics F of this invention, and the conventional fabric in FIG. 59 (Comparative Example 1), are tested to compare the wear resistance therebetween.

In one repeat of the fabric F of FIG. 51 (Example 47), long crimp-forming lower surface wefts and short crimp-forming lower surface wefts are alternately arranged. Of these, the short crimp-forming lower surface wefts form crimps whose length is the same as that of crimps of the lower surface wefts in FIG. 59, and each of the wefts is considered to form two crimps in total in one repeat. One of these crimps crosses 7 warps and, like Example 1, the short crimp-forming lower surface wefts in one repeat are each considered to form two crimps whose total length is 14 (7×2) times the diameter of the warp, while the long crimp-forming lower surface wefts adjacent to said short crimp-forming wefts form longer crimps than the lower surface wefts of FIG. 59 do and one of said long crimp-forming wefts in one repeat is considered to form one crimp in total. This one crimp crosses 13 warps and, when thought likewise in case of Example 1, the long crimp-forming lower surface wefts in one repeat are each deemed to form a crimp whose length is 13 (13×1) times the diameter of the warp.

In the fabric F of this invention, since the lower surface polyamide wefts form long crimps and they are each interlaced with a pair of adjacent two warps between which a warp interlacing with a upper surface weft is sandwiched in, crimpiness is remarkably improved and polyamide wefts having a remarkably large diameter can be used.

Thus, in one repeat of FIG. 1, the volume of crimps of the adjacent two lower surface wefts is:

$$14\times0.17\times(0.22/2)^2\pi+13\times0.17\times(0.30/2)^2\pi=0.247\ \text{mm}^3$$

assuming that the diameters of the polyester warps, lower surface polyester wefts and lower surface polyamide wefts are 0.17 mm, 0.22 mm and 0.30 mm, respectively.

Thus, an increase in the to-be-worn volume of the fabric of FIG. 51 over the fabric of FIG. 59 is:

$$(0.247\div0.181-1)\times100=36.5(\%)$$

As mentioned above, even the rough calculation indicates that the fabric F of this invention (Example 47) has a to-be-worn volume which is about 37% larger than that of the conventional fabric (Comparative Example 1).

To make this clearer, the results of comparative tests carried out under the following test conditions are shown in the following Table 9.

TABLE 9

| | Fabrics of this invention | | | | | | Conventional fabric |
|---|---|---|---|---|---|---|---|
| | Example 1 | Example 7 | Example 13 | Example 24 | Example 35 | Example 47 | Comparative Example 1 |
| Dia. of warp (mm) | 0.17 (*1) | 0.17 (*1) | 0.17 (*1) | 0.17 (*1) | 0.17 (*1) | 0.17 (*1) | 0.17 (*1) |
| Dia. of upper surface weft (mm) | 0.17 (*1) | 0.17 (*1) | 0.17 (*1) | 0.17 (*1) | 0.17 (*1) | 0.17 (*1) | 0.17 (*1) |
| Dia. of lower surface weft (mm) | 0.22 (*1) | 0.30 (*1) | 0.22 (*1) | 0.25 (*1) | 0.22 (*1) | 0.22 (*1) | 0.22 (*1) |
| (1:1 mixedly woven) | 0.25 (*2) | 0.30 (*2) | 0.25 (*2) | 0.30 (*2) | 0.30 (*2) | 0.30 (*2) | 0.22 (*2) |
| No. of warps (per 25 mm) | 155 | 155 | 155 | 155 | 155 | 155 | 155 |
| No. of lower surface wefts (per 25 mm) | 58 | 52 | 58 | 50 | 52 | 52 | 58 |
| Time taken before lower surface weft being torn off by wear (hour) | 63 | 75 | 63 | 63 | 64 | 62 | 40 |

(*1) Polyester,
(*2) Polyamide

Mest method: Tests were carried out using heavy calcium carbonate as the filler by the use of a wear tester (which is registered as Japanese Utility Model No. 1350124 and produced by Nippon Filcon Co., Ltd.).

Test results: As indicated in the previous Table 9, the lower surface wefts of the fabrics of this invention took 1.5–1.9 times as long as those of a conventional fabric took to be torn off by wear (the times so taken being each considered as a wire service life).

Effects of the invention

As has so far been explained, in the papermakers' double layer type fabrics of this invention, polyester yarns and polyamide yarns are arranged as the lower surface wefts which form the running side surface (roller side surface) of the fabric, both the lower surface polymer wefts or the lower surface polyamide wefts are designed to have long crimps and crimpiness therefore becomes very satisfactory, whereby large diameter lower surface wefts, particularly large lower surface polyamide wefts, which so far has not been possible to use, are made usable and the wear resistance of the fabric can be remarkably improved without exerting adverse effects on papermaking performances such as the drainage of the fabric and anti-wire marking property and without impairing the rigidity of the fabric.

Further, in the papermakers' double layer type fabrics (in cases where they are the fabrics B), crimpiness is further satisfactory and further large wefts can be used, whereby the to-be-worn volume of the fabric can be remarkably large. Further, in these fabrics, a decrease in drainage spaces, which is caused by approaching the warps (interlacing with a lower surface weft) each other, is prevented, and the uneven distribution of drainage spaces is also prevented since the knuckles where the adjacent lower surface wefts are interlaced are situated in the staggered relation with each other. Accordingly, these fabrics are excellent in wear resistance and runability (posture stability) and enable the generation of wire marks to be fully prevented.

On the other hand, in the fabrics of this invention (in cases where they are the fabrics D, E or F), crimpiness is further satisfactory and further large polyamide wefts can be used whereby the to-be-worn volume of the fabric can be remarkably large. In these fabrics, the runability (posture) thereof can be satisfactorily maintained whereby the elongation of the fabrics caused by the use thereof is fully prevented and the wear resistance of the fabrics can be remarkably improved without having adverse effects on the papermaking performances such as the drainage and anti-wire marking of the fabrics.

Further, in the fabrics E of this invention, at least one warp interlacing with none of the lower surface wefts is arranged among the warps whereby the fabrics will not be torn off even if the warps exposing to the running side surface (lower surface) have been worn out, thus further improved wear resistance of the fabrics being ensured.

What is claimed is:

1. A papermakers' double layer type fabric comprising in one repeat a warp layer, said warp layer having an upper surface and a lower surface, said warp layer consisting of $n\times2$ of warps wherein n is an integer of at least 7, and $n\times2$ of wefts wherein n is as defined above arranged on said upper surface of said warp layer as the upper surface wefts and $n\times2$ of wefts wherein n is as defined above arranged under the lower surface of said warp layer as the lower surface wefts, the lower surface wefts consisting of polyester yarns and polyamide yarns, the lower surface polyamide wefts and the lower surface polyester wefts being each interlaced once in one repeat with a warp, wherein said lower surface polyamide wefts are of larger diameter than said lower surface polyester wefts.

2. A papermakers' double layer type fabric comprising in one repeat a warp layer, said warp layer having an upper surface and a lower surface, said warp layer consisting of $n\times2$ of warps wherein n is an integer of at least 7, and $n\times2$ of wefts wherein n is as defined above arranged on said upper surface of said warp layer as the upper surface wefts and $n\times2$ of wefts wherein n is as defined above arranged under the lower surface of said warp layer as the lower surface wefts, the lower surface wefts consisting of polyester yarns and polyamide yarns, wherein at least one of said $n\times2$ of warps is non-interlacing with any of said lower surface polyester and polyamide wefts, said lower surface polyamide and polyester wefts are each interlaced once in one repeat of the fabric with a pair of adjacent warps between which said non-interlacing warp is located to form a knuckle so that the knuckles so formed on each of the adjacent lower surface wefts are arranged in a staggered relation.

3. A papermakers' double layer type fabric according to claim 2, wherein a non-interlacing warp sandwiched in between a pair of warps interlacing with a lower surface polymeric weft, interlaces with an upper surface weft at a position where said pair of warps interlace with the lower surface polymeric weft.

4. A papermakers' double layer type fabric according to claim 2, wherein in said $n\times2$ of warps, a non-interlacing warp and a warp interlacing with a lower surface polymeric weft, are alternately arranged.

5. A papermakers' double layer type fabric according to claim 2, wherein in said $n\times2$ of warps, a non-interlacing warp and a plurality of warps interlacing with a lower surface polymeric weft, are alternately arranged.

6. A papermakers' double layer type fabric according to claim 2, wherein said lower surface polyamide wefts are of larger diameter than said lower surface polyester wefts.

7. A papermakers' double layer type fabric comprising in one repeat a warp layer, said warp layer having an upper surface and a lower surface, said warp layer consisting of $n\times2$ of warps, wherein n is an integer of at least 7, and $n\times2$ of wefts wherein n is as defined above arranged on said upper surface of said warp layer as the upper surface wefts and $n\times2$ of wefts wherein n is as defined above arranged under the lower surface of said warp layer as the lower surface wefts, the lower surface wefts consisting of polyester yarns and polyamide yarns, the lower surface polyamide wefts being each interlaced once in one repeat with a warp and the lower surface polyester wefts being each interlaced twice in one repeat with a warp.

8. A papermakers' double layer type fabric according to claim 7, wherein said lower surface polyamide wefts are of larger diameter than said lower surface polyester wefts.

9. A papermakers' double layer type fabric according to claim 7, wherein the number of said lower surface polyamide wefts and that of said lower surface polyester wefts are in a ratio of from 1:3 to 3:1.

10. A papermakers' double layer type fabric according to claim 7, wherein both said lower surface polyamide wefts and lower surface polyester wefts are each interlaced with two adjacent warps.

11. A papermakers' double layer type fabric according to claim 10, wherein said lower surface polyamide wefts are of larger diameter than said lower surface polyester wefts.

12. A papermakers' double layer type fabric according to claim 10, wherein the number of said lower surface polyamide wefts and that of said lower surface polyester wefts are in a ratio of from 1:3 to 3:1.

13. A papermakers' double layer type fabric according to claim 7, wherein said lower surface polyester wefts are each interlaced twice in one repeat with a warp, and said lower surface polyamide wefts are each interlaced once in one repeat with a pair of adjacent warps between which a warp interlacing with an upper surface weft at a position where said pair of warps interlace with the lower surface polyamide weft, is disposed.

14. A papermakers' double layer type fabric according to claim 13, wherein a non-interlacing warp is arranged adjacent to a warp interlacing with said lower surface polyester weft.

15. A papermakers' double layer type fabric according to claim 13, wherein at least one of a pair of warps which interlace with said lower surface polyamide weft also interlaces with the lower surface polyester weft.

16. A papermakers' double layer type fabric according to claim 13, wherein said lower surface polyamide wefts are of larger diameter than said lower surface polyester wefts.

17. A papermakers' double layer type fabric according to claim 13, wherein the number of said lower surface polyamide wefts and that of said lower surface polyester wefts are in a ratio of 1:3 to 3:1.

18. A papermakers' double layer type fabric according to claim 13, wherein said lower surface polyamide wefts are each interlaced once in one repeat with a pair of adjacent warps between which a warp interlacing with an upper surface weft at a position where said pair of warps interlace with the lower surface polyamide weft, is disposed, and said lower surface polyester wefts are each interlaced twice in one repeat with a warp located between a pair of warps interlacing with a lower surface polyamide weft.

19. A papermakers' double layer type fabric according to claim 18, wherein said lower surface polyamide wefts are of larger diameter than said lower surface polyester wefts.

20. A papermakers' double layer type fabric according to claim 18, wherein the number of said lower surface polyamide wefts and that of said lower surface polyester wefts are in a ratio of from 1:3 to 3:1.

* * * * *